United States Patent [19]

Kohno et al.

[11] Patent Number: 4,837,141

[45] Date of Patent: Jun. 6, 1989

[54] THERMALLY DEVELOPABLE LIGHT-SENSITIVE MATERIAL CONTAINING A DEVELOPMENT RESTRAINER COMPOUND

[75] Inventors: Junichi Kohno; Ken Okauchi, both of Hachioji; Sohei Goto; Masaru Iwagaki, both of Hino; Tawara Komamura, Hachioji, all of Japan

[73] Assignee: Konishiroku Photo Industry Co., Ltd., Tokyo, Japan

[21] Appl. No.: 191,781

[22] Filed: May 3, 1988

Related U.S. Application Data

[63] Continuation of Ser. No. 907,670, Sep. 15, 1986, abandoned.

[30] Foreign Application Priority Data

| | | | |
|---|---|---|---|
| Sep. 17, 1985 | [JP] | Japan | 60-205129 |
| Oct. 1, 1985 | [JP] | Japan | 60-218769 |
| Oct. 17, 1985 | [JP] | Japan | 60-232263 |
| Nov. 20, 1985 | [JP] | Japan | 60-262177 |
| Nov. 22, 1985 | [JP] | Japan | 60-263564 |

[51] Int. Cl.[4] ..... G03C 1/06

[52] U.S. Cl. ..... 430/559; 430/607; 430/611; 430/614; 430/615; 430/617; 430/957

[58] Field of Search ..... 430/203, 559, 607, 661, 430/614, 615, 617, 957

[56] References Cited

U.S. PATENT DOCUMENTS

| | | | |
|---|---|---|---|
| 3,832,186 | 8/1974 | Masuda et al. | 430/617 |
| 4,511,644 | 4/1985 | Okamura et al. | 430/957 |
| 4,546,073 | 10/1985 | Bergtholler et al. | 430/957 |
| 4,546,075 | 10/1985 | Kitaguchi et al. | 430/617 |
| 4,584,257 | 4/1986 | Okamura et al. | 430/219 |
| 4,607,004 | 8/1986 | Ikenoue et al. | 430/611 |
| 4,610,957 | 9/1986 | Kato et al. | 430/957 |

*Primary Examiner*—Paul R. Michl
*Assistant Examiner*—Patrick A. Doody
*Attorney, Agent, or Firm*—Jordan B. Bierman

[57] ABSTRACT

A thermally developable light-sensitive material is disclosed that the said material has at least one light-sensitive silver halide containing layer on a support and which further contains a compound represented by the general formula (I):

$$X\text{-}(J_m F)_n \qquad \text{(I)}$$

wherein X is the residue of the development restrainer; J is a divalent linkage; F is an immobilizing group that is capable of reducing the diffusibility of the compound of formula (I) or a silver salt or silver complex thereof during thermal development; m is 0 or 1; and n is an integer of 1 to 3.

17 Claims, No Drawings

THERMALLY DEVELOPABLE LIGHT-SENSITIVE MATERIAL CONTAINING A DEVELOPMENT RESTRAINER COMPOUND

This application is a continuation of application Ser. No. 907,670, filed Sept. 15, 1986, now abandoned.

BACKGROUND OF THE INVENTION

The present invention relates to a thermally developable light-sensitive material, and more particularly to one that experiences only a small amount of fog during thermal development (this fog is hereinafter referred to as thermal fog).

The silver-image forming, thermally developable light-sensitive material to be processed for development by dry heat, has the disadvantage that an adequately high image density cannot be attained without increasing the level of fog, which is the minimum density obtained in the unexposed portions of the material.

Various compounds have been proposed for use in thermally developable light-sensitive materials as agents that are capable of preventing thermal fog (hereinafter also referred to as development restrainers). Examples of these agents include mercury compounds (U.S. Pat. No. 3,589,903), N-halogeno compounds (West German Pat. No. 2,402,161), Peroxides (West German Pat. No. 2,500,508), sulfur compounds (West German Pat. No. 2,617,907), palladium compounds (U.S. Pat. No. 4,102,312), sulfinic acids (Japanese Patent Publication No. 28417/1978), mercaptotriazoles (Research Disclosure Nos. 169077 and 169079), and 1,2,4-triazole (U.S. Pat. No. 4,137,079).

However, none of these development restrainers are completely satisfactory since they are either quite harmful to humans or low in their effectiveness in preventing thermal fog.

The present inventors previously filed Japanese Patent Application No. 66386/1984 wherein they proposed that a thermally developable light-sensitive material that will experience only a small degree of thermal fog can be attained by incorporating in at least one light-sensitive layer an antifoggant that consists of a hydroquinone or phenol derivative based compound and benzotriazole or a derivative thereof. However, the improvement achieved by this proposal was still unsatisfactory and it has been desired to offer a thermally developable light-sensitive material that will experience an even smaller degree of thermal fog.

SUMMARY OF THE INVENTION

One object, therefore, of the present invention is to provide a thermally developable light-sensitive material that will experience a minimum degree of thermal fog.

Another object of the present invention is to provide a thermally developable color light-sensitive material that experiences a minimum degree of thermal fog and which yet attains a high maximum density.

These objects of the present invention can be attained by a thermally developable light-sensitive material that has at least one light-sensitive silver halide containing layer on a support and which further contains a compound represented by the general formula [I]:

$$X\{(J)_m F\}_n \qquad [I]$$

wherein X is the residue of the development restrainer; J is a divalent linkage; F is an immobilizing group that is capable of reducing the diffusibility of the compound of formula [I] or a silver salt or silver complex thereof during thermal development; m is 0 or 1; and n is an integer of 1 to 3.

SPECIFIC EMBODIMENTS OF THE INVENTION

The compound represented by the general formula [I] (hereunder referred to as the restrainer of the present invention) is hereinafter described in detail. The residue of the development restrainer of the formula [I] which is denoted by X may be the residue of any of the organic compounds that are known as restrainers (or antifoggants) for use in conventional silver halide photographic materials, as shown in "Fundamentals of Photographic Technology", Part I, Silver Salt Photography, ed. by the Society of Photographic Science and Technology of Japan, published by Corona-sha, p. 354, 1979; A. Sasai, "Photographic Chemistry", pp. 168–169, Shashin Kogyo Shuppansha, and The Theory of the Photographic Process, 4th edition, ed. by T. H. James, Macmillan Publishing Co., Inc., 1977, pp. 396–399. Preferably, X is selected from among the residues of those organic compounds which form silver salts having solubility products (pKsp) of 10 or more in water at 25° C.

Preferable restrainers are represented by the following general formulas (1) to (17):

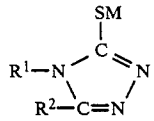

(1)

(where $R^1$ and $R^2$ are each a hydrogen atom, an alkyl group or an aryl group; and M is a hydrogen atom, an alkali metal atom, an ammonium group or an organic amino residue);

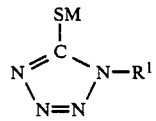

(2)

[wherein $R^1$ is an alkyl group, an aryl group or a hydrogen atom; and M has the same meaning as M in formula (1)];

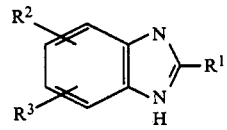

(3)

(wherein $R^1$ is a hydrogen atom, an alkyl group, an aryl group or

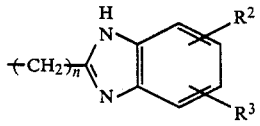

where n is 1 or 2; $R^2$ and $R^3$ are each a hydrogen atom, an alkyl group, an aryl group or a nitro group, provided that $R^2$ may combine with $R^3$ to form a 5- or 6-membered ring);

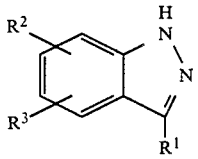

(4)

(where $R^1$ is an alkyl group, an aryl group or a hydrogen atom; $R^2$ and $R^3$ are each a hydrogen atom, an alkyl group, an aryl group or a nitro group, provided that $R^2$ may combine with $R^3$ to form a 5- or 6-membered ring);

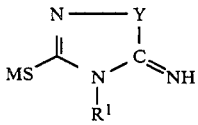

(5)

[where Y is

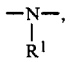

—O— or —S—; $R^1$ is an alkyl group, an aryl group or a hydrogen atom; and M has the same meaning as M in formula (1)];

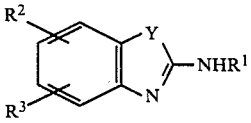

(6)

(where Y is —O—, —S—,

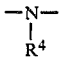

or

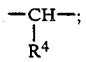

$R^1$ and $R^4$ are each an alkyl group, an aryl group or a hydrogen atom; $R^2$ and $R^3$ are each a hydrogen atom, an alkyl group, an aryl group or a nitro group, provided that $R^2$ may combine with $R^3$ to form a 5- or 6-membered ring);

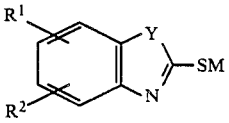

(7)

[where Y has the same meaning as Y in formula (6); $R^1$ and $R^2$ have the same meanings as $R^2$ and $R^3$ in formula (6); and M has the same meaning as M in formula (1)];

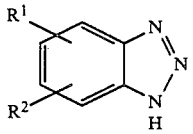

(8)

(where $R^1$ and $R^2$ are each a hydrogen atom, an alkyl group, an aryl group, a nitro group or a halogen atom, provided that $R^1$ may combine with $R^2$ to form a 5- or 6-membered ring);

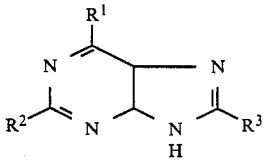

(9)

(where $R^1$, $R^2$ and $R^3$ are each an alkyl group, an amino group, an alkoxy group, a thioalkoxy group, —SM where M has the same meaning as M in formula (1), a hydroxyl group or a hydrogen atom);

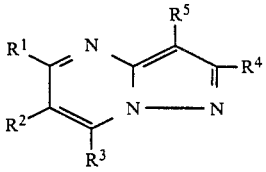

(10)

[where $R^1$, $R^2$, $R^3$, $R^4$ and $R^5$ are each a hydrogen atom, an alkyl group, an aryl group, $R^6$—NH— where $R^6$ is a hydrogen atom, an alkyl group or an aryl group, —SM where M has the same meaning as M in formula (1), an alkylthio group, a hydroxyl group or an alkoxy group];

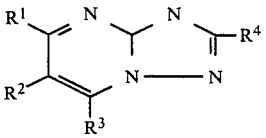

(11)

[where $R^1$, $R^2$, $R^3$ and $R^4$ each has the same meaning as $R^1$ to $R^5$ in formula (10)];

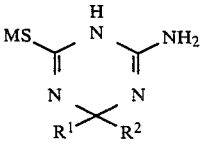

(12)

[where $R^1$ and $R^2$ are each an alkyl group or a hydrogen atom; and M has the same meaning as M in formula (1)];

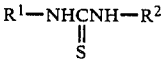

(13)

(where $R^1$ and $R^2$ are each an alkyl group, an aryl group or a hydrogen atom, provided that $R^1$ may combine with $R^2$ to form a 5- or 6-membered ring);

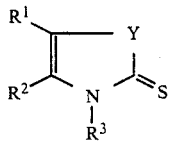

(14)

(where $R^1$, $R^2$ and $R^3$ are each an alkyl group, an aryl group or a hydrogen atom, provided that $R^1$ may combine with $R^2$ to form a 5- or 6-membered ring; Y is —O—, —S— or

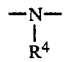

where $R^4$ is a hydrogen atom or an alkyl group);

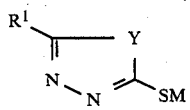

(15)

[where $R^1$ is an alkyl group, an aryl group or a hydrogen atom; Y is —O—, —S— or

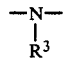

where $R^3$ is a hydrogen atom or an alkyl group; and M has the same meaning as M in formula (1)];

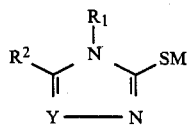

(16)

[where Y is

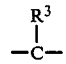

or =N— where $R^3$ is a hydrogen atom or an alkyl group; $R^1$ and $R^2$ are each an alkyl group, an aryl group or a hydrogen atom, provided that $R^1$ and $R^2$ may combine with each other to form a 5- or 6-membered ring; and M has the same meaning as M in formula (1)];

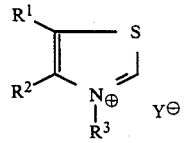

(17)

[where $R^1$, $R^2$ and $R^3$ have the same meanings as $R^1$ to $R^3$ in formula (14); and $Y^{\ominus}$ is a counter anion].

Preferable development restrainer residues are those of nitrogenous heterocyclic rings having an —SM group where M is a hydrogen atom, an alkali metal atom, an ammonium group or an organic amino residue, and the residue of a development restrainer of the formula (2) or (7) is particularly preferable.

Examples of the divalent linkage denoted by J in formula (I) include the following: —CONH—, —$SO_2$NH—, —NHCONH—, —COO—,

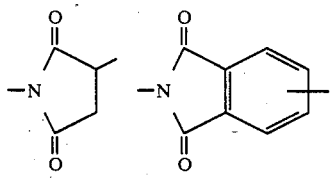

—NHCO—, —$NHSO_2$—, —O—, —S—,

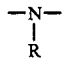

(R is H or an alkyl group) and —CO—.

Also preferable are alkylene groups having 1–7 carbon atoms (e.g. methylene, ethylene and propylene), arylene groups e.g. p-phenylene, m-phenylene and o-phenylene); imino groups, carbonyl groups, sulfonyl groups, ether groups and combinations thereof (e.g. alkylenecarbonylamino, aralkyleneamino and sulfonylamino).

The immobilizing group denoted by F in formula [I] may be a hydrophilic group or a group having a hydrophilic group, a ballast group, or a polymer residue having a building block derived from an ethylenically unsaturated group or a group having an ethylenically unsaturated group. If the immobilizing group denoted by F is a hydrophilic group or a group having a hydrophilic group, said hydrophilic group is preferably a hydroxyl group, a carboxyl group or a salt thereof, a sulfo group or a salt thereof, or a sulfinic acid group or a salt thereof.

Preferable embodiments of the restrainer [I] are hereunder described with reference to the case where the immobilizing group denoted by F is a hydrophilic group or a group having a hydrophilic group as in formula [I-A]

X—J—R [I-A]

where X is the residue of the development restrainer; J is a divalent linkage; and R is a hydroxyl group, a carboxyl group or a salt thereof, a sulfo group or a salt thereof, or a sulfinic acid group or a salt thereof.

The residue X of the restrainer of formula [I-A] has the same meaning as X in formula (I). The divalent linkage J has the same meaning as J in formula [I] and the one represented by the following general formula (20) is preferable:

$$-(L)_n- \quad (20)$$

where L is an alkylene group having 1–7 carbon atoms (e.g. methylene, ethylene or propylene), an arylene group (e.g. p-phenylene, m-phenylene or o-phenylene), an imino group, a carbonyl group, a sulfonyl group, an ether group or a combination thereof (e.g. alkylenecarbonylamino, aralkyleneamino or sulfonylamino); and n is 0 or 1.

Particularly preferable compounds of formula [I-A] are those wherein the restrainer residue denoted by X has an —SH group, with compounds wherein X is a nitrogenous heterocyclic residue and R is a sulfo group or a salt thereof being most preferable.

Particularly preferable compounds represented by formula [I-A] are those represented by the following formulas [I-D] and [I-E]:

Compounds represented by the following general formulas [I-D] and [I-E] are other examples of the case where the immobilizing group signified by F in formula [I] is a hydrophilic group or a group having a hydrophilic group.

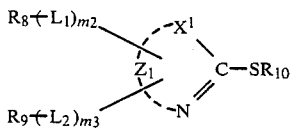

[I-D]

where $X^1$ is —O—, —S—, —Se— or $>N(L_3)_{\overline{m4}}R_{11}$; $Z_1$ represents the nonmetallic atomic group necessary for forming a 5- or 6-membered heterocyclic ring (including the case where unsaturated rings are condensed); $L_1$, $L_2$ and $L_3$ are each a divalent group; m2, m3 and m4 are each 0 or 1; $R_8$, $R_9$ and $R_{11}$ are each a hydrogen atom, a halogen atom, a mercapto group, a hydroxyl group, a carboxylic acid group or a salt thereof, a sulfonic acid group or a salt thereof, an alkyl group or an aryl group, provided that at least one of $R_8$, $R_9$ and $R_{11}$ is a hydroxyl group, a carboxylic acid group or a salt thereof, or a sulfonic acid group or a salt thereof; $R_{10}$ is a hydrogen atom, an alkali metal ion, a quarternary ammonium ion or a quarternary phosphonium ion;

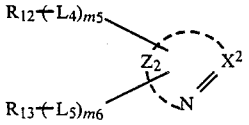

[I-E]

where $X^2$ is a carbon or nitrogen atom participating in the formation of an unsaturated ring; $Z^2$ represents the nonmetallic atomic group necessary for forming a 5- or 6-membered heterocylic ring (including the case where unsaturated rings are condensed); $L_4$ and $L_5$ are each a divalent group having the same meaning as $L_1$, $L_2$ or $L_3$ in formula [I-D]; m5 and m6 are each 0 or 1; $R_{12}$ and $R_{13}$ are each a hydrogen atom, a halogen atom, a hydroxyalkyl group, a carboxylic acid group or a salt thereof, a sulfonic acid group or a salt thereof, an amino group, an alkyl group or an aryl group, provided that at least one of $R_{12}$ and $R_{13}$ is a hydroxyalkyl group, a carboxylic acid group or salt thereof, or a sulfonic acid group or a salt thereof.

Examples of the divalent group denoted by $L_1$, $L_2$ and $L_3$ in formula [I-D] include alkylene groups such as methylene, ethylene, and propylene; arylene groups such as p-phenylene, m-phenylene and o-phenylene; an imino group; a carbonyl group; a sulfonyl group; an ether group; and combinations thereof such as acylimino, sulfonimino and aryleneimino.

In formula [I-D], $R_8$, $R_9$ and $R_{11}$ (when X is $>N(L_3)_{\overline{m4}}R_{11}$) each represents a hydrogen atom, a halogen atom (e.g. Cl, Br or F), a mercapto group, a hydroxyl group, a carboxylic acid group or a salt thereof, a sulfonic acid group or a salt thereof, an alkyl group (e.g. methyl, ethyl, i-propyl or trifluoromethyl) or an aryl group (e.g. phenyl, p-tolyl or naphthyl).

If $L_1$ and/or $L_2$ is an imino group, the linking $R_8$ or $R_9$ is free of any hydrogen atom. At least one of $R_8$, $R_9$ and $R_{11}$ is a hydroxyl group, a carboxylic acid group or a salt thereof, or a sulfonic acid group or a salt thereof. In formula [I-D], $R_{10}$ represents a hydrogen atom, an alkali metal ion (e.g. Na or K ion), a quaternary ammonium ion or a quarternary phosphonium ion.

In formula [I-E], each of $R_{12}$ and $R_{13}$ represents a hydrogen atom, a halogen atom (e.g. Cl, Br or F), a hydroxylalkyl group, a carboxylic acid group or a salt thereof, a sulfonic acid group or a salt thereof, an amino group, an alkyl group (e.g. methyl, ethyl, propyl or trifluoromethyl), or an aryl group (e.g. phenyl, p-tolyl or naphthyl), provided that at least one of $R_{12}$ and $R_{13}$ is a hydroxyalkyl group, a carboxylic acid group or a salt thereof, or a sulfonic acid group or a salt thereof.

Preferable examples of the compound represented by formula [I-A] are listed below but it should be understood that the scope of the present invention is by no means limited to these particular examples.

Illustrative compounds [I-A]

(A-1)

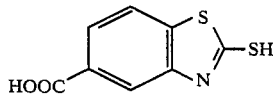

(A-2)

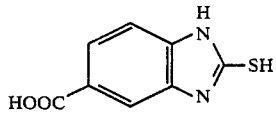

(A-3)

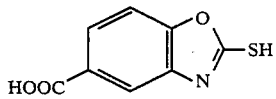

(A-4)

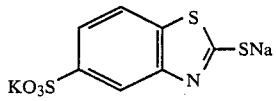

(A-5)

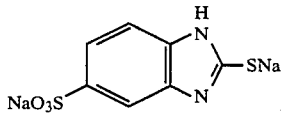

(A-6)

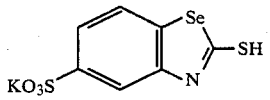

(A-7)

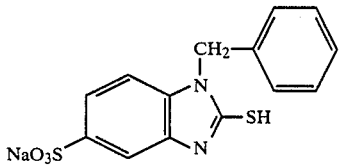

(A-8)

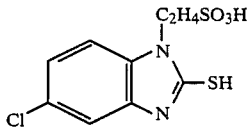

-continued
Illustrative compounds [I-A]
(A-9)
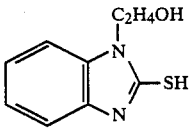
(A-10)
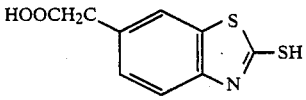
(A-11)
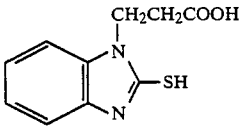
(A-12)
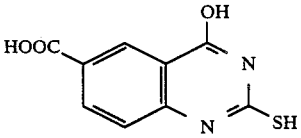
(A-13)
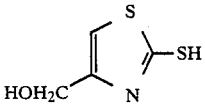
(A-14)
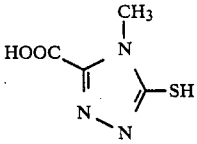
(A-15)
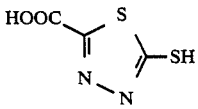
(A-16)
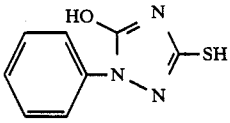
(A-17)
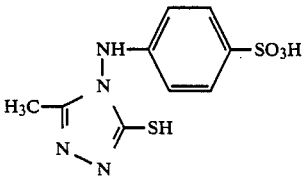
(A-18)
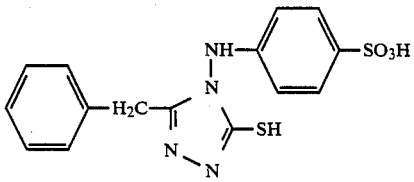
(A-19)
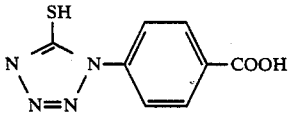
-continued
Illustrative compounds [I-A]
(A-20)
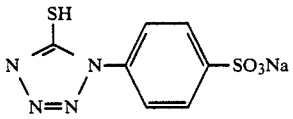
(A-21)
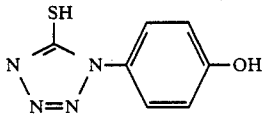
(A-22)
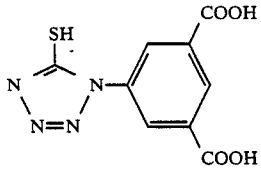
(A-23)
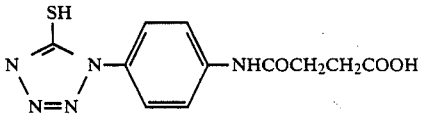
(A-24)
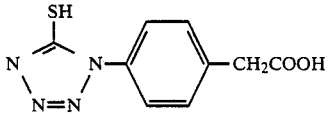
(A-25)
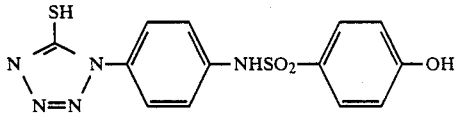
(A-26)
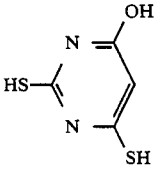
(A-27)
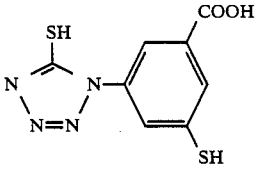
(A-28)
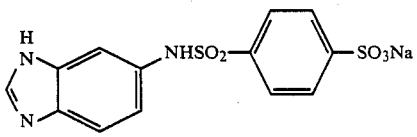
(A-29)
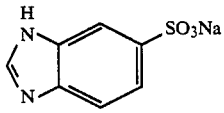
(A-30)
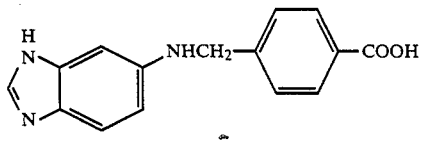

-continued

Illustrative compounds [I-A]

(A-31)

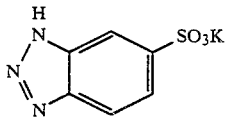

(A-32)

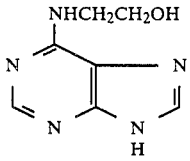

(A-33)

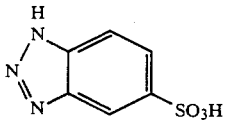

(A-34)

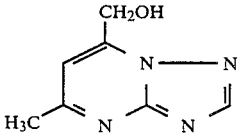

(A-35)

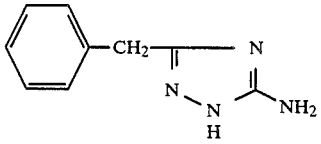

(A-36)

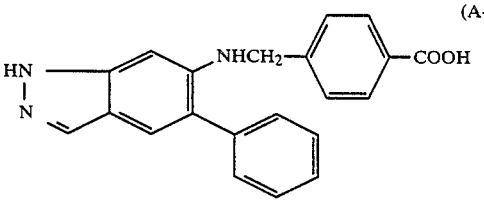

(A-37)

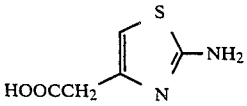

(A-38)

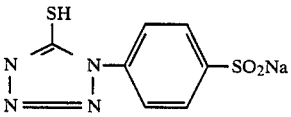

(A-39)

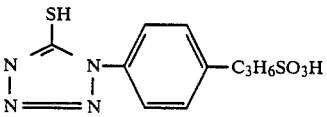

(A-40)

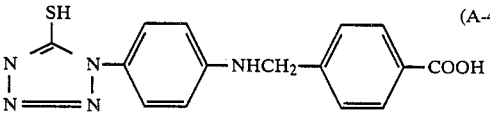

-continued

Illustrative compounds [I-A]

(A-41)

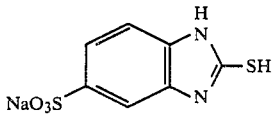

(A-42)

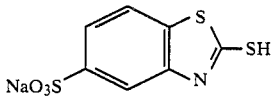

(A-43)

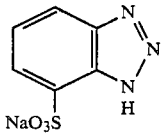

(A-44)

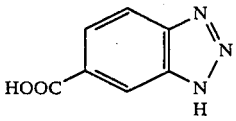

The restrainers of the present invention that are represented by the formula [I-A] can be synthesized by routine procedures such as the ones described in Chemische Berichte, 86, pp. 314, 1953; Canadian Journal of Chemistry, 37, p. 101, 1959; Journal of Chemical Society, 49, p. 1748, 1927; British Pat. No. 1,275,710; U.S. Pat. No. 3,266,897; and Japanese Patent Application (OPI) Nos. 89034/1975, 28426/1978, 21067/1980, 111846/1981, etc.

The effect of the present invention can be attained more effectively when the compound represented by the formula [I-D] or [I-E] is incorporated in a thermally developable light-sensitive material in combination with a compound represented by the following general formula [II]:

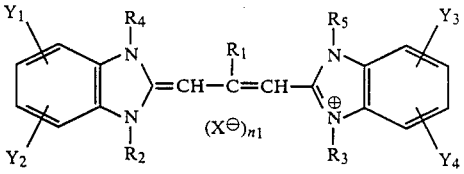

[II]

where $Y_1$, $Y_2$, $Y_3$ and $Y_4$ are each a hydrogen atom, a halogen atom, an acyl group, an acylamido group, an acyloxy group, an alkoxycarbonyl group, an aryloxycarbonyl group, an alkoxycarbonylamino group, a cyano group, a sulfonyl group, an alkyl group or an aryl group, provided that $Y_1$ and $Y_2$ (and/or $Y_3$ and $Y_4$) may combine with each other to form a naphthodiazole ring; $R_1$ is a hydrogen atom or an alkyl group; $R_2$, $R_3$, $R_4$ and $R_5$ are each an alkyl or alkenyl group; $X^{\ominus}$ is an anion; nl is 0 or 1, provided that when nl is 0, $R_2$, $R_3$, $R_4$ or $R_5$ represents a group capable of forming an intramolecular salt.

Typical examples of the sensitizing dye represented by formula [II] are listed below but it should be understood that the scope of the present invention is by no means limited to these particular examples.

Illustrative compounds [II]
(II-1)
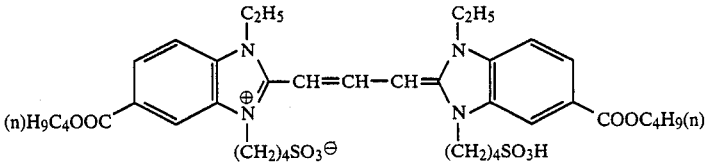
(II-2)
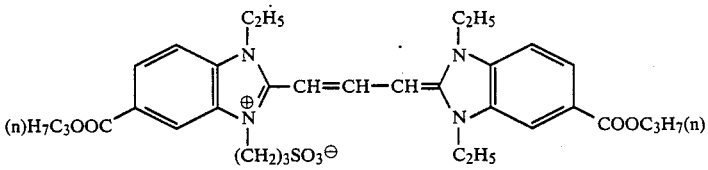
(II-3)
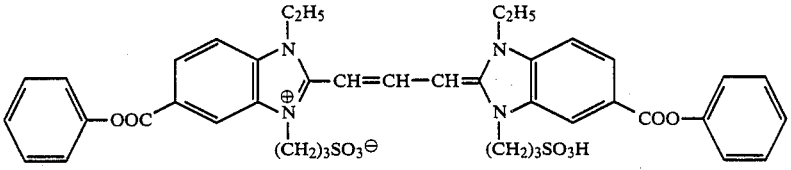
(II-4)
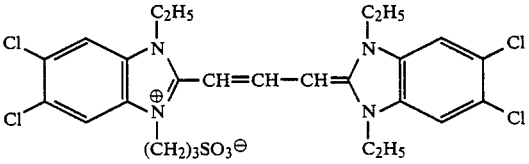
(II-5)
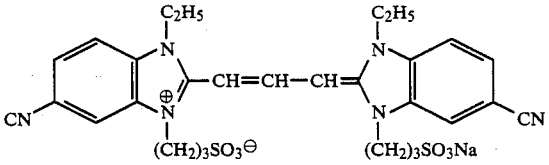
(II-6)
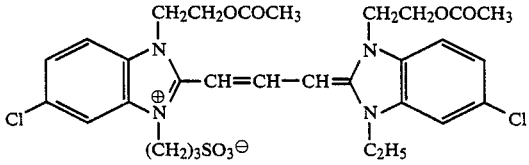
(II-7)
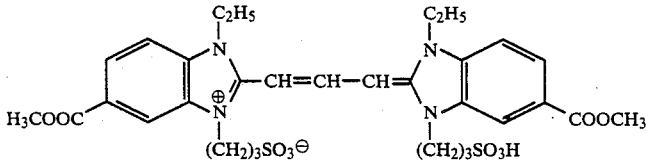
(II-8)
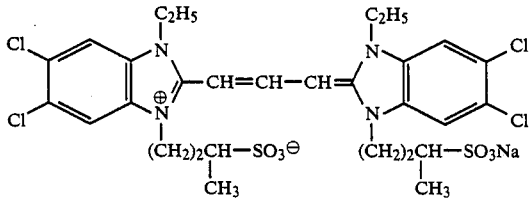
(II-9)
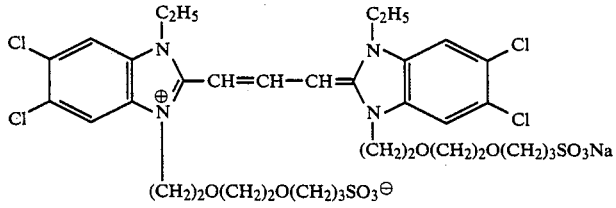

-continued
Illustrative compounds [II]
(II-10)
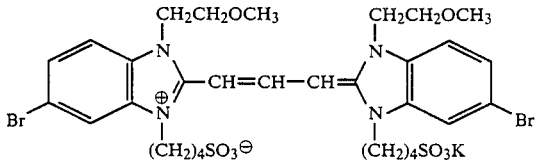
(II-11)
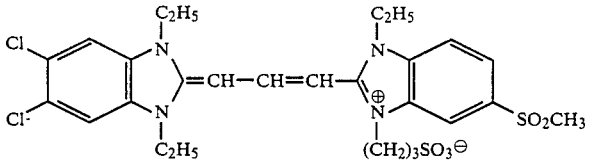
(II-12)
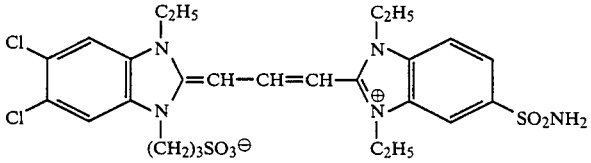
(II-13)
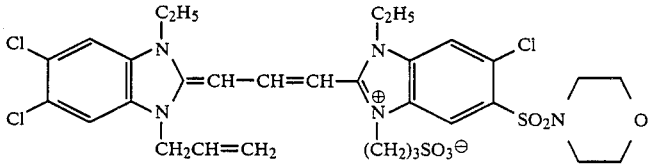
(II-14)
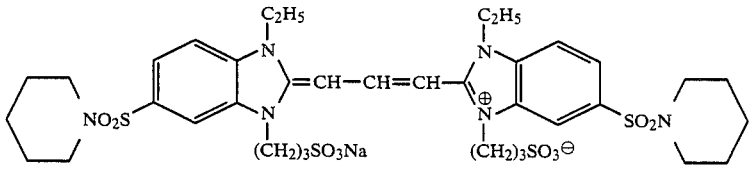
(II-15)
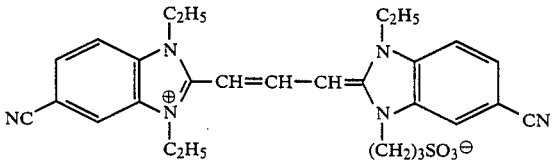
(II-16)
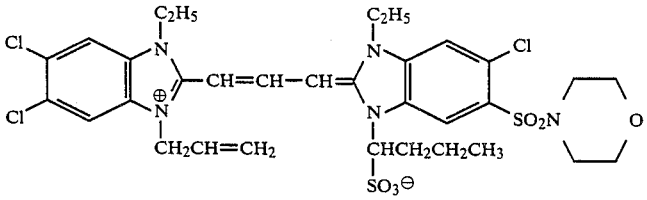
(II-17)
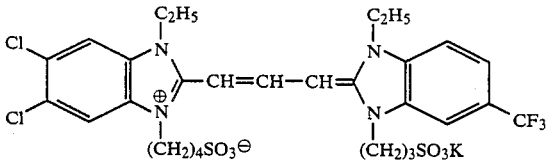
(II-18)
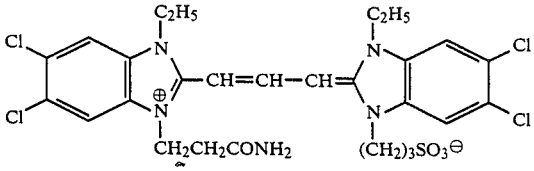

-continued
Illustrative compounds [II]
(II-19)
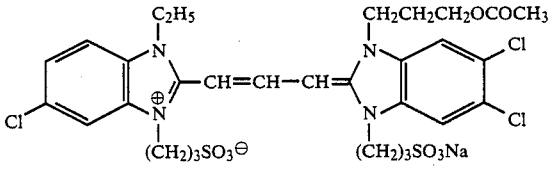
(II-20)
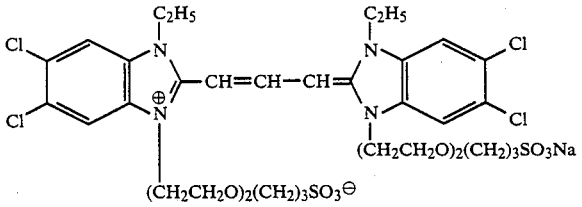
(II-21)
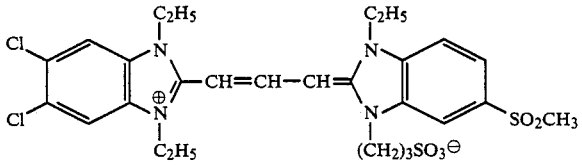
(II-22)
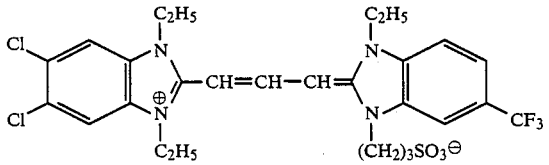
(II-23)
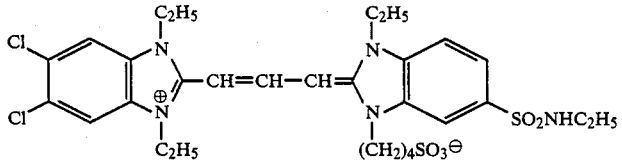
(II-24)
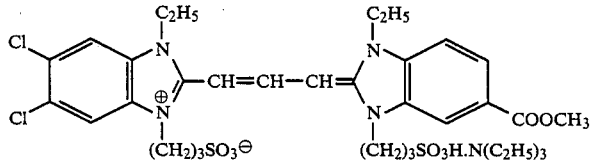
(II-25)
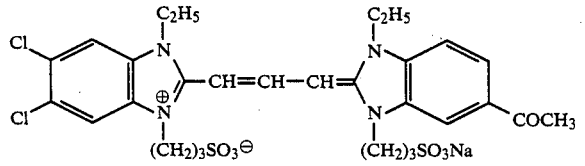
(II-26)
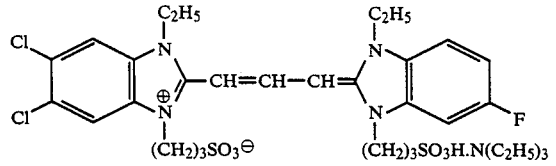
(II-27)
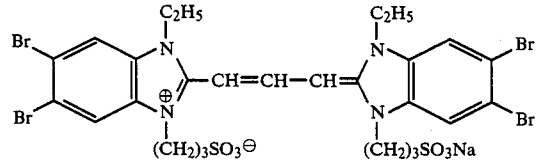

-continued
Illustrative compounds [II]
(II-28)
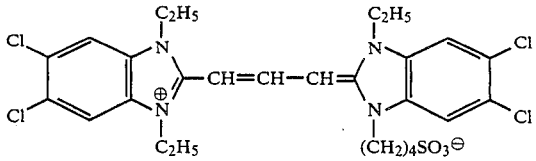
(II-29)
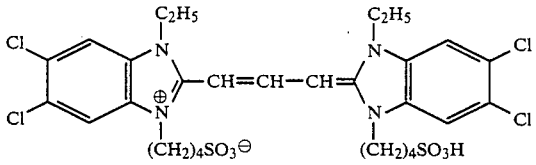
(II-30)
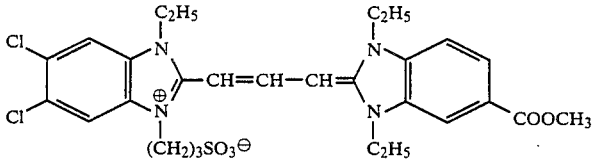
(II-31)
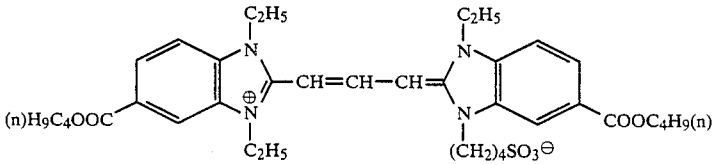
(II-32)
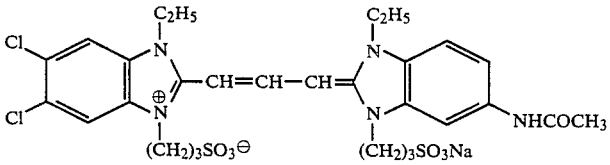
(II-33)
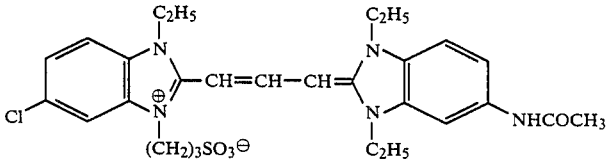
(II-34)
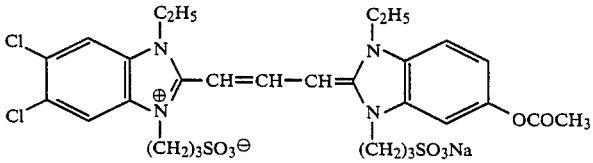
(II-35)
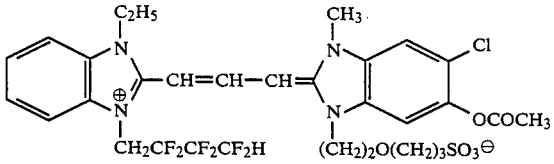
(II-36)
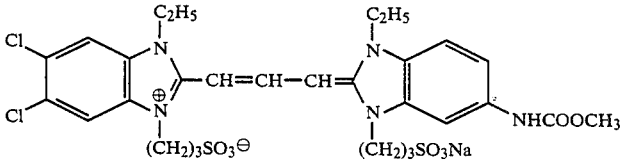

-continued

Illustrative compounds [II]

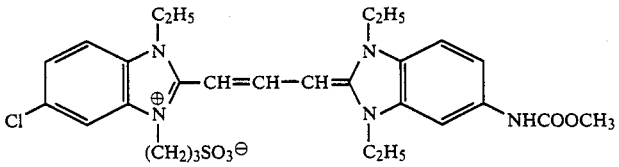

(II-37)

Examples of the sensitizing dye of the present invention which are represented by formula [II] are mentioned in U.S. Pat. Nos. 3,397,060 and 3,506,443, which also describe methods for synthesizing these examples. Those sensitizing dyes which are not illustrated in these patents may be readily synthesized by those skilled in the art who rely upon the discolosure in these patents.

The sensitizing dye of the present invention may be incorporated in a silver halide emulsion by any of the methods so far proposed in the art. See, for example, U.S. Pat. No. 3,469,987, where the sensitizing dye is dissolved in a volatile organic solvent, the resulting solvent being dispersed in a hydrophilic colloid, and the dispersion added to an emulsion.

Solvents which are preferably used in incorporating the sensitizing dye of the present invention in a silver halide emulsion are water-miscible organic solvents such as methyl alcohol, ethyl alcohol and acetone.

The sensitizing dye of the present invention is incorporated in a silver halide emulsion in an amount which preferably ranges from $1.0\times10^{-5}$ to $2.5\times10^{-2}$ moles, more preferably from $1.0\times10^{-4}$ to $1.0\times10^{-3}$ moles, per mole of the light-sensitive silver halide.

The sensitizing dye of the present invention may optionally be used in combination with other sensitizing dyes or appropriate supersensitizers.

When the sensitizing dye of the present invention is used in combination with the restrainer represented by the general formula [I-D] or [I-E], the following mixing proportions are employed: if the restrainer of formula [I-D] is used, its molar ratio to the sensitizing dye of the present invention preferably ranges from 0.1 to 100, more preferably from 0.5 to 50; if the restrainer of formula [I-E 9 is used, its molar ratio to the sensitizing dye preferably ranges from 0.1 to 500, more preferably from 1 to 200.

The objects of the present invention can be attained in an even more effective manner if the compound represented by formula [I-D] or [D-E] is incorporated in a thermally developable light-sensitive material in combination with at least one compound selected from the group of compounds represented by the following general formulas [III] and [IV]:

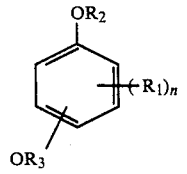

[III]

In formula [III], $R_1$ represents a halogen atom (e.g. Cl, Br or I), an alkyl group (which is preferably an alkyl group having 1–24 carbon atoms such as methyl, ethyl, butyl, t-amyl, t-octyl, n-dodecyl, n-pentadecyl or cyclohexyl, and may be benzyl or phenethyl which is an alkyl group substituted by an aryl group such as phenyl), an aryl group (e.g. phenyl, naphthyl, tolyl or mesityl), an acyl group (e.g. acetyl, tetradecanoyl, pivaloyl, or substituted or unsubstituted benzyol), an alkyloxycarbonyl group (e.g. methoxycarbonyl or benzyloxycarbonyl), an aryloxycarbonyl group (e.g. phenoxycarbonyl, p-tolyloxycarbonyl or α-naphtoxycarbonyl), an alkylsulfonyl (e.g. methylsulfonyl), an arylsulfonyl (e.g. phenylsulfonyl) or dodecylphenylsulfonyl), an alkylamino group (e.g. ethylamino or t-octylamino), an arylamino group (e.g. anilino which optionally has a substituent such as a halogen atom, an alkyl group, an amido group or an imido group), a carbamoyl group (e.g. a substituted or unsubstituted alkylcarbamoyl group such as methylcarbamoyl, butylcarbamoyl, tetradecylcarbamoyl or N-methyl-N-dodecylcarbamoyl; an optionally substituted phenoxyalkylcarbamoyl group such as 2,4-di-t-phenoxybutylcarbamoyl; or a substituted or unsubstituted phenylcarbamoyl group such as 2-dodecyloxyphenylcarbamoyl), an acylamino group (e.g. n-butylamido, laurylamido, an optionally substituted β-phenoxyethylamido, phenoxyacetamido, substituted or unsubstituted benzamido, methanesulfonamidoethylamido, or β-methoxyethylamido), an alkoxy group (which is preferably an alkoxy group having 1–18 carbon atoms such as methoxy, ethoxy or octadecyloxy), a sulfamoyl group (e.g. an alkylsulfamoyl group such as methylsulfamoyl or n-dodecylsulfamoyl; a substituted or unsubstituted phenylsulfamoyl group such as an arylsulfamoyl group illustrated by dodecylphenylsulfamoyl), a sulfonic acid group or a salt thereof, a carboxylic acid group or a salt thereof, a nitro group, or a hydroxyl group; when n is more than one, $R_1$ may combine with each other to form a saturated or unsaturated 5- or 6-membered ring.

In formula [III], $R_2$ and $R_3$ are each a hydrogen atom or a protective group that will be eliminated upon decomposition, preferably under alkaline conditions, as illustrated by

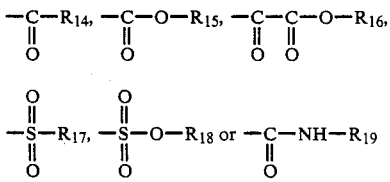

wherein $R_{14}$ to $R_{19}$ are each an alkyl, cycloalkyl, alkenyl or aryl group which may be substituted by a halogen atom such as chlorine, bromine or fluorine; n is an integer of 1 to 4.

Specific examples of the compound represented by formula [III] are listed below but it should be understood that the scope of the present invention are by no means limited to these particular examples.

Illustrative compounds [III]

-continued
(III-1)
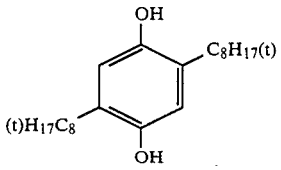
(III-2)
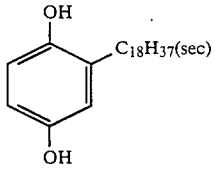
(III-3)
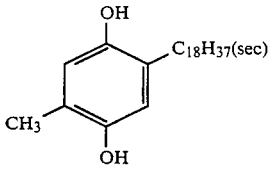
(III-4)
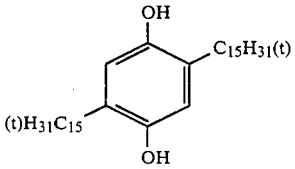
(III-5)
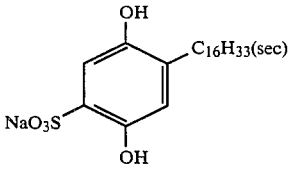
(III-6)
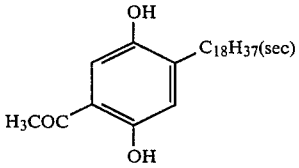
(III-7)
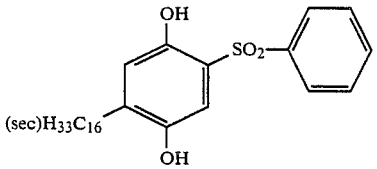
(III-8)
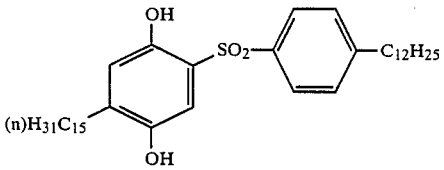
(III-9)
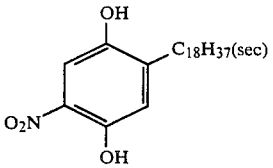
-continued
(III-10)
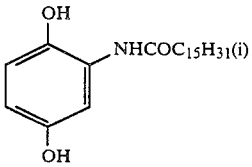
(III-11)
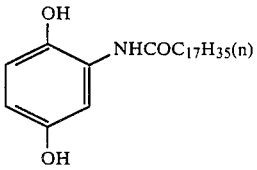
(III-12)
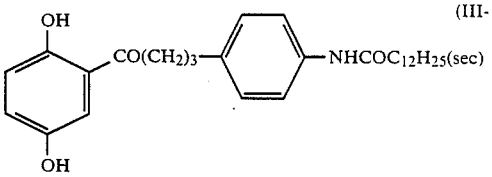
(III-13)
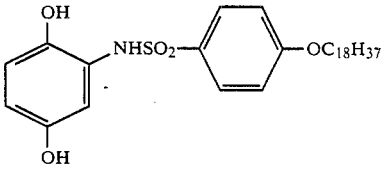
(III-14)
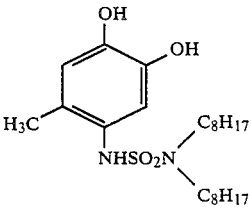
(III-15)
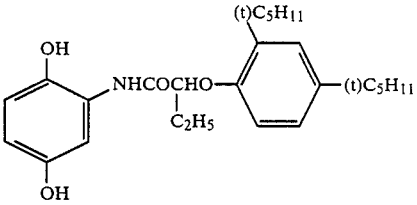
(III-16)
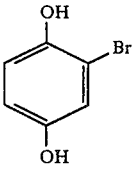
(III-17)
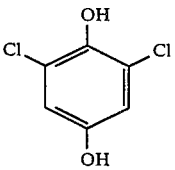

-continued (III-18)

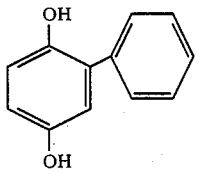

(III-19)

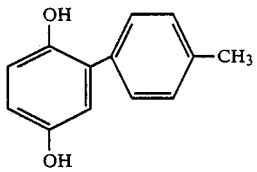

(III-20)

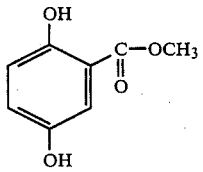

(III-21)

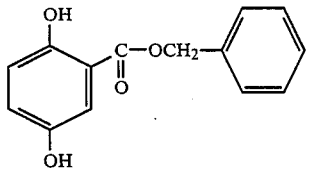

(III-22)

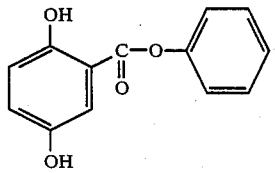

(III-23)

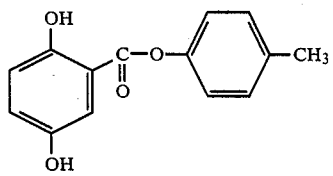

(III-24)

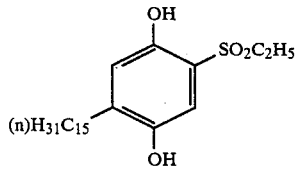

(III-25)

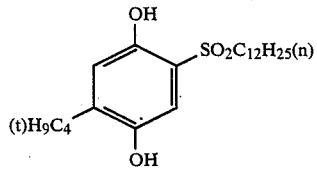

(III-26)

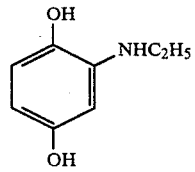

-continued (III-27)

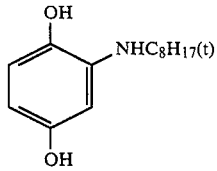

(III-28)

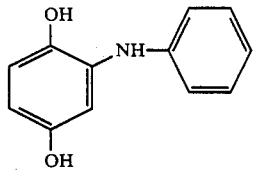

(III-29)

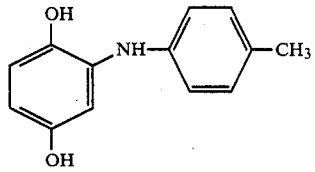

(III-30)

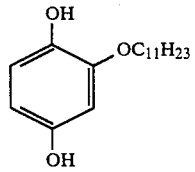

(III-31)

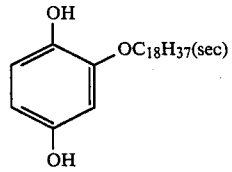

(III-32)

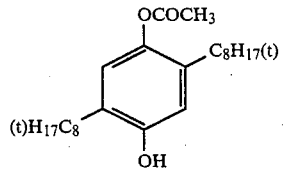

(III-33)

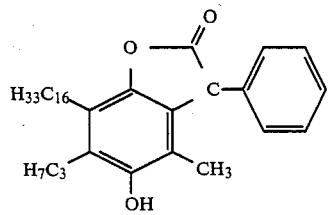

Formula [IV]

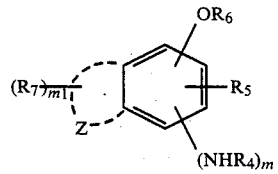

In formula [IV], $R_4$ represents a hydrogen atom, an alkyl group (e.g. methyl, i-propyl, n-pentadecyl or trifluoromethyl), an acyl group (e.g. acetyl, stearoyl, cyclohexanecarbonyl or tolylcarbonyl), an alkylsulfonyl group (e.g. methylsulfonyl), an arylsulfonyl group (e.g. phenylsulfonyl, p-tolylsulfonyl or p-dodecylphenylsulfonyl), an alkylaminosulfonyl group (e.g. ethylaminosulfonyl or t-octylaminosulfonyl) or an arylaminosulfonyl group (e.g. anilinosulfonyl).

In formula [IV], $R_5$ is a hydrogen atom, a halogen atom (which is preferably Cl, Br or I), an alkyl group (which is preferably an alkyl group having 1–24 carbon atoms, as illustrated by methyl, ethyl, butyl, t-amyl, t-octyl, n-dodecyl, n-pentadecyl or cyclohexyl, and may optionally be an alkyl group such as benzyl or phenethyl substituted by an aryl group such as phenyl), an aryl group (e.g. phenyl, naphthyl, tolyl or mesityl), an alkoxy group (e.g. methoxy or benzyloxy), an acylamino group (e.g. n-butylamido, laurylamido, optionally substituted β-phenoxyethylamido, phenoxyacetamido, substituted or unsubstituted benzamido, methanesulfonamidoethylamido or β-methoxyethylamido), or a sulfamoyl group (e.g. an alkylsulfamoyl group such as methylsulfamoyl or n-dodecylsulfamoyl; a substituted or unsubstituted phenylsulfamoyl such as an arylsulfamoyl illustrated by dodecylphenylsulfamoyl).

In formula [IV], $R_6$ represents a hydrogen atom or a protective group that will be eliminated upon decomposition and examples of such protective group include those mentioned for $R_2$ and $R_3$ in formula [III].

In formula [IV], Z is $(R_5)_2$ or the atomic group which is necessary for forming a condensed carbon ring, and when Z is $(R_5)_2$, $R_5$ may be the same or different.

In formula [IV], $R_7$ is a group having no less than 7 carbon atoms as illustrated by n-heptyl, tolyl or t-pentadecyl; m is an integer of 0–2; and ml is 0 or 1.

Specific examples of the compound represented by formula [IV] are listed below but it should be understood that the scope of the present invention is in no way limited to these particular examples.

Illustrative compounds IV (IV-1)

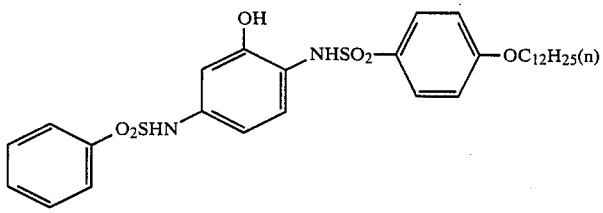

(IV-2)

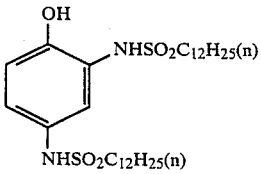

(IV-3)

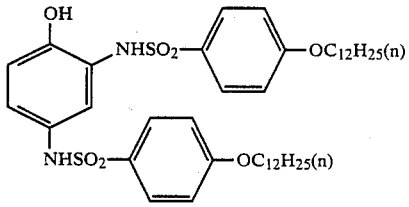

(IV-4)

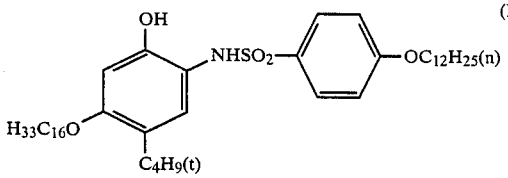

(IV-5)

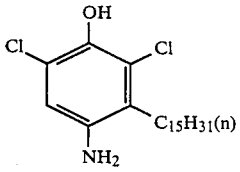

(IV-6)

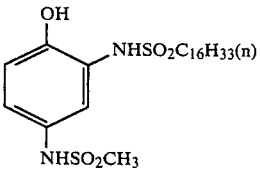

(IV-7)

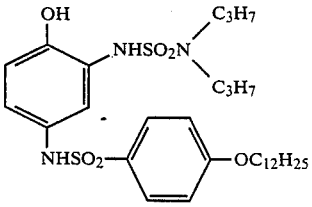

(IV-8)

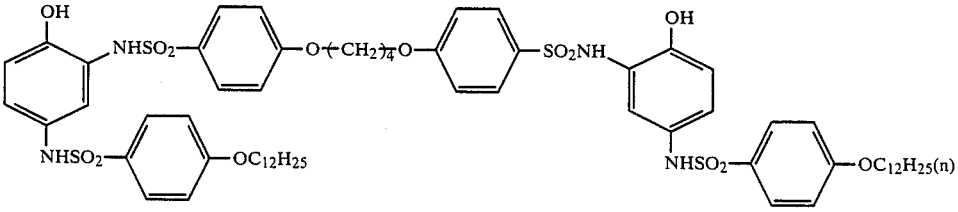

-continued

Illustrative compounds IV

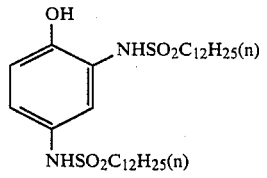

(IV-9)

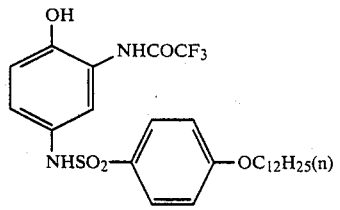

(IV-10)

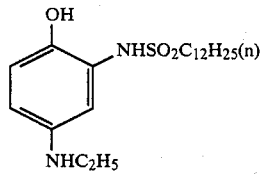

(IV-11)

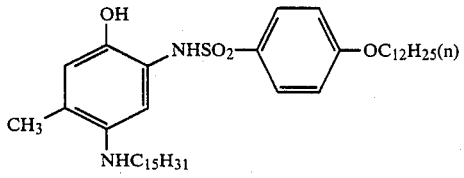

(IV-12)

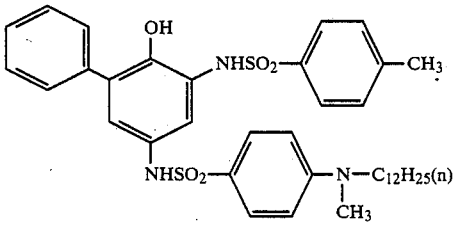

(IV-13)

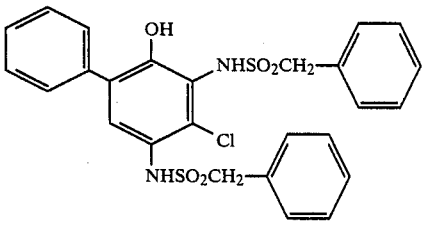

(IV-14)

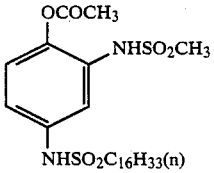

(IV-15)

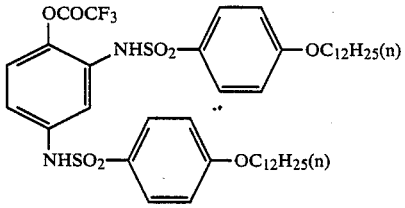

(IV-16)

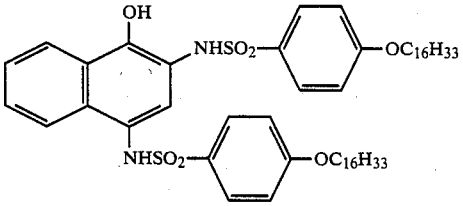

(IV-17)

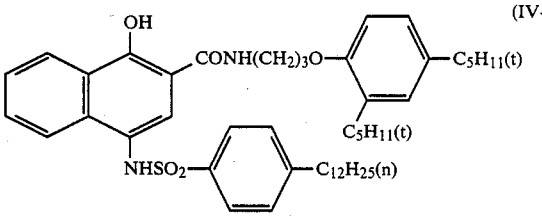

(IV-18)

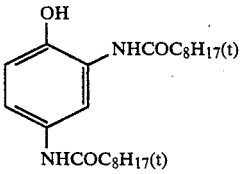

(IV-19)

The compound represented by the above-described general formula [III] or [IV] which is hereunder referred to as the hydroxybenzene derivative of the present invention (or a precursor thereof if it is substituted by a protective group) may be synthesized by any of the methods described in prior art references such as Methoden der Organischen Chemie (Houben-Weyl), Band VI/IC, Phenole Teil 1 (George Thime Verlag, Stuttgard, 1976); U.S. Pat. Nos. 4,205,987, 4,447,523, Japanese patent application (OPI) Nos. 188646/1984, 192246/1984, 192247/1984, 195238/1984, 195239/1984, 202465/1984, 204039/1984, 204040/1984 and 232341/1984.

The hydroxybenzene derivative of the present invention may be added in an amount within a wide range that should be determined by such factors as the specific use of the thermally developable light-sensitive material, the type of the dye-providing material used, the place of addition, and the specific conditions of thermal development. It is generally preferably that the hydroxybenzene derivative of the present invention is added in an amount ranging from 0.001 to 0.5 moles, more preferably from 0.005 to 0.2 moles, per mole of the light-sensitive silver halide used.

The hydroxybenzene derivative of the present invention may be incorporated in at least one of the silver halide emulsion layers in the thermally developable light-sensitive material of the present invention which contain a light-sensitive silver halide. The hydroxybenzene derivatives of the present invention may be used either individually or in combination with themselves. The hydroxybenzene derivative of the present invention may optionally be used in combination with one or more hydroquinone compounds or precursors thereof which are outside the scope of the present invention. This method is effective in improving the dispersion stability of the hydroxybenzene derivative of the present invention.

The hydroxybenzene derivative of the present invention may be incorporated in a silver halide emulsion layer in the thermally developable light-sensitive material after it is dispersed in a hydrophilic colloid. While any known method may be employed to achieve the dispersion of the derivative, the following techniques are advantageous:

(1) the hydroxybenzene derivative of the present invention is dissolved in a substantially water-insoluble high-boiling point solvent and the resulting solution is dispersed in a hydrophilic protective colloid to attain fine particles of the derivative; a low-boiling point solvent or a highly water-soluble organic solvent may be used as a dissolving aid;

(2) the hydroxybenzene derivative of the present invention is dissolved in a water-miscible organic solvent; a fillable polymer latex and a sufficient amount of water to render the derivative in the solution insoluble are gradually added to the solution so as to incorporate said hydroquinone and/or a precursor thereof into the particles of the fillable polymer latex; for details of the water-miscible organic solvent and the fillable polymer latex, see Japanese patent application (OPI) Nos. 59942/1976 and 59943/1976; and (3) the hydroxybenzene derivative of the present invention is dispersed in a hydrophilic colloid by mechanically reducing the size of the particles of said derivative with a sand grinder, colloid mill or any other appropriate means.

The method of dispersing the hydroxybenzene derivative of the present invention is not limited to those shown above and any other appropriate method may be employed to achieve the same purpose.

If the hydroxybenzene derivative of the present invention is used in combination with the restrainer of the formula [I-D] or [I-E], their mixing proportions are such that the molar ratio of the hydroxybenzene derivative to the restrainer preferably ranges from 1:2 to 500:1, more preferably from 2:1 to 100:1.

Preferably embodiments of the restrainer (I) are hereunder described with reference to the case where the immobilizing group denoted by F is a ballast group as in formula [I-B]:

$$X(J)_n(B)$$

where X is the residue of the development restrainer; J is a divalent linkage; B is a ballast group; and n is 0 or 1.

The residue X of the restrainer of formula [I-B] and the divalent linkage J have the same meanings as X and J in formula [I]. Preferably examples of the divalent linkage J in the compound represented by formula [I-B] are listed below: —CONH—, —$SO_2$NH—, —NHCONH—, —COO—,

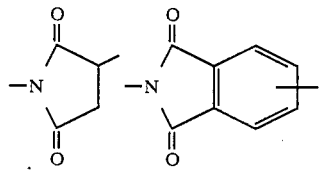

—NHCO—, —$NHSO_2$—, —O—, —S—,

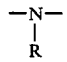

(where R is a hydrogen atom or an alkyl group) and —CO—.

The ballast group B in formula [I-B] is an organic ballast group whose molecular size and shape are such that it will reduce the diffusibility of the compound [I-B] or a silver salt (silver complex) thereof or render them nondiffusible during thermal development. Common organic ballast groups include long-chain alkyl groups which are bonded to the restrainer residue X either directly or by the divalent linkage $(J)_n$, as well as benzene- or naphthalene-based aromatic groups which are fused, either directly or indirectly, to the nucleus of a carbon ring or heterocyclic ring in said restrainer residue. Effective ballast groups are generally those which have at least 8 carbon atoms, and substituted or unsubstituted alkyl groups having 8–40 carbon atoms are preferable. Also effective are those ballast groups which have groups substituted by such hydrophilic groups as a sulfo group and a carboxylgroup and which have groups having substituted or unsubstituted alkyl groups with 8–30 carbon atoms.

Preferably examples of the ballast group are listed below:

$-C_{17}H_{33}$, $-C_{15}H_{31}$, $-C_{10}H_{21}$, $-CH_2CH(C_2H_5)-C_4H_9$, $-(CH_2)_3O(CH_2)_7CH_3$, $-(CH_2)_3OCH_2CH(C_2H_5)(CH_2)_8CH_3$,

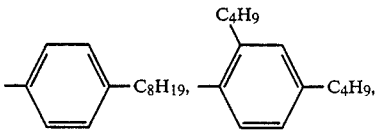

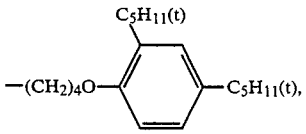

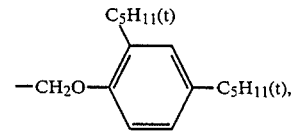

-continued
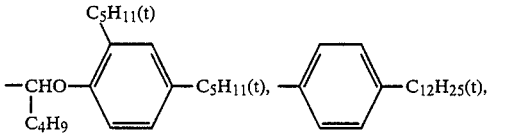
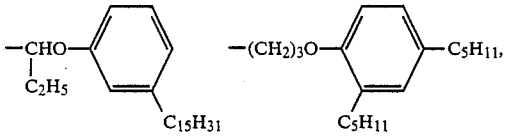
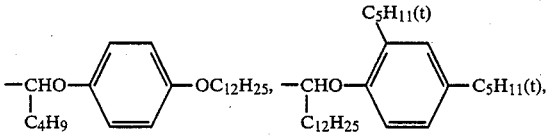
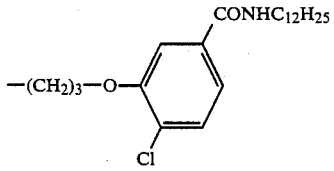
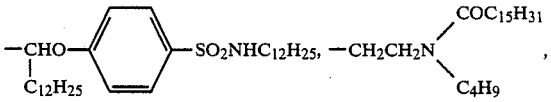
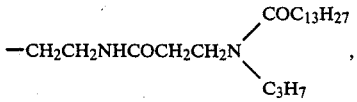
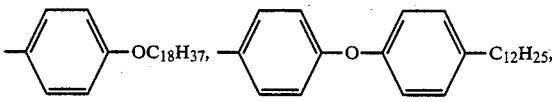
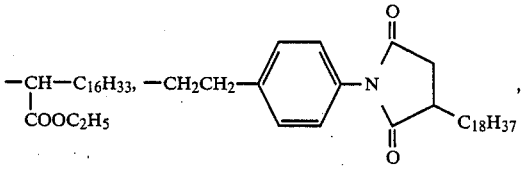
-continued
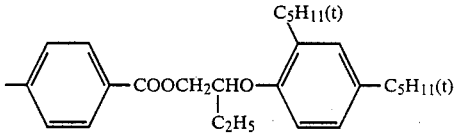
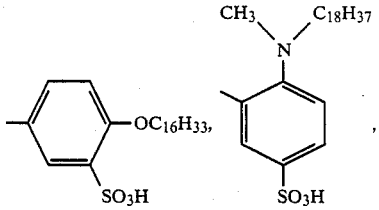
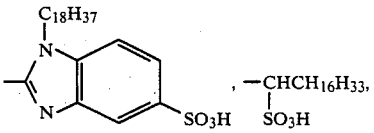
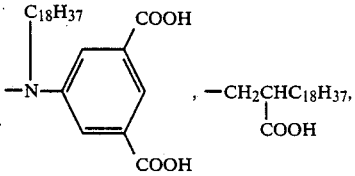
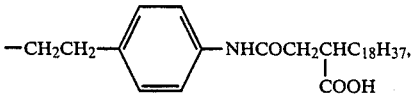
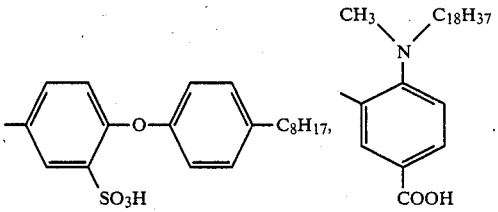
Specific examples of the compound represented by formula [I-B] are listed below.
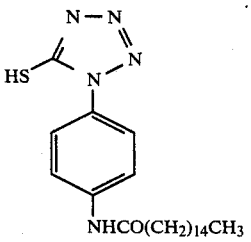
(B-1)
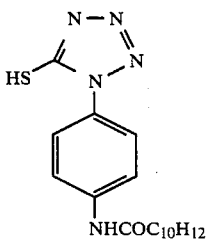
(B-2)

-continued
(B-3)
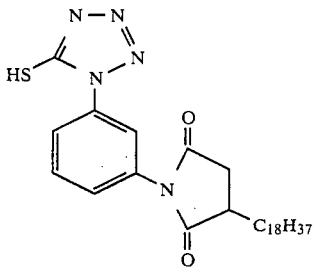
(B-4)
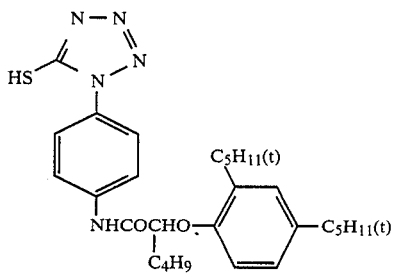
(B-5)
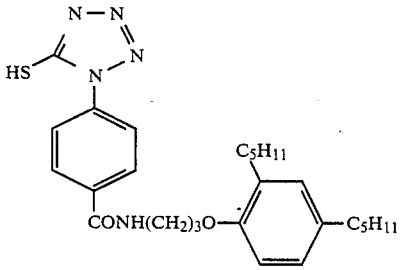
(B-6)
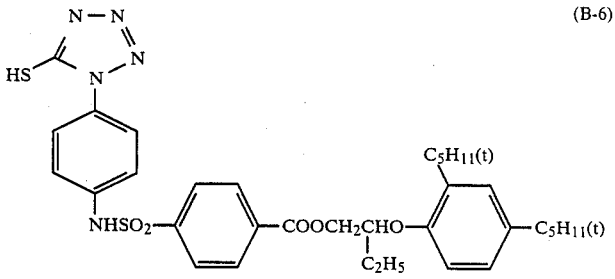
(B-7)
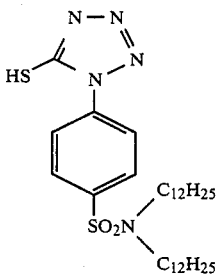
(B-8)
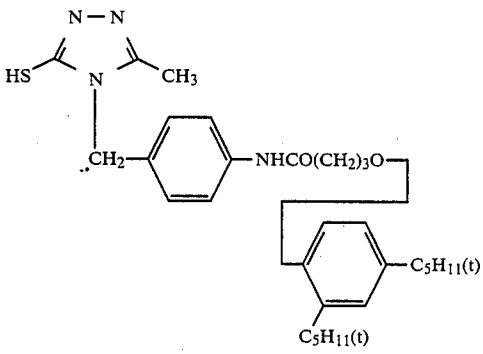
(B-9)
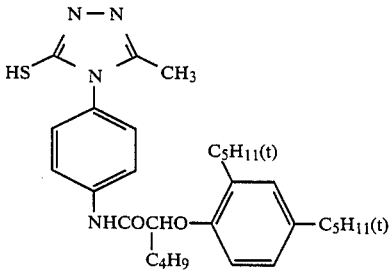
(B-10)
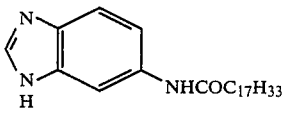
(B-11)
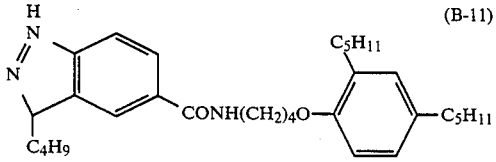
(B-12)
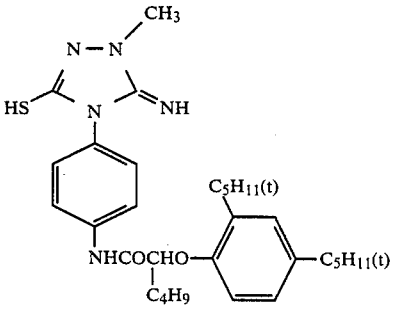

-continued
(B-13)
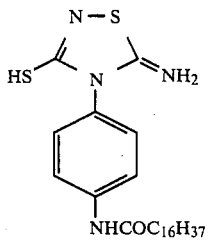
(B-14)
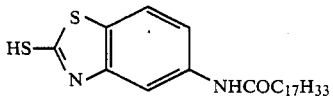
(B-15)
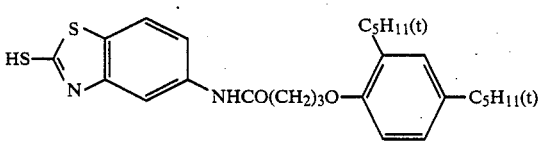
(B-16)
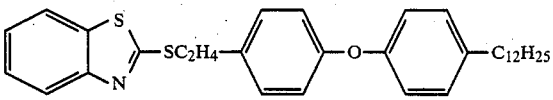
(B-17)
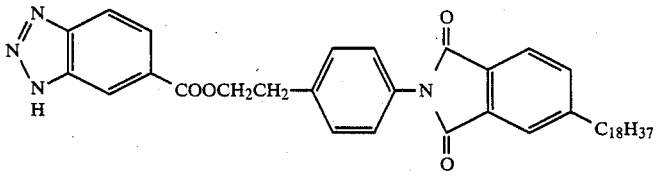
(B-18)
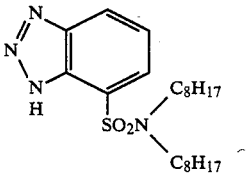
(B-19)
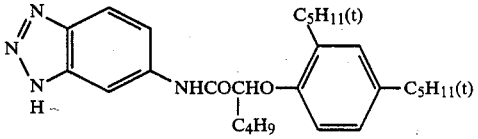
(B-20)
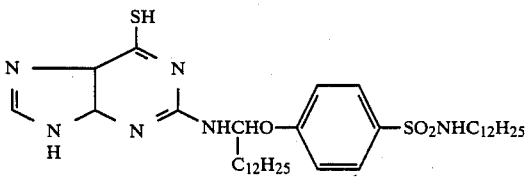
(B-21)
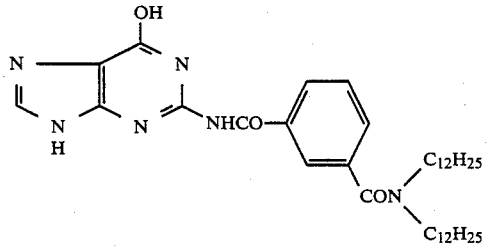
(B-22)
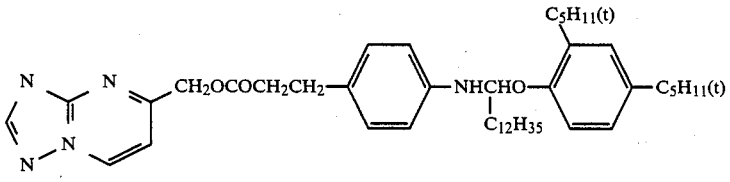

-continued
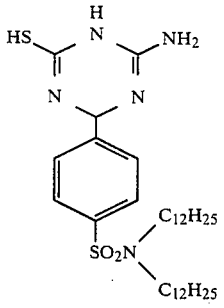
(B-23)
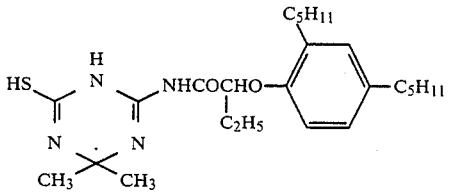
(B-24)
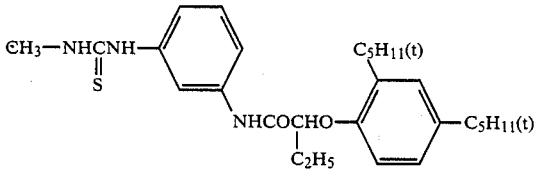
(B-25)
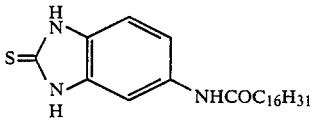
(B-26)
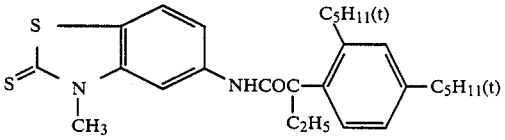
(B-27)
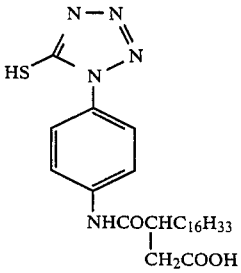
(B-28)
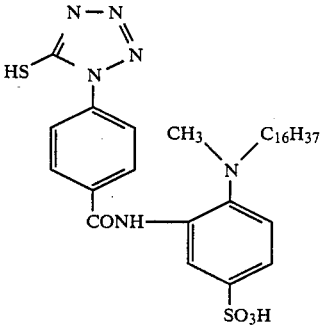
(B-29)
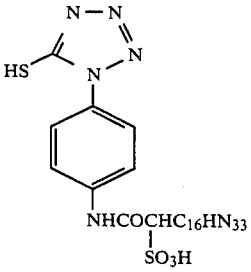
(B-30)
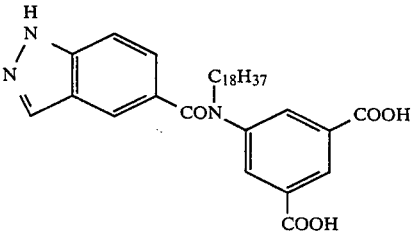
(B-31)
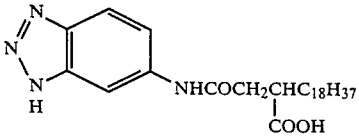
(B-32)
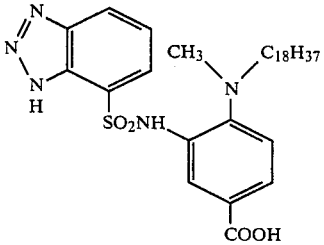
(B-33)

-continued

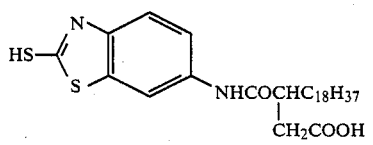

(B-34)

Syntheses of several compounds represented by formula [I-B] are described below.

Snythesis 1: synthesis of compound (B-1)

A mixture of 1-(p-aminophenyl)-1,2,3,4-tetrazole-5-thiol (19.3 g) and pyridine (20 ml) was added to 200 ml of acetonitrile, and palmitoyl chloride (33 g) was added dropwise with agitation at room temperature. After the addition of palmitoyl chloride, the mixture was refluxed for 1 hour and subsequently cooled to have a cyrstal precipitated. This crystal was recovered by filtration, washed with cold acetonitrile and dried to obtain the end compound in an amount of 31.5 g (yield, 76%).

Synethesis 2: synethesis of compound (B-15)

A mixture of 6-amino-2-mercaptobenzothiazole (18.2 g) and pyridine (20 ml) was added to 200 ml of acetonitrile, and a solution of 3-(2,4-di-(t)pentylphenoxy)-butyric acid chloride (35 g) in acetonitrile (50 ml) was added dropwise with agitation at room temperature. After the addition of the acetonitrile solution, the mixture was refluxed for 1 hour. The reaction mixture was poured into water, and the resulting crystal was recovered by filtration. By subsequent recrystallization from acetonitrile, the end compound was obtained in an amount of 33.8 g (yield, 88%).

The other compounds of formula [I-B] can be synthesized by similar procedures.

Preferable embodiments of the restrainer (I) are hereunder described with reference to the case where the immobilizing group denoted by F is a polymer residue having a building block derived from an ethylenically unsaturated group or a group having an ethylenically unsaturated group. In this case, the restrainer of the present invention is a polymer having a recurring unit derived from a monomer represented by the following general formula [I-C]:

Q—X [I-C]

where Q is an ethylenically unsaturated group or a group having an ethylenically unsaturated group; and X is the residue of the development restrainer.

In formula [I-C], Q represents an ethylenically unsaturated group or a group having an ethylenically unsaturated group and is preferably represented by the following formula (18):

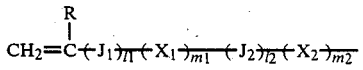

(18)

where R is a hydrogen atom, a carboxyl group or an alkyl group (e.g. methyl or ethyl), said alkyl group optionally having a substituent such as a halogen atom (e.g. F or Cl) or a carboxyl group; the carboxyl group represented by R and the one as a substituent may form a salt; $J_1$ and $J_2$ are each a divalent linkage such as —NHCO—, —CONH—, —COO—, —OCO—, —S-CO—, —COS—, —O—, —S—, —SO— or —$SO_2$—; $X_1$ and $X_2$ are each a divalent hydrocarbon group such as alkylene, arylene, aralkylene, alkylenearylene or arylenealkylene; illustrative alkylene groups are methylene, ethylene and propylene, an illustrative arylene group is phenylene, an illustrative aralkylene group is phenylmethylene, an illustrative alkylarylene group is methylenephenylene, and an illustrative arylenealkylene group is phenylenemethylene, K, $l_1$, $m_1$, $l_2$ and $m_2$ are each 0 or 1.

The residue X of the restrainer of formula [I-C] has the same meaning as X in formula [I].

The following are typical examples of the monomeric compound represented by formula [I-C] but should in no sense be taken as limiting the present invention.

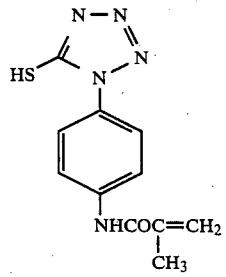

(m-1)

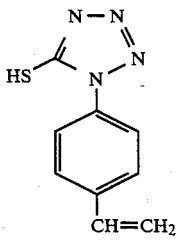

(m-2)

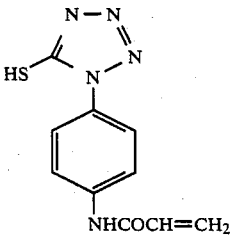

(m-3)

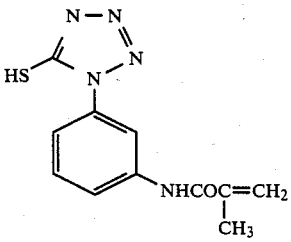

(m-4)

-continued
(m-5)
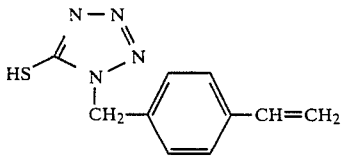
(m-6)
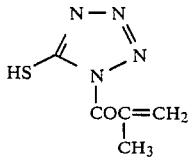
(m-7)
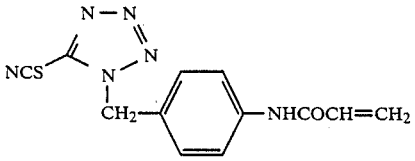
(m-8)
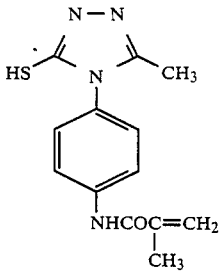
(m-9)
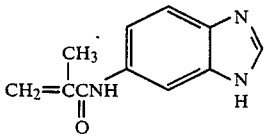
(m-10)
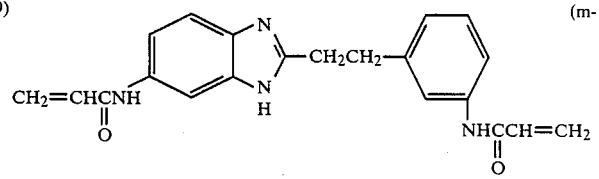
(m-11)
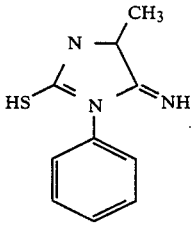
(m-12)
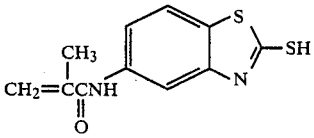
(m-13)
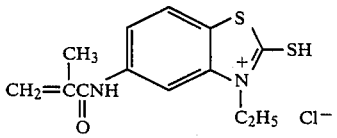
(m-14)
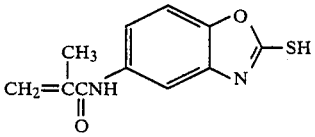
(m-15)
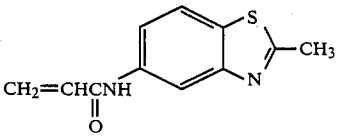
(m-16)
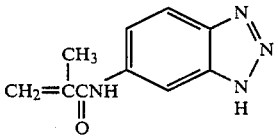
(m-17)
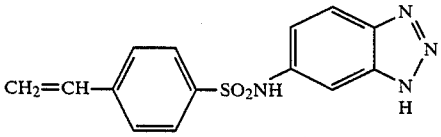
(m-18)
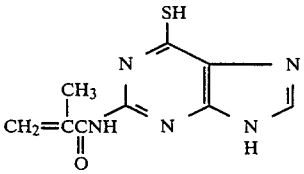
(m-19)
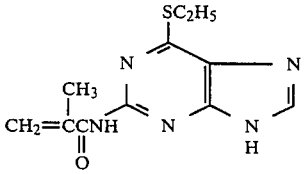
(m-20)
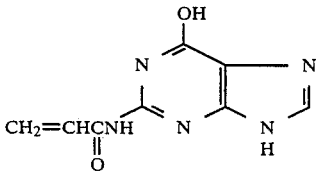

-continued (m-21)

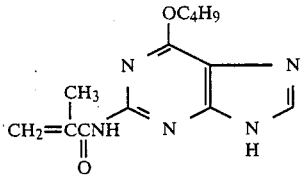

(m-22)

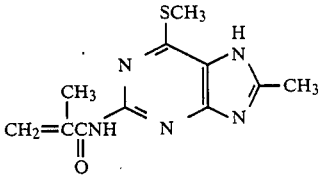

(m-23)

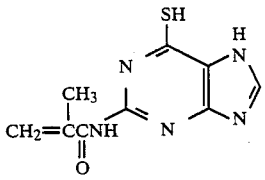

(m-24)

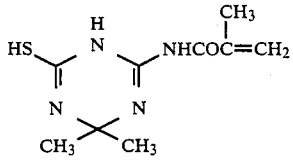

(m-25)

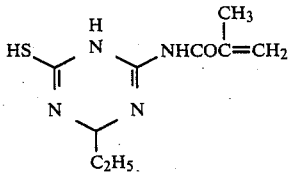

(m-26)

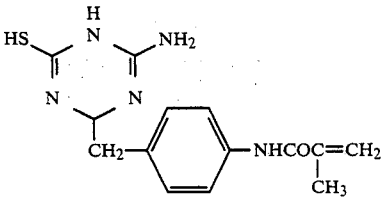

(m-27)

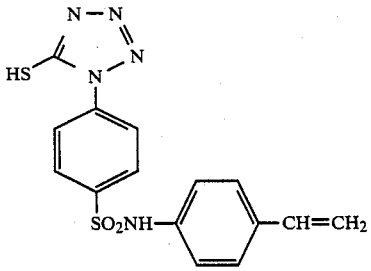

(m-28)

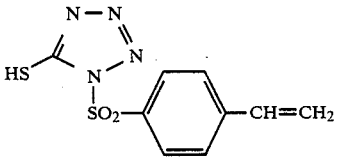

(m-29)

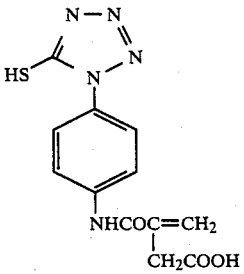

(m-30)

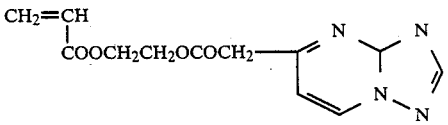

Syntheses of several compounds represented by formula [I-C] are shown below.

Synthesis C-1: synthesis of 1-(p-methacrylamidophenyl)-1,2,3,4-tetrazole-5-thiol (m-1)

Thirty grams of 1-(p-aminophenyl)-1,2,3,4-tetrazole-5-thiol was dissolved in 300 ml of acetonitrile and 20 ml of pyridine, and 16 ml of methacrylic acid chloride was added dropwise to the resulting solution with agitation. After the addition of the methacrylic acid chloride, the mixture was agitated for 1 hour at room temperature. Thereafter, a 10% aqueous solution of sodium hydroxide was added and the mixture was agitated for a white. The mixture was rendered weakly acidic with dilute hydrochloric acid and the end compound was obtained as a white crystal in an amount of 29.4 g (yield, 72%).

Synthesis C-2: synthesis of 1-(p-vinylbenzyl)-1,2,3,4-tetrazole-5-thiol (m-5)

Vinyl benzyl chloride (76 g) was dissolved in 300 ml of dimethylformamide (DMF). To the resulting solution, a mixture of potassium thiocyanate (56 g) and sodium iodide (28 g) was added and the mixture was heated at 150° C. for 30 minutes under agitation. After the greater part of the DMF was distilled off under vacuum, the residue was extracted with 750 ml of ether, filtered and concentrated to obtain 30 g of liquid vinyl benzyl isothiocyanate. Fifteen grams of this benzyl isothiocyanate was added with agitation to 200 ml of water containing 6.2 g of sodium azide and the mixture was refluxed for 3 hours. The reaction mixture was cooled and rendered acidic with dilute hydrochloric acid to obtain the end compound as a white crystal in an amount of 7 g (34%).

Synthesis C-3: synthesis of 5-methacrylamidobenzotriazole (m-17)

After 26.8 g of 5-aminobenzotriazole was dissolved in a mixture of acetonitrile (300 ml) and pyridine (40 ml), 46.5 g of methacrylic acid chloride was added dropwise. The resulting solution was concentrated and 200 ml of a 10% aqueous solution of sodium hydroxide was added. After the mixture was agitated for 30 minutes, it was neutralized with dilute hydrochloric acid and the end compound was obtained as a solid precipitate in an amount of 27.3 g (yield, 6.7%).

The polymer having a recurring unit derived from the monomer represented by formula [I-C] may be a homopolymer whose recurring unit is solely composed of a single monomer of formula [I-C] or it may be a copolymer whose recurring unit is composed of two or more of the monomers of formula [I-C]. Preferably, the polymer is a copolymer that is composed of a monomer of formula [I-C] and one or more comonomers having an ethylenically unsaturated group that are capable of copolymerizing with said monomer.

Illustrative comonomers having an ethylenically unsaturated group that are capable of forming copolymers with the monomer of formula [I-C] include the following: acrylic acid esters, methacrylic acid esters, vinyl esters, olefins, styrenes, crotonic acid esters, itaconic acid diesters, maleic acid diesters, fumaric acid diesters, acrylamides, allyl compounds, vinyl ethers, vinyl ketones, vinyl heterocyclic compounds, glycidyl esters, unsaturated nitriles, polyfinctional monomers, and various unsaturated acids.

If both the monomer of formula [I-C] and one or more of the comonomers listed above are used to form copolymers, the recurring unit composed of the monomer of formula [I-C] is preferably present in an amount which accounts for 10–90 wt% of the total polymer, with the range of 30–70 wt% being more preferable.

Polymer couplers are generally obtained by emulsion polymerization or solution polymerization and these methods may be employed in the production of a polymer that has a recurring unit derived from the monomer represented by formula [I-C]. For details of the method of emulsion polymerication, see U.S. Pat. Nos. 4,080,211 and 3,370,952. An oleophilic polymer may be dispersed in an aqueous solution of gelatin in the form of a latex by employing the method described in U.S. Pat. No. 3,451,820.

These methods may equally be applied to the formation of homopolymers and copolymers. In the latter case, a liquid comonomer is preferably used and this will also serve as a solvent in emulsion polymerization for monomers which are solid in the normal state.

Emulsifying agents that are employed in emulsion polymerization include surfactants, high-molecular weight protective colloids, and copolymerizing/emulsifying agents. A suitable surfactant may be selected from among the anionic surfactants, nonionic surfactants, cationic surfactants and amphoteric surfactants known in the art.

An oleophilic polymer synthesized by solution polymerization or any other appropriate methods is dispersed in a latex form in an aqueous solution of gelatin by the following procedures: first, the polymer is dissolved in an organic solvent; then the solution is dispersed in a latex form in an aqueous solution of gelatin with the aid of a dispersant by means of sonication or a colloid mill. For details of the method of dispersing an oleophilic polymer in a latex form in an aqueous solution, see U.S. Pat. No. 3,451,820.

Organic solvents that may be employed for dissolving the oleophilic polymer include esters (e.g. methyl acetate, ethyl acetate and propyl acetate), alcohols, ketones, hydrocarbon halides and ethers. These organic solvents may be used either independently or in admixture.

The solvents for polymerization that are employed in the production of the polymer of the present invention are preferably those which are good solvents for both the monomers and the product polymer and which have low reactivity with the polymerization initiator used. These solvents may be used either independently or in admixture.

The temperature for polymerization must be determined in consideration of such factors as the types of the polymerization initiator and solvent used, and is generally selected from the range of 30°–120° C.

The following polymerization initiators may be employed in producing the polymer of the present invention either by emulsion polymerization or by solution polymerization: water-soluble polymerization initiators including persulfate salts such as potassium persulfate, ammonium persulfate and sodium persulfate, water-soluble azo compounds such as sodium 4,4'-azobis-4-cyanovalerate and 2,2'-azobis(2-amidinopropane)-hydrochloride, and hydrogen peroxide; and oleophilic polymerization initiators for use in solution polymerization which include azo compounds such as azobisisobutyronitrile, 2,2'-azobis-(2,4-dimethylvaleronitrile), 2,2'-azobis(4-methoxy-2,4-dimethylvaleronitrile), 1,1'-azobis(cyclohexanone-1-carbonitrile), 2,2'-azobisisocyanobutyric acid, dimethyl 2,2'-azobisisobutyrate, 1,1'-azobis(cyclohexanone-1-carbonitrile), and 4,4'-azobis-4-cyano valeric acid, and peroxides such as benzoyl peroxide, lauryl peroxide, chlorobenzyl peroxide, diisopropyl peroxydicarbonate, and di-t-butyl peroxide, with benzoyl peroxide, chlorobenzyl peroxide and lauryl peroxide being preferable.

These polymerization initiators, when use in emulsion polymerization or solution polymerization, may be present in amounts ranging from 0.01 to 10 wt%, preferably from 0.1 to 5 wt%, of the total monomer content.

Other polymerization methods such as suspension polymerization and bulk polymerization may also be employed in producing the polymer of the present invention. In other words, the range of the polymers of the present invention covers a homopolymer of the monomer of formula [I-C], a copolymer composed of two or more of the monomers of formula [I-C], and a copolymer composed of said monomer and at least one other copolymerizable monomer, and it should be understood that the polymers of the present invention are by no means limited by the process of their synthesis.

Some of the monomers of formula [I-C], in particular, those having an —SH group, may be subjected to the following procedures in order to attain polymers in accordance with the present invention: the —SH group is protected with an acetyl group or any appropriate protective group and, after performing polymerization reaction, the protective group is eliminated by hydrolysis.

The polymer attained in accordance with the present invention is preferably a copolymer containing 10–95 wt% (more preferably 30–80 wt%) of a recurring unit composed of the monomer represented by formula [I-C].

Typical examples of the polymer which are within the scope of the present invention are given below but should in no sense be taken as limiting.

| Polymer | Monomer (m) of formula [I-C] | Comonomer (cm) | Monomeric ratio (m/cm) |
|---|---|---|---|
| P-1 | m-1 | BA | 1/1 |
| P-2 | m-1 | BA | 3/2 |
| P-3 | m-1 | EA | 4/1 |
| P-4 | m-2 | St | 1/1 |
| P-5 | m-3 | BA | 2/3 |
| P-6 | m-4 | EA | 1/1 |
| P-7 | m-5 | BA | 1/1 |
| P-8 | m-5 | MMA | 3/2 |
| P-9 | m-6 | BA | 1/1 |
| P-10 | m-7 | BA | 3/2 |
| P-11 | m-8 | BA | 7/3 |
| P-12 | m-10 | BA | 1/1 |
| P-13 | m-11 | MA | 2/3 |
| P-14 | m-12 | BA | 2/3 |
| P-15 | m-15 | BA | 7/3 |
| P-16 | m-18 | BA | 1/1 |
| P-17 | m-19 | BA | 3/2 |
| P-18 | m-21 | BA | 1/1 |
| P-19 | m-23 | BA | 3/7 |
| P-20 | m-26 | BA | 3/7 |
| P-21 | m-29 | VP | 1/1 |

BA, butyl acrylate; EA, ethyl acrylate; St, styrene; VP, vinylpyrrolidone; MMA, methyl methacrylate; MA, methyl acrylate.

Synthesis of several examples of the above-listed polymers are shown below.

Synthesis C-1: synthesis of polymer P-1

Five grams of a monomer (m-1) and 5 g of butyl acrylate were dissolved in 100 ml of dimethylformamide (DMF) and the solution was heated at 80° C. while it was purged with a nitrogen gas. At a controlled temperature of 80° C., 250 mg of azobisisobutyronitrile was added and reaction was carried out for 2 hours. Thereafter, another 250 mg of azobisisobutyronitrile was added and reaction was carried out at 80° C. for 2 hours. The reaction mixture was cooled and poured into 1,000 ml of cold water and the resulting solid precipitate was recovered by filtration. This precipitate was dissolved in ethyl acetate, extracted, dried over magnesium sulfate and filtered. By distilling off the ethyl acetate, the end compound was obtained as a pale yellow product in an amount of 8.3 g (Mw=4,300).

Synthesis C-2: synthesis of polymer P-7

Six grams and a half of a monomer (m-5) was dissolved in 100 ml of acetonitrile, and 5 ml of pyridine was added to the solution. To the solution, 2.4 g of acetyl chloride was added dropwise and the mixture was refluxed for 2 hours. The heated reaction mixture was concentrated and poured into ice water. The resulting solid precipitate was recovered by filtration and dried to obtain an acetylated monomer.

Six grams of the acetylated monomer and 5.0 g of butyl acrylate were dissolved in 110 ml of DMF and the solution was heated at 80° C. while it was purged with a nitrogen gas. At a controlled temperature of 80° C., 400 ml of azobisisobutyronitrile was added and reaction was carried out for 4 hours. The reaction mixture was cooled and poured into 1000 ml of cold water. The resulting solid precipitate was recovered by filtration and re-dissolved in DMF. To the solution, 20 ml of an aqueous solution of 10% sodium hydroxide was added and the mixture was agitated for 2 hours. The stirred mixture was poured into 1,000 ml of water and neutralized with dilute hydrochloric acid. The resulting solid precipitate was recovered by filtration and dried to obtain the end compound in an amount of 7.9 g.

The polymers other than P-1 and P-7 may be synthesized by employing slight modifications of these procedures.

In the present invention, restrainers such as the compounds represented by the general formulas [I-A], [I-D], [I-E] and [I-B], or the polymer having a recurring unit derived from the monomer represented by the general formula [I-C] may be used either independently or in combination.

The amount in which the restrainer of the present invention is added varies with such factors as the types of the light-sensitive silver halide and organic silver salt used, their amounts and mixing proportions, but a preferable range is generally from $10^{-6}$ to $10^{-1}$ moles per mole of the light-sensitive silver halide, with the range of $10^{-5}$–$10^{-2}$ moles being more preferable.

The restrainer of the present invention may be incorporated in any of the constituent layers of a thermally developable light-sensitive material. While the restrainer may be incorporated in more than one layer, it is preferably incorporated in a light-sensitive layer having a light-sensitive silver halide. The restrainer of the present invention may be added at any point of the time interval between the formation of a precipitate after the physical ripening of the grains of a light-sensitive silver halide to be used in the light-sensitive layer and the application of an emulsion containing the grains of said light-sensitive silver halide. The restrainer may be added by any of the methods commonly employed to incorporate conventional restrainers. For example, the restrainer of the present invention, which is in the form of either an acid or a salt, may be incorporated in the emulsion after it is dissolved in water, an organic solvent such as methanol, or a mixture thereof. If the restrainer is soluble in an organic solvent such as ethyl acetate or cyclohexane, it may be first emulsified before addition to the emulsion.

The thermally developable light-sensitive material of the present invention contains a light-sensitive silver halide. Examples of the light-sensitive silver halides that may be used in the present invention include silver chloride, silver bromide, silver iodide, silver chlorobromide, silver chloroiodide, silver iodobromide and silver chloroiodobromide. These light-sensitive silver halides may be prepared by the single-jet method, double-jet method and any other methods known in the art of photographic technology. A light-sensitive silver halide emulsion containing light-sensitive silver halides prepared in accordance with the method commonly employed in preparing conventional silver halide gelatin emulsions will provide preferable results.

This light-sensitive silver halide emulsion may be chemically sensitized by any of the methods known in the art of photographic technology.

The silver halide in the light-sensitive emulsion may be coarse- or fine-grained. A preferable grain size ranges from about 0.001 to about 1.5 μm in diameter, with the range of about 0.01–about 0.5 μm being more preferable.

The thus prepared light-sensitive silver halide emulsion is most preferably incorporated in a thermally developable light-sensitive layer in the light-sensitive material of the present invention.

The light-sensitive silver halide used in the present invention may be prepared by another method, wherein a light-sensitive silver salt forming component is caused to react with an organic silver salt (to be described later in this specification) so as to form the intended light-sensitive halide in part of the organic silver salt.

The light-sensitive silver halides and light-sensitive silver salt forming components shown above may be used in combination in a variety of methods, and the amount in which they are used preferably ranges from 0.001 to 50 g, more preferably from 0.1 to 10 g, per square meter of one layer.

The light-sensitive silver halide used in the thermally developable light-sensitive material of the present invention preferably contains 0–40 mol% of silver iodide. A more preferable light-sensitive silver halide is of the core/shell type having a shell capable of forming surface latent image.

If the light-sensitive silver halide contains silver iodide, it may contain other halogen components which are not limited to any particular type but are preferably silver iodobromide and silver chloroiodobromide.

The light-sensitive silver halide which contains silver iodide and is preferably used in the present invention may be prepared by any of the methods described in P. Glafkides, Chimie et Physique Photographique, Paul Montel, Paris (1967); G. F. Duffin, Photographic Emulsion Chemistry, The Focal Press, London (1966); and V. L. Zelikmann et al., Making and Coating Photographic Emulsions, The Focal Press, London (1964).

An emulsion of the core/shell type light-sensitive silver halide which is used particularly preferably in the present invention may be prepared by forming a shell coat on each of the cores which are made of the monodispersed silver halide grains described above.

The thermally developable light-sensitive material of the present invention may have a multilayered structure comprising a thermally developable blue-sensitive layer, a thermally developable green-sensitive layer and a thermally developable red-sensitive layer. If desired, each of the light-sensitive layers may be divided into two or more layer such as a layer of the higher sensitivity and a layer of the lower sensitivity. In the case shown above, each of the blue-, green- and red-sensitive silver halide emulsions employed in the individual light-sensitive layers may be attained by adding the necessary spectral sensitizing dye in the silver halide emulsion already described.

The sensitizing dyes shown above are preferably added in amounts ranging from $1\times10^{-4}$ to 1 mole, preferably from $1\times10^{-4}$ to $1\times10^{-1}$ mole, per mole of the light-sensitive silver halide or the silver halide forming component.

Illustrative organic silver salts that may be used in the thermally developable light-sensitive material of the present invention include: silver salts of aliphatic carboxylic acids as described in Japanese Patent Publication Nos. 4921/1968, 26582/1969, 18416/1970, 12700/1970, 22185/1970, Japanese Patent Application (OPI) Nos. 52626/1974, 31728/1977, 137321/1977, 141222/1977, 36224/1978 and 37610/1978, and U.S. Pat. Nos. 3,330,633, 3,794,496, 4,105,451, 4,123,274 and 4,168,980, such as silver laurate, silver myristate, silver palmitate, silver stearate, silver arachidonate, silver behenate and silver α-(1-phenyltetrazole) thioacetate; silver salts of aromatic carboxylic acids such as silver benzoate and silver phthalate; silver salts of an imino group as described in Japanese Patent Publication Nos. 26582/1969, 12700/1970, 18416/1970, 22185/1970, Japanese Patent Application (OPI) No. 31728/1977, 137321/1977, 118638/1983 and 118639/1983.

Among the organic silver salts, silver salts of an imino group are preferable, with silver salts of benzotriazole derivatives being more preferable. Most preferable organic silver salts are those of sulfobenzotriazole derivatives.

The organic silver salts shown above may be used in the present invention either independently or in combination. Isolated forms of these silver salts may be used after they are dispersed in binders by appropriate means. Alternatively, such silver salts may be used unisolated after they have been prepared in appropriate binders.

The organic silver salts are preferably used in amounts ranging from 0.01 to 500 moles, more preferably from 0.1 to 100 moles, per mole of the light-sensitive silver halide. In terms of molar ratio to the monomer unit in the dye-providing material, the organic silver salts are preferably used in amounts ranging from 0.1 to 5 moles, more preferably from 0.3 to 3 moles, per mole of the monomer unit in the dye-providing material.

The thermally developable light-sensitive material of the present invention may be applied to black-and-white photography, but more preferably, it is applied to color photography. When the thermally developable light-sensitive material of the present invention is used in color photography, a dye-providing material is employed, with one capable of forming a diffusible dye being particularly preferable.

The dye-providing material which may be employed in the present invention is hereunder described. It may be of any kind that is involved in the reduction reaction of the light-sensitive silver halide and/or organic silver salt and which is capable of forming or releasing a diffusible dye as a function of said reaction. The dye-providing material used in the present invention is classified as a negative-acting dye-providing material which acts as a positive function of said reaction (ie, forming a negative dye image when a negative-acting silver halide is used) or as a positive-acting dye-providing material which acts as a negative function of said reaction (ie, forming a positive dye image when a negative-acting silver halide is used). The negative-acting dye-providing is further classified as follows:

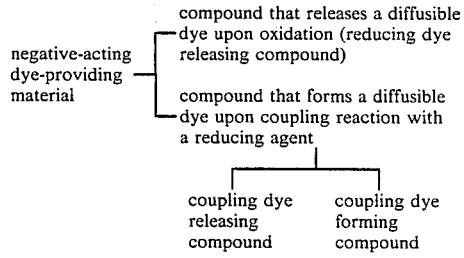

Each type of dye-providing material is hereunder described in greater detail.

An illustrative reducing dye releasing compound may be represented by the following general formula (21):

$$\text{Car—NHSO}_2\text{—Dye} \quad (21)$$

where Car is a carrier which is oxidized to relase a dye during reduction of the light-sensitive silver halide and- /or an optionally used organic silver salt; and Dye is a diffusible dye residue.

Specific examples of the reducing dye releasing compound of formula (21) are described in Japanese Patent Application (OPI) Nos. 179840/1982, 116537/1983, 60434/1984, 65839/1984, 71046/1984, 87450/1984, 88730/1984, 123837/1984, 165054/1984 and 165055/1984.

After example of the reducing dye releasing compound may be represented by the following general formula (22):

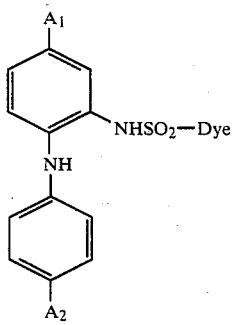

(22)

where $A_1$ and $A_2$ are each a hydrogen atom, a hydroxyl group or an amino group; and Dye has the same meaning as Dye in formula (21).

Specific examples of the compound (22) are shown in Japanese Patent Application (OPI) No. 124329/1984.

An illustrative coupling dye relasing compound may be represented by the following general formula (23):

$$Cp_1(J)_{n1}Dye \quad (23)$$

where $Cp_1$ is a coupler residue which is an organic group that is capable of reacting with the oxidized product of a reducing agent to release a diffusible dye; J is a divalent linkage, with the bond between $Cp_1$ and J being disrupted as a result of reaction with the oxidized product of the reducing agent; $n_1$ is 0 or 1; and Dye has the same meaning as Dye in formula (21).

Preferably, $Cp_1$ is substituted by various ballast groups in order to render the coupling dye releasing compound nondiffusible. Illustrative ballast groups include an organic group having at least 8 carbon atoms (preferably at least 12), a hydrophilic group such as a sulfo group or a carboxyl group, and a group having both at least 8 (preferably at least 12) carbon atoms and a hydrophilic group such as a sulfo or carboxyl group. Choice of an appropriate ballast group depends on the form of the light-sensitive material used. Another preferable ballast group is a polymer chain.

Specific examples of the compound represented by formula (23) are described in Japanese Patent Application (OPI) Nos. 186744/1982, 122596/1982, 160698/1982, 174834/1984, 224883/1982 and 159159/1984, and Japanese Patent Application No. 104901/1984.

An illustrative coupling dye forming compound may be represented by the following general formula (24):

$$Cp_2(F)(B) \quad (24)$$

where $Cp_2$ is a coupler residue which is an organic group capable of forming a diffusible dye upon reaction (coupling reaction) with the oxidized product of a reducing agent; F is a divalent linkage; and B is a ballast group.

The molecular weight of the coupler residue $Cp_2$ is preferably 700 or below, more preferably 500 or below, in order to ensure the formation of a desired diffusible dye. The ballast group B is preferably the same as the ballast group defined for formula (23). A particularly preferable ballast group is one having both at least 8 (preferably 12 or more) carbon atoms and a hydrophilic group such as a sulfo or carboxyl group. A polymer chain is a most preferable ballast group.

A preferable example of the coupling dye forming compound having a polymer chain is a polymer having a recurring unit derived from a monomer represented by the following general formula (25):

$$Cp_2(F)(Y)_l(Z)(L) \quad (25)$$

where $Cp_2$ and F are the same as defined in formula (24); Y is an alkylene group, an arylene group or an aralkylene group; l is 0 or 1; Z is a divalent organic group; and L is an ethylenically unsaturated group or a group having an ethylenically unsaturated group.

Specific examples of the coupling dye forming compounds represented by formulas (24) and (25) are described in Japanese Patent Application (OPI) Nos. 124339/1984, 181345/1984, Japanese Patent Application Nos. 109293/1983, 179657/1984, 181604/1984, 182506/1984 and 182507/1984, and the formulas of several examples are shown below.

Illustrative dye-providing materials
(Illustrative polymer-type coupling dye forming compounds)

①

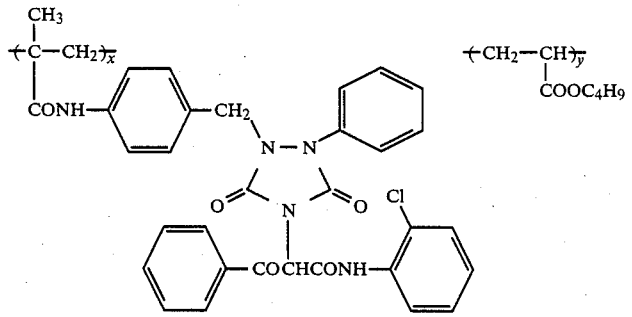

x: 60 wt %
y: 40 wt %

-continued
Illustrative dye-providing materials
(Illustrative polymer-type coupling dye forming compounds)
②
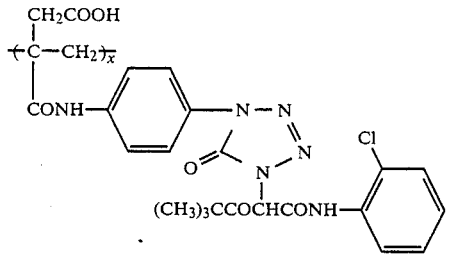
x: 50 wt %
y: 50 wt %
③
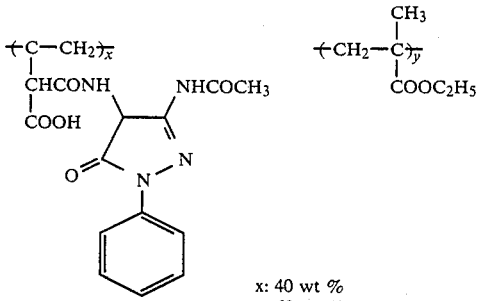
x: 40 wt %
y: 60 wt %
④
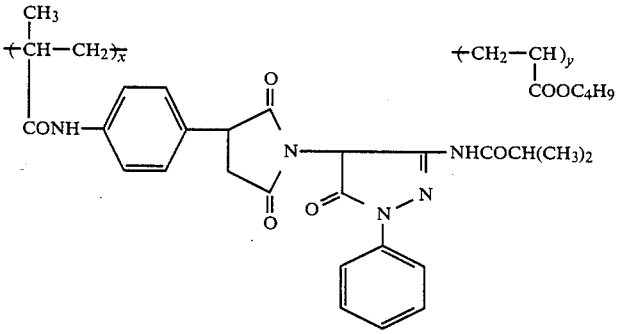
x: 40 wt %
y: 60 wt %
⑤
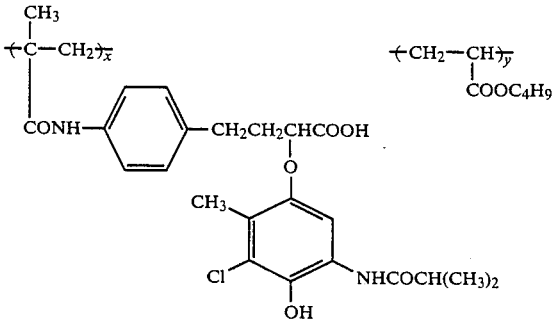
x: 60 wt %
y: 40 wt %

-continued
Illustrative dye-providing materials
(Illustrative polymer-type coupling dye forming compounds)
⑥
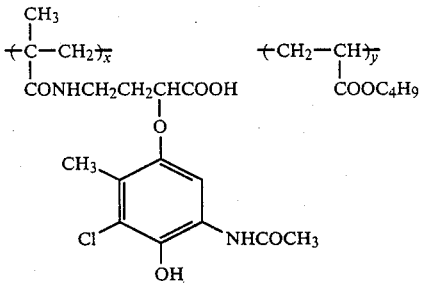
x: 50 wt %
y: 50 wt %
⑦
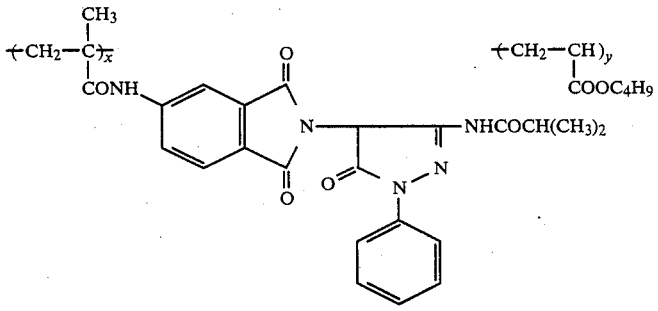
x: 50 wt %
y: 50 wt %
The following are preferable examples of the coupler residue represented by $Cp_1$ or $Cp_2$ in formulas (23), (24) and (25).
formula (26)
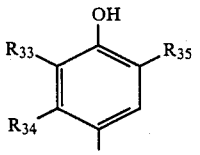
formula (27)
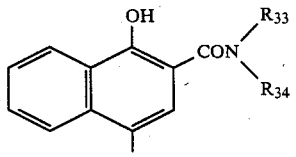
formula (28)
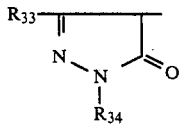
formula (29)
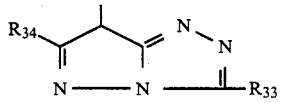
-continued
formula (30)
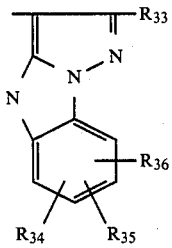
formula (31)
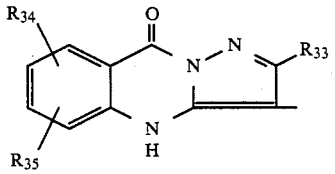
formula (32)
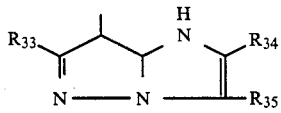
formula (33)
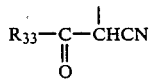
formula (34)
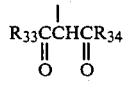

-continued formula (35)

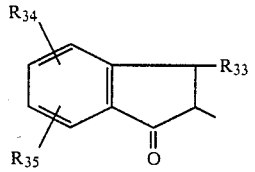

In the formulas shown above, $R_{33}$, $R_{34}$, $R_{35}$ and $R_{36}$ each represents a hydrogen atom, a halogen atom, an alkyl group, a cycloalkyl group, an aryl group, an acyl group, an alkyloxycarbonyl group, an aryloxycarbonyl group, an alkylsulfonyl group, an arylsulfonyl group, a carbamoyl group, a sulfamoyl group, an acyloxy group, an amino group, an alkoxy group, an aryloxy group, a cyano group, a ureido group, an alkylthio group, an arylthio group, a carboxy group, a sulfo group or a hetercyclic residue. These may be substituted by an appropriate substituent such as a hydroxyl group, a carboxyl group, a sulfo group, an alkoxy group, a cyano group, a nitro group, an alkyl group, an aryl group, an aryloxy group, an acyloxy group, an acyl group, a sulfamoyl group, a carbamoyl group, an imido group or a halogen atom.

Choice of these substituents depends on the object of $Cp_1$ and $Cp_2$. As already mentioned, at least one of the substituents in $Cp_1$ is preferably a ballast group, and the substituents in $Cp_2$ are preferably selected such that its molecular weight is 700 or less, more preferably 500 or less, in order to ensure the formation of a highly diffusible dye.

An illustrative positive-acting dye-providing material is an oxidizing dye releasing compound represented by the following general formula (36):

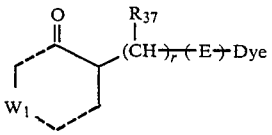

(36)

where $W_1$ signifies the atomic group necessary for forming a quinone ring (which may have a substituent thereon); $R_{37}$ is an alkyl group or a hydrogen atom; E is

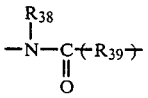

(where $R_{38}$ is an alkyl group or a hydrogen atom, and $R_{39}$ is an oxygen atom or

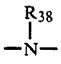

or $—SO_2—$; r is 0 or 1; and Dye has the same meaning as defined for formula (21);

Specific examples of this compound are shown in Japanese Patent Application (OPI) Nos. 166954/1984 and 154445/1984.

Another example of the positive-acting dye providing material is a compound that is oxidized to lose its dye-releasing ability, as typified by a compound represented by the following general formula (37):

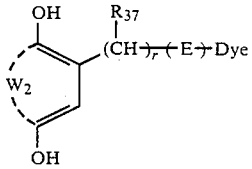

(37)

where $W_2$ signifies the atomic group necessary for forming a benzene ring (which may have a substituent thereon); and $R_{37}$, r, E and Dye are the same as defined in formula (36).

Specific examples of this compound are shown in Japanese Patent Application (OPI) Nos. 124329/1984 and 154445/1984.

Still another example of the positive-acting dye providing materials a compound that is represented by the following general formula (38):

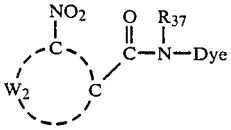

(38)

where $W_2$, $R_{37}$ and Dye are the same as defined in formula (37).

Specific examples of this compound are shown in Japanese Patent Application (OPI) No. 154445/1984.

The diffusible dye residue signified by Dye in formulas (21), (22), (23), (36), (37) and (38) is hereunder described in greater detail. In order to ensure the diffusibility of a dye, the molecular weight of Dye is preferably 800 or less, more preferably 600 or less. Examples of the diffusible dye residue that satisfy this requirement are azo, azomethine, anthraquinone, naphthoquinone, styryl, nitro, quinoline, carbonyl and phthalocyanine dye residues. The spectral absorption of these dye residues may be temporarily shifted toward a shorter wavelength in order to regenerate the desired image color during thermal development or subsequent transfer. In order to provide an image with enhanced resistance to light, these dye residues may be rendered chelatable as described in Japanese Patent Application (OPI) Nos. 48765/1984 and 124337/1984.

The dye-providing materials described above may be used either independently or in combination. The amount in which these dye-providing materials are used is in no way limited and may be determined depending upon the type of the dye-providing materials used, or as to whether they are used singly or in combination, or as to whether the photographic layers in the light-sensitive material of the present invention are single-layered or multi-layered. As a guide, the dye-providing materials may be used in amounts of 0.005–50 g, preferably 0.1–10 g, per square meter of the light-sensitive material.

The dye-providing materials used in the present invention may be incorporated in photographic layers in the thermally developable light-sensitive material by any known method. For instance, the dye-providing material is dissolved in a low-boiling point solvent (e.g. methanol, ethanol or ethyl acetate) or in a high-boiling point solvent (e.g. dibutyl phthalate, dioctyl phthalate or tricresyl phosphate), and the resulting solution is sonicated to disperse the dye-providing material; alternatively, the dye-providing material is dissolved in an aqueous alkaline solution (e.g. an aqueous solution of 10% sodium hydroxide) and then neutralized with a mineral acid (e.g. hydrochloric acid or nitric acid); in still another method, the dye-providing material is dispersed in an aqueous solution of an appropriate polymer (e.g. gelatin, polyvinyl butyral or polyvinylpyrrolidone) by means of a ball mill.

Any of the reducing agents commonly employed in the field of thermally developable light-sensitive materials may be used in the light-sensitive material of the present invention. Examples are the p-phenylenediamine-based and p-aminophenolic developing agents, phosphoroamidophenolic and sulfonamidophenolic developing agents, and hydrazone-based color developing agents of the types described in U.S. Pat. Nos. 3,531,286, 3,761,270, 3,764,328, Research Disclosure Nos. 12146, 15108 and 15127, and Japanese Patent Application (OPI) No. 27132/1981. Color developing agent precursors of the types described in U.S. Pat. Nos. 3,342,599 and 3,719,492, and Japanese Patent Application (OPI) Nos. 135628/1978 and 79035/1979 may also be used with advantage.

A particularly preferable reducing agent is the one shown in Japanese Patent Application (OPI) No. 146133/1981 which is represented by the following general formula (39):

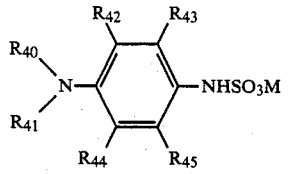

(39)

where $R_{40}$ and $R_{41}$ are each a hydrogen atom or an optionally substituted alkyl group having 1–30 (preferably 1–4) carbon atoms, provided that $R_{40}$ and $R_{41}$ may combine to form a hetero ring; $R_{42}$, $R_{43}$, $R_{44}$ and $R_{45}$ are each a hydrogen atom, a halogen atom, a hydroxyl group, an amino group, an alkoxy group, an acylamido group, a sulfonamido group, an alkylsulfonamido group or an optionally substituted alkyl group having 1–30 (preferably 1–4) carbon atoms, provided that $R_{42}$ and $R_{40}$ as well as $R_{44}$ and $R_{41}$ may combine to form hetero rings; M is a compound containing an alkali metal atom, an ammonium group, a nitrogenous organic base or a quaternary nitrogen atom.

These reducing agents may be used either independently or in combination. The amount in which the reducing agents are used depends on such factors as the types of the light-sensitive silver halide, the silver salt of organic acid and other additives used. Usually, the amount of their addition is within the range of 0.01–1500 moles, preferably 0.1–200 moles, per mole of the light-sensitive silver halide. In terms of molar ratio to the monomer unit in the the dye-providing material, the reducing agents are used in amounts ranging from 0.05 to 10 moles, preferably from 0.1 to 5 moles, per mole of the monomer unit.

Binders which may be used in the thermally developable light-sensitive material of the present invention are natural and synthetic high-molecular weight substances such as polyvinyl butyral, polyvinyl acetate, ethyl cellulose, polymethyl methacrylate, cellulose acetate butyrate, polyvinyl alcohol, polyvinylpyrrolidone, gelatin and phthalated gelatin. These binders may be used either singly or in combination. It is particularly preferable to use gelatin or derivatives thereof in combination with hydrophilic polymers such as polyvinylpyrrolidone and polyvinyl alcohol. Most preferable binders are shown in Unexamined Published Japanese Patent Application No. 229556/1984.

The vinylpyrrolidone polymers described above may be crosslinked polymers, in which case crosslinking is preferably achieved after coating on a support (including the case where a crosslinking reaction proceeds during standing under natural conditions).

The binder is generally used in an amount of 0.005–100 g, preferably 0.01–40 g, more preferably 0.1–10 g, per square meter of one photographic layer. In terms of weight relative to the dye-providing monomer unit, the binder is preferably used in an amount of 0.1–10 g, more preferably 0.25–4 g, per gram of said unit.

Supports that can be used with the thermally developable light-sensitive material of the present invention include; synthetic plastic films such as a polyethylene film, a cellulose acetate film, a polyethylene terephthalate film and a polyvinyl chloride film; paper supports such as photographic raw paper, printing paper, baryta paper and resin-coated paper; and supports having a reflective layer formed on one of the synthetic plastic films mentioned above.

A variety of "hot" solvents are preferably incorporated in the thermally developable light-sensitive material of the present invention. Any substance that is capable of accelerating the rate of thermal development and/or thermal transfer may be used as a "hot" solvent. The "hot" solvent is preferably a substance that is solid, semi-solid or liquid (preferably boiling at 100° C. or above, more preferably at 150° C. or above, at atmospheric pressure) and which will dissolve or melt in the binder upon heating. Preferable examples of the "hot" solvent include urea derivatives (e.g. dimethylurea, diethylurea and phenylurea), amide derivatives (e.g. acetamide and benzamide), polyhydric alcohols (e.g. 1,5-pentanediol, 1,6-pentanediol, 1,2-cyclohexanediol, pentaerythritol and trimethylolethane), and polyethylene glycols. Further details of these "hot" solvents are given in Japanese Patent Application No. 104249/1983. These "hot" solvents may be used either singly or in combination.

In addition to the components described above, various additives may be incorporated in the thermally developable light-sensitive material of the present invention as required. One such optional additive is a development accelerator, examples of which include: alkali releasing agents such as urea and guanidium trichloroacetate as described in U.S. Pat. Nos. 3,220,840, 3,531,285, 4,012,260, 4,060,420, 4,088,496 and 4,207,392, Research Disclosure Nos. 15733, 15734, and 15776, and Japanese Patent Application (OPI) Nos. 130745/1981 and 132332/1981; an organic acid as described in Japanese Patent Publication No. 12700/1970; nonaqueous polar solvent compounds having a —CO—, —$SO_2$— or —SO— group as described in U.S. Pat. No. 3,667,959; a melt former as described in U.S. Pat. No. 3,438,776; and polyalkylene glycols as described in U.S. Pat. No. 3,666,477 and Japanese Patent Application (OPI) No. 19525/1976. Another additive that may be optionally used is a toning agent, examples of which are shown in Japanese Patent Application (OPI) Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980 and 32015/1980, West German Pat. Nos. 2,140,406, 2,147,063, and 2,220,618; and U.S. Pat. Nos. 3,080254, 3,847,612, 3,782,941, 3,994,732, 4,123,282 and 4,201,582; the compounds shown in these patents include phthalazinone, phthalimide pyrazolone, quinazolone, N-hydroxynaphthalimide, benzoxazine, naphthoxazinedione, 2,3-dihydro-phthalazinedione, 2,3-dihydro-1,3-oxazine-2,4-dione, oxypyridine, aminopyridine, hydroxyquinoline, aminoquinoline, isocarbostyryl, sulfonamide, 2H-1,3-benzothiazine-2,4-(3H)-dione, benzotriazine, mercaptotriazole, dimercaptotetrazapentalene, phthalic acid, naphthalic acid and phthalamic acid. One or more of these compounds may be used in mixture with imidazole compounds; at least one of acids such as phthalic acid and naphthalic acid and acid anhydrides thereof may be mixed with phthalazine compounds; or alternatively, phthalazine may be combined with acids such as maleic acid, itaconic acid, quinolic acid and gentisic acid.

Other compounds which are effective as toning agents are 3-amino-5-mercapto-1,2,4-triazoles and 3-acylamino-5-mercapto-1,2,4-triazoles of the types described in Japanese Patent Application (OPI) Nos. 189628/1983 and 193460/1983.

Antifoggants other than the development restrainer of the present invention may also be used, and preferable examples of such antifoggants which may be used in combination with the restrainer of the present invention include the hydroquinone derivatives (e.g. di-t-octylhydroquinone and dodecanylhydroquinone) described in Japanese Patent Application No. 56506/1984 and the combinations of hydroquinone derivatives and benzotriazole derivatives (e.g. 4-sulfobenzotriazole and 5-carboxybenzotriazole) shown in Japanese Patent No. 66380/1984.

An agent that serves to prevent printing-out after processing may also be used as a stabilizer, and the hydrocarbon halides described in Japanese Patent Application (OPI) Nos. 45228/1973, 119624/1975, 120328/1975 and 46020/1978 may be employed as such agents; more specific examples are tetrabromoethane, tribromoethanol, 2-bromo-2-tolylacetamide, 2-bromo-2-tolylsulfonylacetamide, 2-tribromomethylsulfonylbenzothiazole, and 2,4-bis(tribromomethyl)-6-methyltriazine.

Post-treatment may be performed using sulfur-containing compounds as described in Japanese Patent Publication No. 5393/1971, Japanese Patent Application (OPI) Nos. 54329/1975 and 77034/1975.

The thermally developable light-sensitive material of the present invention may also contain an isothiuronium based stabilizer of the types described in U.S. Pat. Nos. 3,301,678, 3,506,444, 3,824,103 and 3,844,788, or an activator/stabilizer precursor of the types described in U.S. Pat. Nos. 3,669,670, 4,012,260 and 4,060,420.

A water releasing agent such as sucrose or $NH_4Fe(SO_4)_2 \cdot 12H_2O$ may also be employed. If desired, thermal development may be carried out with water being supplied as shown in Japanese Patent Application (OPI) No. 132332/1981.

In addition to the components described above, the thermally developable light-sensitive material of the present invention may contain various additives and coating aids such as spectral sensitizing dyes, antihalation dyes, brighteners, hardening agents, antistats, plasticizers and leveling agents.

A preferable basic structure of the thermally developable light-sensitive material of the present invention is such that (1) a light-sensitive silver halide, (2) a reducing agent, (3) an organic silver salt, (4) a binder and (5) a dye-providing material are incorporated in one light-sensitive layer. However, these components need not be incorporated in a single layer, and they may be incorporated in two or more photographic layers so long as they remain reactive with one another. For instance, a light-sensitive layer is divided into two layers, with components (1) to (4) being incorporated in one sublayer and component (5) in the other sublayer which is adjacent said first sublayer.

The development restrainer of the present invention is of course effective in a thermally developable light-sensitive material of the dry silver type which produces an image solely made of silver.

The light-sensitive layer may be divided into two layers such as a high-sensitivity layer and a low-sensitivity layer, or it may be divided into three or more layers. The light-sensitive layer may be combined with one or more light-sensitive layers that are sensitive to light of other colors. Furthermore, said layer may be provided with a variety of photographic layers such as a topcoat, an undercoat, a backing layer, an intermediate layer and a filter layer.

Coating solutions are prepared not only for the thermally developable light-sensitive layer but also for other photographic layers such as a protective layer, an intermediate layer, an undercoat, and a backing layer and are applied by dip coating, air-knife coating, curtain coating, hopper coating (see U.S. Pat. No. 3,681,294) or any other appropriate coating techniques to make a light-sensitive material.

If necessary, two or more layers may be applied simultaneously by employing the methods described in U.S. Pat. No. 2,761,791 and British Patent No. 837,095.

The components described above which are employed in the photographic layers of the thermally developable light-sensitive material of the present invention are coated onto a support for a dry thickness which preferably ranges from 1 to 1,000 $\mu$m, more preferably from 3 to 20 $\mu$m.

The thermally developable light-sensitive material of the present invention, after being subjected to imagewise exposure, may be simply heated generally at 80°–200° C. (preferably 120°–170° C.) for a period of 1–180 seconds (preferably 1.5–120 seconds) so as to obtain a color-developed image. If need be, development may be achieved with the light-sensitive material being placed in close contact with a water-impermeable material, or alternatively, the light-sensitive material may be subjected to pre-exposure heating at a temperature within the range of 70°–180° C.

The thermally developable light-sensitive material of the present invention may be given an exposure by various means. Light sources commonly employed for conventional color prints may be used, such as a tungsten lamp, a mercury lamp, a xenon lamp, a laser bean and CRT rays.

All heating methods that can be applied to the conventional thermally developable light-sensitive material may be employed in the present invention; illustrative heating means include contact with a heated block or plate, contact with heated rollers or a heated drum, passage through a hot atmosphere, radio-frequency heating, and the use of the Joule heat that is generated by application of a current or strong magnetic field to an electrically conductive layer formed within the light-sensitive material of the present invention or a heat-transfer image-receiving layer (element). Heating profile that can be employed is in no way limited; preheating may be followed by another heating, or cyclic heating may be achieved either for a short period at high temperature or for a prolonged period at low temperature, or intermittent heating may be effected. A convenient heating profile is preferable. If desired, exposure and heating may proceed simultaneously.

Any image-receiving member may be employed in the present invention if it has a capacity for accommodating the dye either released or formed by thermal development. A preferable image-receiving member is formed of a mordant used in a dye diffusion transfer light-sensitive material or a heat-resistant organic large-molecular substance of the type shown in Japanese Patent Application (OPI) No. 207250/1982 which has a glass transition temperature of at least 40° C. and not higher than 250° C.

Specific examples of the usable mordant include: nitrogenous secondary and tertiary amines; nitrogenous heterocyclic compounds, and quaternary cationic compounds thereof; the vinylpyridine polymer and vinylpyridinium cation polymer shown in U.S. Pat. Nos. 2,548,564, 2,484,430, 3,148,061 and 3,756,814; the polymer containing a dialkylamino group which is shown in U.S. Pat. No. 2,675,316; the aminoguanidine derivatives shown in U.S. Pat. No. 2,882,156; reactive polymers capable of forming a covalent bond as shown in Japanese Patent Application (OPI) No. 137333/1979; mordants capable of crosslinking with gelatin or the like as shown in U.S. Pat. Nos. 3,625,694 and 3,859,096, and British Patent Nos. 1,277,453 and 2,011,012; the aqueous sol type mordants shown in U.S. Pat. Nos. 3,958,995, 2,721,852 and 2,798,063; the water-insoluble mordant shown in Japanese Patent Application (OPI) No. 61228/1975; and the mordants described in U.S. Pat. No. 3,788,855, West German Patent Application (OLS) No. 2,843,320, Japanese Patent Application (OPI) Nos. 30328/1978, 155528/1977, 125/1978, 1024/1978, 74430/1979, 124726/1979 and 22766/1980, U.S. Pat. Nos. 3,642,482, 3,488,706, 3,557,066, 3,271,147 and 3,271,148, Japanese Patent Publication Nos. 29418/1980, 36414/1981 and 12139/1982, and Research Disclosure No. 12045 (1974).

Particularly useful mordants are polymers containing ammonium salts, such as a quaternary amino group, as shown in U.S. Pat. No. 3,709,690. An illustrative polymer containing an ammonium salt is polystyrene-co-N,N,N-tri-n-hexyl-N-vinylbenzylammonium chloride, with the styrene to vinylbenzylammonium chloride ranging from 1:4 to 4:1, preferably at 1:1.

An image-receiving layer must be employed if the thermally developable light-sensitive material of the present invention contains a dye-providing material that liberates or forms a diffusible dye. The image-receiving layer which will receive an imagewise pattern of the diffusible dye that forms when the photographic layers are subjected to image exposure and thermal development may be formed of any material that is customarily used in the art, such as paper, cloth and plastics. In a preferable embodiment, an image-receiving layer containing a mordant or a compound having a capacity for dye accommodation is formed on a support. A particularly preferable image-receiving layer is one formed of polyvinyl chloride as shown in Japanese Patent Application No. 97907/1983 or one which is composed of a polycarbonate and a plasticizer as shown in Japanese Patent Application No. 128600/1983.

The image-receiving layer may be formed on the same support as that for the above-described photographic layers in which case the image-receiving layer may be designed to be strippable from the photographic layers after dye transfer. Alternatively, the image-forming layer and the photographic layers may be disposed on separate supports. Any techniques known in the art may be employed without any limitation in order to form the image-receiving layer.

A typical image-receiving layer for dye diffusion transfer may be attained by coating a support with a mixture of gelatin and a polymer containing an ammonium salt.

The polymers are dissolved in appropriate solvents and applied onto a support to form image-receiving layers; alternatively, image-receiving films formed of these polymers may be laminated on a support; members (e.g. films) formed of these polymers may independently be used to form image-receiving layers that also serve as a support.

An image-receiving layer on a transparent support may be coated with an opacifying layer (reflective layer) having titanium dioxide or other pigments dispersed in gelatin. In this case, a reflective transfer color image can be seen through the transparent support associated with the image-receiving layer.

To summarize the advantages of the thermally developable light-sensitive material of the present invention, it is capable of providing a high-density image with a minimum degree of fog. In addition, the thermally developable light-sensitive material of the present, if it contains a compound represented by the general formula [I-B] or [I-C], exhibits good keeping quality after manufacture.

The following examples are provided for the purpose of further illustrating the present invention but are in no sense to be taken as limiting possible embodiments of the present invention.

EXAMPLE 1

Preparation of Emulsion A:

Emulsion A was prepared by the following procedures. To solution A having 20 g of ossein gelatin and ammonia dissolved in 1000 ml of distilled water and which was held at 50° C., solution B containing 130.9 g of potassium bromide in 500 ml of water and solution C containing 1 mole of silver nitrate and ammonia in 500 ml of water were added simultaneously at a controlled pAg in a mixer/agitator of the type shown in Japanese Patent Application Nos. (OPI) 92523/1982 and 92524/1982. The shape and size of the emulsion grains being formed were adjusted by controlling the pH, pAg and the rates of addition of solutions B and C. As a result, a silver bromide emulsion was attained. The silver halide grains in the emulsion were octahedral in shape with an average size of 0.3 μm and 8% monodispersity. This emulsion was washed with water and desalted. The yield of the emulsion was 800 ml.

Preparation of Emulsions B and C:

Two emulsions, B and C, having different silver iodide contents were prepared by the following procedures. As in the preparation of emulsion A, solution A was first prepared by dissolving 20 g of ossein gelatin and ammonia in 1000 ml of distilled water. To solution A held at 50° C., 500 ml of solution B which was an aqueous solution containing predetermined amounts of potassium iodide and potassium bromide (6.64 g and 130.9 g, respectively, for emulsion B, and 11.62 g and 130.9 g for emulsion C), and 500 ml of solution C which was an aqueous containing 1 mole of silver nitrate and ammonia were added simultaneously, with the pAg held at a constant value. The shape and size of the emulsion grains being formed were adjusted by controlling the pH, pAg and the rates of addition of solutions B and C. As a result, silver iodobromide emulsions were B and C obtained. They had octahedral grains with 9% monodispersity. The only difference between the two emulsions was about the content of silver iodide. Both emulsions were washed with water and desalted. The yield of each emulsion was 800 ml.

Preparation of Emulsions D, E and F:

Three core/shell type emulsions having different silver iodide contents and grain sizes were prepared by the following procedures. To solution A having 20 g of ossein gelatin and ammonia dissolved in 1000 ml of distilled water and which was held at 50° C., 500 ml of solution B which was an aqueous solution containing predetermined amounts of potassium iodide and potassium bromide (11.62 g and 130.9 g, respectively, for emulsion D; 11.62 g of potassium iodide and 130.9 g of potassium bromide for emulsion E; and 33.2 g and 119.0 g for emulsion F), and 500 ml of solution C which was an aqueous solution containing 1 mole of silver nitrate and ammonia were added simultaneously at a controlled pAg in a mixture/agitator of the type shown in Japanese Patent Application (OPI) Nos. 92523/1982 and 92524/1982. The shape and size of the core emulsion grains being formed were adjusted by controlling the pH, pAg and the rates of addition of solutions B and C. As a result, three core emulsions comprising octahedral grains with 8% monodispersity were obtained. The only differences were about the grain size and the content of silver iodide.

By repeating the same procedures, a silver halide shell was coated on each of the so prepared core silver halide grains. As a result, three core/shell emulsions, D, E and F, were prepared; they comprised grains which were of the same octahedral shape but which had different sizes and silver iodide contents.

These emulsions were washed with water and desalted. The yield of each emulsion was 800 ml. The characteristics of the six emulsions, A to F, are summarized in Table 1.

TABLE 1

| Emulsion | AgI content (mol %) core | AgI content (mol %) shell | Shell thickness (μm) | Grain size (μm) |
|---|---|---|---|---|
| A | 0 | | — | 0.3 |
| B | 4 | | — | 0.3 |

TABLE 1-continued

| Emulsion | AgI content (mol %) core | AgI content (mol %) shell | Shell thickness (μm) | Grain size (μm) |
|---|---|---|---|---|
| C | 7 | | — | 0.3 |
| D | 7 | 2 | 0.04 | 0.3 |
| E | 7 | 2 | 0.05 | 0.5 |
| F | 20 | 4 | 0.04 | 0.3 |

Preparation of light-sensitive silver halide dispersion:

Each of the six silver halide emulsions, A to F, was subjected to sulfur sensitization with sodium thiosulfate in the presence of a sensitizing dye (1) having the structure shown below and 4-hydroxy-6-methyl-1,3,3a,7-tetrazaindene, so as to prepare a dispersion of light-sensitive silver halide having the following formulation:

silver halide (in terms of silver): 381 g
gelatin: 85 g/2820 ml

Sensitizing dye (1):

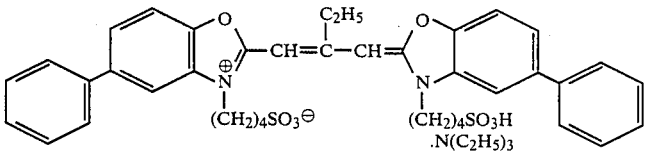

Preparation of organic silver salt dispersion:

5-methylbenzotriazole was reacted with silver nitrate in a mixed solvent of water and alcohol; 28.8 g of the resulting 5-methylbenzotriazole silver, 16.0 g of poly(N-vinylpyrrolidone) and 1.33 g of sodium 4-sulfobenzotriazole were dispersed in water with an alumina ball mill and thereafter adjusted to pH 5.5 to prepare a dispersion of organic silver salt in a yield of 200 ml.

Preparation of dispersion of dye-providing material:

A dye-providing material No. ⑦ having the structure shown below was dissolved in 200 ml of ethyl acetate in an amount of 35.5 g. The solution was mixed with 124 ml of an aqueous solution of 5 wt% Alkanol XC (Du Pont) and 720 ml of an aqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the pH of the dispersion was adjusted to 5.5 and its volume adjusted to 795 ml to make dispersion (1) of the dye-providing material.

Preparation of developer dispersion:

A reducing agent (23.3 g) identified by (R-11), 1.10 g of a development accelerator having the formula given below, 14.6 g of poly(N-vinylpyrrolidone) and 0.50 g of a fluorine-based surfactant having the formula shown below were dissolved in water. The pH of the solution was adjusted to 5.5 and its volume to 250 ml to make a dispersion of the developer.

Reducing agent (R-11)

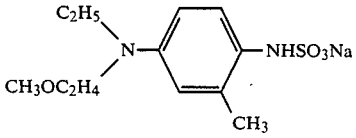

-continued

Development accelerator:

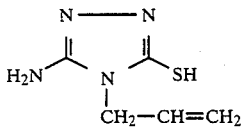

Surfactant:

$N_aO_3S-CH(CH_2COOCH_2(CF_2CF_2)_nH)COOCH_2(CF_2CF_2)_mH$ (m, n = 2 or 3)

Preparation of thermally developable light-sensitive material:

Six milliliters of one of the three light-sensitive silver halide dispersions, A, C and D, was mixed with 12.5 ml of the dispersion of organic silver salt, 39.8 ml of the dispersion of dye-providing material ⑦, 12.5 ml of the dispersion of developer, and an aqueous solution of $2\times10^{-2}$ moles of one of the compounds listed in Table 2 below. To the resulting mixture, 2.50 ml of a hardening agent [i.e., a solution of hardening agent prepared by reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)methane] and 3.80 g of a hot solvent (polyethylene glycol 300 of Kanto Chemical Co., Inc.) were added. The resulting coating solution was applied to a 180 μm thick subbed photographic polyethylene terephthalate film for a silver deposit of 1.76 g/m². The applied light-sensitive layer was further coated with a protective layer made of a mixture of phenylcarbamoylated gelatin (Type 17819PC Rousselot Inc.) and poly(N-vinylpyrrolidone), so as to obtain sample Nos. A-1 to A-15 of thermally developable light-sensitive material shown in Table 2.

Preparation of image-receiving element:

An image-receiving element was prepared by coating a tetrahydrofuran solution of polyvinyl chloride (n=1,100; product of Wako Pure Chemical Industries, Ltd.) on photographic baryta paper to attain a polyvinyl chloride deposit of 12 g/m².

Each of the thermally developable light-sensitive materials previously prepared was given an exposure of 1,600 C.M.S. through a step wedge, superposed on the image-receiving element, and thermally developed at 150° C. for 1 minute in a thermal developer (Developer Module 277 of 3M). Immediately thereafter, the light-sensitive material was stripped away from the image-receiving element, which carried a negative image of magenta color.

The green reflection densities of the negative images attained from sample Nos. A-1 to A-15 were measured with a densitometer (PDA-65 of Konishiroku Photo Industry Co., Ltd.). The respective values of maximum density, relative sensitivity and minimum density (fog) attained for each sample are shown in Table 2.

TABLE 2

| Sample No. | Emulsion | Restrainer: Compound | Restrainer: Amount added (mol/mol Ag) | $D_{min}$ | $D_{max}$ | Relative sensitivity |
|---|---|---|---|---|---|---|
| Comparative samples | | | | | | |
| A-1 | A | — | — | 0.30 | 2.20 | 100 |
| A-2 | C | — | — | 0.36 | 2.18 | 182 |
| A-3 | D | — | — | 0.33 | 2.24 | 218 |
| A-4 | D | (a) | $1\times10^{-4}$ | 0.38 | 2.21 | 76 |
| A-5 | D | (a) | $1\times10^{-3}$ | 0.49 | 2.17 | 139 |
| Samples of the invention | | | | | | |
| A-6 | D | (A-22) | $1\times10^{-4}$ | 0.31 | 2.21 | 207 |
| A-7 | D | (A-41) | $1\times10^{-4}$ | 0.32 | 2.20 | 211 |
| A-8 | D | (A-42) | $1\times10^{-4}$ | 0.32 | 2.18 | 208 |
| A-9 | D | (A-21) | $1\times10^{-4}$ | 0.19 | 2.21 | 227 |
| A-10 | A | (A-20) | $1\times10^{-4}$ | 0.16 | 2.18 | 105 |
| A-11 | C | (A-20) | $1\times10^{-4}$ | 0.20 | 2.19 | 192 |
| A-12 | D | (A-20) | $1\times10^{-4}$ | 0.17 | 2.20 | 231 |
| A-13 | D | (A-20) | $1\times10^{-3}$ | 0.14 | 2.21 | 224 |
| A-14 | D | (A-24) | $1\times10^{-4}$ | 0.17 | 2.21 | 226 |
| A-15 | D | (A-40) | $1\times10^{-4}$ | 0.18 | 2.22 | 220 |

The comparative restrainer (a) mentioned in Table 2 had the following structural formula:

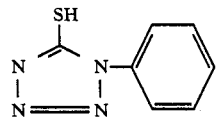

The "relative sensitivity" whose values are shown in Table 2 is the reciprocal of the amount of exposure necessary to provide a density of fog+0.3 and indicated in terms of a relative value, with the value for sample No. A-1 being taken as 100.

As one can seen by comparison with the data for sample Nos. A-1 to A-3 containing no restrainer, sample Nos. A-4 and A-5 containing the comparative restrainer exhibited little effect in reducing the minimum density (fog) while sample Nos. A-6 to A-15 containing restrainers within the scope of the present invention displayed reduced minimum densities without substantially reducing the maximum density (this effect was particularly noticeable with sample Nos. A-9 to A-15). It is therefore clear that the restrainers of the present invention were effective in preventing thermal fog. The samples prepared in accordance with the present invention attained generally higher sensitivities than the comparative samples.

Compared with sample No. A-10 of the present invention employing a silver bromide emulsion, sample No. A-11 of the present invention which employed a AgI-containing silver iodobromide emulsion attained a significant increase in sensitivity. An even greater increase in sensitivity was achieved by sample Nos. A-12 to A-15 which employed the core/shell type silver iodobromide emulsion D. It is therefore clear that the restrainers of the present invention were effective in preventing thermal fog irrespective of the type of emulsion used.

EXAMPLE 2

Preparation of light-sensitive silver halide dispersion:

Emulsions A, B and F prepared in Example 1 were subjected to sulfur sensitization with sodium thiosulfate in the presence of a sensitizing dye (2) having the structure shown below and 4-hydroxy-6-methyl-1,3,3a,7-tetrazaindene, so as to prepare dispersions of light-sensitive silver halide having the following formulation:

silver halide (in terms of silver): 381 g
gelatin: 85 g/2820 ml

Sensitizing dye (2):

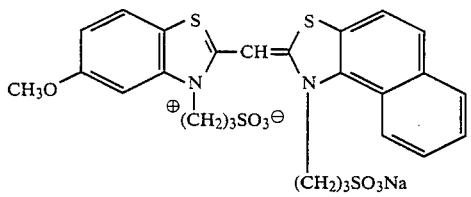

Preparation of dispersion of dye-providing material:

Thirty grams of a dye-providing material ③ having the structure shown below was dissolved in 30.0 g of tricresyl phosphate and 90.0 ml of ethyl acetate. The solution was mixed with 460 ml of an aqueous gelatin solution containing the same surfactant as used in Example 1; the mixture was dispersed with an ultrasonic homogenizer and the ethyl acetate was distilled off. By addition of water to make a total volume of 500 ml, dispersion (2) of the dye providing material was produced.

Dye-providing material ③

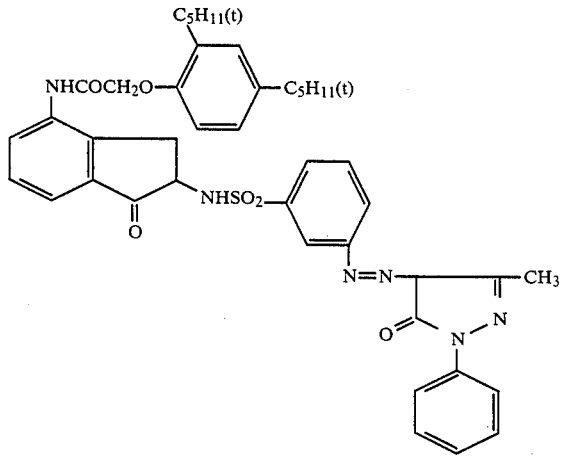

Preparation of thermally developable light-sensitive material:

Forty milliliters of the previously prepared dispersion of light-sensitive silver halide was mixed with 25.0 ml of the dispersion of organic silver salt prepared in Example 1 and 50.0 ml of the above-prepared dispersion of dye-providing material 3. To the resulting mixture was added 4.20 g of a hot solvent (polyethylene glycol 300 of Kanto Chemical Co., Inc.) 3.00 ml of the same solution of hardening agent as used in Example 1, 20.0 ml of a solution of 10 wt% guanidinetrichloroacetic acid in a mixture of water and alcohol, and 20 ml of a methanol solution of 10 wt% 2,6-dichloro-p-aminophenol. The resulting coating solution was applied to a 180 μm thick subbed photographic polyethylene terephthalate film for a silver deposit of 2.50 g/m². By these procedures, sample Nos. A-16 to A-33 of thermally developable light-sensitive material having the compositions shown in Table 3 were prepared.

Preparation of image-receiving element:

An image-receiving element was prepared by successively coating the following layers on a 100 μm thick transparent polyethylene terephthalate film:

(1) polyacrylic acid layer (7.00 g/m²);
(2) acetylcellulose layer (4.00 g/m²); and
(3) layer made of a 1:1 copolymer of styrene and N-benzyl-N,N-dimethyl-N-(3-maleimidopropyl-)ammonium chloride and gelatin (copolymer, 3.00 g/m²; gelatin, 3.00 g/m²).

Each of the thermally developable light-sensitive materials (sample Nos. A-16 to A-33) was given an exposure of 1,600 C.M.S. through a step wedge, heated on a heat block for 1 minute at 150° C., superimposed on the image-receiving element while it was submerged in water, and the two elements were compressed together at 500–800 g/cm² for 30 seconds at 50° C. Immediately thereafter, the two elements were stripped apart from each other. The transmission density of the yellow transparent image formed on the surface of the image-receiving element was measured with a densitometer (PDA-65 of Konishiroku Photo Industry Co., Ltd.). The respective values of maximum density, minimum density (fog) and relative density attained for each sample are shown in Table 3.

The comparative restrainer (a) mentioned in Table 3 was the same as employed in Example 1. The "relative sensitivity" whose values are shown in Table 3 is the reciprocal of the amount of exposure necessary to provide a density of fog+0.3 and indicated in terms of a relative value, with the value for sample No. a-16 being taken as 100.

TABLE 3

| Sample No. | Emulsion | Restrainer: Compound | Restrainer: Amount added (mol/mol/Ag) | $D_{min}$ | $D_{max}$ | Relative sensitivity |
|---|---|---|---|---|---|---|
| Comparative samples | | | | | | |
| A-16 | A | — | — | 0.31 | 2.16 | 100 |
| A-17 | B | — | — | 0.35 | 2.17 | 161 |
| A-18 | E | — | — | 0.30 | 1.23 | 366 |
| A-19 | F | — | — | 0.32 | 2.15 | 285 |
| A-20 | B | (a) | $1 \times 10^{-4}$ | 0.48 | 2.12 | 167 |
| Samples of the invention | | | | | | |
| A-21 | B | (A-22) | $1 \times 10^{-4}$ | 0.32 | 2.16 | 144 |

TABLE 3-continued

| Sample No. | Emulsion | Restrainer Compound | Restrainer Amount added (mol/mol/Ag) | $D_{min}$ | $D_{max}$ | Relative sensitivity |
|---|---|---|---|---|---|---|
| A-22 | B | (A-22) | $1 \times 10^{-3}$ | 0.32 | 2.14 | 114 |
| A-23 | B | (A-41) | $1 \times 10^{-4}$ | 0.34 | 2.13 | 150 |
| A-24 | B | (A-42) | $1 \times 10^{-4}$ | 0.34 | 2.12 | 145 |
| A-25 | B | (A-42) | $1 \times 10^{-3}$ | 0.33 | 2.09 | 138 |
| A-26 | B | (A-20) | $1 \times 10^{-4}$ | 0.17 | 2.18 | 169 |
| A-27 | A | (A-21) | $1 \times 10^{-4}$ | 0.18 | 2.15 | 105 |
| A-28 | B | (A-21) | $1 \times 10^{-4}$ | 0.15 | 2.17 | 171 |
| A-29 | B | (A-21) | $1 \times 10^{-3}$ | 0.13 | 2.16 | 167 |
| A-30 | E | (A-21) | $1 \times 10^{-4}$ | 0.13 | 1.20 | 385 |
| A-31 | F | (A-21) | $1 \times 10^{-3}$ | 0.14 | 2.13 | 300 |
| A-32 | B | (A-38) | $1 \times 10^{-4}$ | 0.16 | 2.16 | 168 |
| A-33 | B | (A-39) | $1 \times 10^{-4}$ | 0.17 | 2.15 | 167 |

As one can see from Table 3, restrainers within the scope of the present invention attained the same results as in Example 1 even when they were used in combination with the dye-providing material ③ which, when heated, would react with a light-sensitive silver halide to release a hydrophilic dye.

In comparison with sample Nos. A-16 to A-19 containing no restrainer, sample No. A-20 containing the comparative restrainer exhibited little effect in reducing the minimum density (fog) while sample Nos. A-21 to A-33 containing the restrainers of the present invention displayed reduced minimum densities without substantially reducing the maximum density (this effect was particularly noticeable with sample Nos. A-26 to A-33). It is therefore clear that the restrainers of the present invention is capable of preventing thermal fog. The samples prepared in accordance with the present invention attained generally higher sensitivities than the comparative samples.

Compared with sample No. A-27 of the present invention employing a silver bromide emulsion, sample Nos. A-29, A-32 and A-33 which employed a AgI-containing silver iodobromide emulsion attained a significant increase in sensitivity. An even greater increase in sensitivity was achieved by sample Nos. A-30 and A-31 which employed the core/shell type silver iodobromide emulsions, E and F. It is therefore clear that the restrainers of the present invention were effective in thermal fog irrespective of the type of emulsion used.

EXAMPLE 3

Preparation of 5-methylbenzotriazole silver:

5-Methylbenzotriazole was reacted with silver nitrate in a mixed solvent of water and ethanol; 28.8 g of the resulting 5-methylbenzotriazole silver and 16 g of poly-N-vinylpyrrolidone (Mw=30,000) were dispersed in 150 ml of water with an aluminum ball mill. After pH adjustment to 5.5, the dispersion was worked up to a volume of 200 ml.

Dispersion of dye-providing material:

A dye-providing material, cpm-I (35.5 g) having the structure shown below, 5.0 g of a hydroquinone compound having the structure shown below and a restrainer of the present invention (B-1) were dissolved in 200 ml of ethyl acetate. The solution was mixed with 124 ml of an aqueous solution of 5 wt% Alkanol XC (Du Pont) and 720 ml of an aqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the dispersion was adjusted to pH 5.5 and worked up to a volume of 800 ml.

Dye-providing material, cpm-I

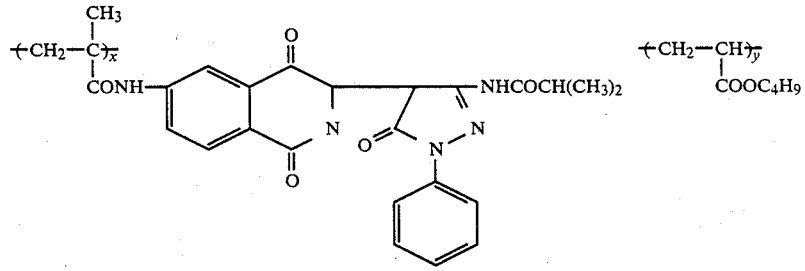

x:y = 2:3 by weight

Hydroquinone compound

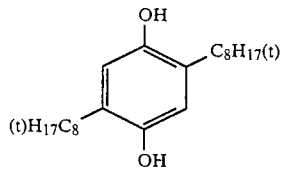

Developer solution:

The reducing agent (R-11) (23.3 g), 1.10 g, 14.6 g of poly(N-vinylpyrrolidone) (Mw=30,000) and 0.5 g of a fluorine-based surfactant having the formula shown below were dissolved in water. The solution was adjusted to pH 5.5 and worked up to a volume of 250 ml.

Development accelerator

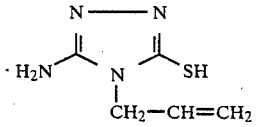

Surfactant

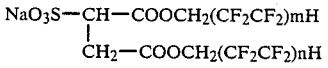

(m, n = 2 or 3)

Preparation of thermally developable light-sensitive material:

The dispersion of organic silver salt (12.5 ml), 40.0 ml of the dispersion of dye-providing material (cpm-1), 12.5 ml of the developer solution, 2.0 g of polyethylene glycol, 2.0 g of 3-methylpentane-1,3,5-triol and 6 ml of a silver halide emulsion having an average grain size of 0.13 μm (containing $7.5\times10^{-3}$ moles of silver halide in terms of silver) were mixed. To the mixture was added 2.5 ml of a solution of hardening agent [i.e., a solution prepared by first reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)-methane]. The resulting coating solution was applied to a 180 μm thick subbed photographic polyethylene terephthalate film for a silver deposit of 2.64 g/m². The applied light-sensitive layer was further coated with a protective layer made of a mixture of phenylcarbamoylated gelatin (Type 17819PC of Rousselot Inc.) and poly(N-vinylpyrrolidone), (Mw=30,000), so as to obtain sample No. B-1 of thermally developable light-sensitive material.

The so prepared light-sensitive material was dried and exposed to white light (8,000 C.M.S.) through a step wedge.

In a separate step, an image-receiving layer made of polyvinyl chloride was coated on baryta paper in an amount of 12 g/m². The resulting image-receiving sheet was superposed on the exposed light-sensitive material, with the image-receiving layer side being placed in contact with the coated surface of the latter. The assembly was developed by heating at 150° C. for 1 minute and, thereafter, the light-sensitive material was stripped from the image-receiving sheet now carrying a magenta transfer image. The maximum reflection density (Dmax) of the transfer image and its fog (Dmin) are shown in Table 4.

EXAMPLE 4

Light-sensitive materials, Nos. B-2 to B-13, were prepared by repeating the procedures of Example 3 except that the types and amounts of the restrainers of the present invention were changed as shown in Table 4. The materials were exposed and thermally developed as in Example 3 to obtain the results shown in Table 4.

COMPARATIVE EXAMPLE 1

Comparative light-sensitive materials, Nos. B-14 to B-25, were prepared by repeating the procedures of Example 3 except that one of the comparative restrainers, A, B, C and D, having the structural formulas shown below was substituted for the restrainers of the present invention. The materials were exposed and thermally developed as in Example 3 to obtain the results shown in Table 4.

(A)

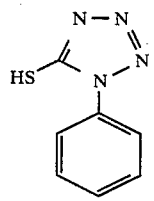

(B)

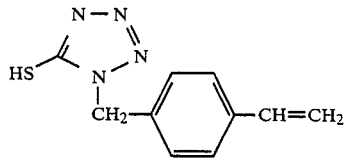

(C)

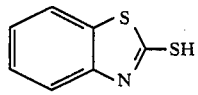

(D)

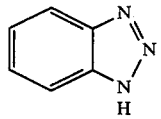

TABLE 4

| Sample No. | Restrainer | Amount added (per mole of silver in total silver compound) | $D_{max}$ | $D_{min}$ |
|---|---|---|---|---|
| Sample of the invention | | | | |
| B-1 | B-1 | 5 g | 2.51 | 0.08 |
| B-2 | B-1 | 0 g | 2.67 | 0.33 |
| B-3 | B-1 | 2 g | 2.61 | 0.10 |

TABLE 4-continued

| Sample No. | Restrainer | Amount added (per mole of silver in total silver compound) | $D_{max}$ | $D_{min}$ |
|---|---|---|---|---|
| B-4 | B-1 | 20 g | 2.49 | 0.08 |
| B-5 | B-4 | 2 g | 2.54 | 0.10 |
| B-6 | B-4 | 5 g | 2.55 | 0.07 |
| B-7 | B-4 | 20 g | 2.52 | 0.07 |
| B-8 | B-14 | 2 g | 2.55 | 0.12 |
| B-9 | B-14 | 5 g | 2.53 | 0.10 |
| B-10 | B-14 | 20 g | 2.49 | 0.09 |
| B-11 | B-18 | 2 g | 2.59 | 0.16 |
| B-12 | B-18 | 5 g | 2.48 | 0.12 |
| B-13 | B-18 | 20 g | 2.34 | 0.09 |
| Comparative Samples | | | | |
| B-14 | (A) | 2 g | 2.60 | 0.31 |
| B-15 | (A) | 5 g | 2.75 | 1.19 |
| B-16 | (A) | 20 g | 2.84 | 1.98 |
| B-17 | (B) | 2 g | 2.57 | 0.33 |
| B-18 | (B) | 5 g | 2.64 | 1.07 |
| B-19 | (B) | 20 g | 2.82 | 1.87 |
| B-20 | (C) | 2 g | 2.58 | 0.35 |
| B-21 | (C) | 5 g | 2.67 | 0.63 |
| B-22 | (C) | 20 g | 2.70 | 1.03 |
| B-23 | (D) | 2 g | 2.55 | 0.30 |
| B-24 | (D) | 5 g | 2.04 | 0.24 |
| B-25 | (D) | 20 g | 1.67 | 0.22 |

The above data shows that the samples of thermally developable light-sensitive material containing restrainers within the scope of the present invention achieved a significant improvement in Dmin compared with the sample containing no restrainer and those containing known restrainers.

EXAMPLE 5

Light-sensitive materials were prepared as in Example 3 except that the dye-providing material cpm-I was replaced by the following compounds, cpm-II and cpm-III. These materials were exposed and thermally developed as in Example 3 to obtain the results shown in Table 5.

cpm-II

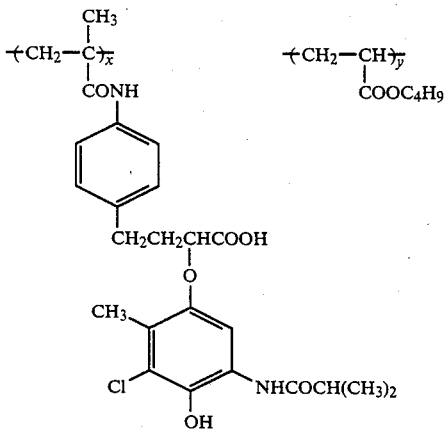

cpm-III

-continued

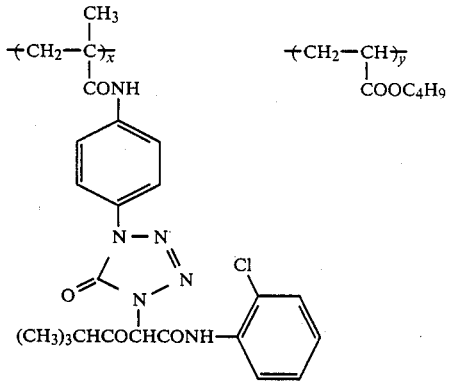

x: 60 Wt %
y: 40 Wt %

TABLE 5

| Dye-providing material | $D_{max}$ | $D_{min}$ |
|---|---|---|
| cpm-II | 2.34 | 0.06 |
| cpm-III | 2.32 | 0.06 |

The above data shows that the restrainers of the present invention are effective for use with various dye-providing materials.

EXAMPLE 6

A light-sensitive material was prepared by successively coating the following layers on a subbed photographic polyethylene terephthalate film 180 μm thick.

(1) first (bottommost) light-sensitive layer: having the same composition as employed in Example 3 except that the the silver halide used in Example 3 was replaced by a green-sensitive silver halide (average size: 0.13 μm) (silver deposit was 2/5 of the value used in Example 3);

(2) intermediate layer I: containing 0.5 g of gelatin, 0.5 g of polyvinylpyrrolidone, 0.4 g of polyethylene glycol, 0.4 g of 3-methylpentane-1,3,5-triol, and a given amount of CD′ scavenger having the formula shown below;

(3) second light-sensitive layer: having the same composition as the first light-sensitive layer except that the silver halide and the dye-providing material were replaced by a red-sensitive silver halide and cpm-II, respectively (silver deposit was ⅓ of the value used in Example 3);

(4) intermediate layer II: the same as intermediate layer I except that it further contained 0.4 g of a yellow filter dye having the formula shown below;

(5) third light-sensitive layer: having the same composition as the second light-sensitive layer except that the silver halide and the dye-providing material were replaced by a blue-sensitive silver halide and cpm-III, respectively; and (6) protective layer: the same as used in Example 3.

CD′ scavenger

-continued

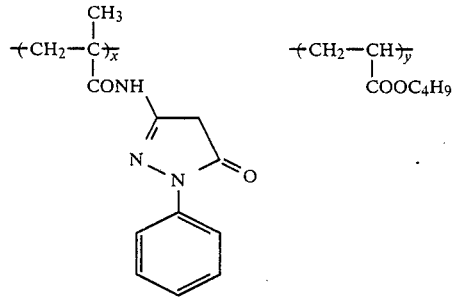

x/y = 3/2 by weight

Y-filter dye

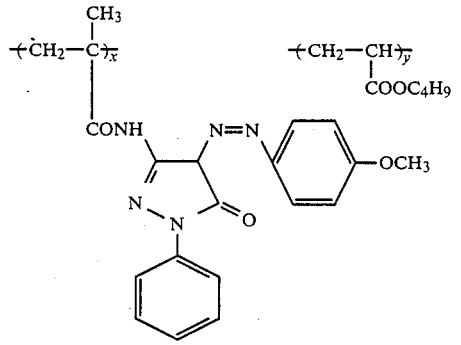

x/y = 1/1 by weight

The so prepared light-sensitive material was exposed to red, green and blue light each having an intensity of 8000 C.M.S., and thermally developed as in Example 3. The transfer densities (Dmax and fog) of the cyan, magenta and yellow dyes attained were measured, with the results being shown in Table 6.

COMPARATIVE EXAMPLE 2

Two additional light-sensitive material were prepared as in Example 6, except that the light-sensitive layers in one material did not contain any restrainer and that each light-sensitive layer in the other material contained the comparative restrainer (A). These materials were exposed and thermally developed as in Example 6. The results are shown in Table 6.

TABLE 6

| Restrainer | | Exposed to red light | Exposed to green light | Exposed to blue light |
|---|---|---|---|---|
| B-1 | $D_{max}$ | 1.61 | 1.52 | 1.85 |
| | $D_{min}$ | 0.07 | 0.08 | 0.08 |
| None | $D_{max}$ | 1.64 | 1.61 | 1.89 |
| | $D_{min}$ | 0.34 | 0.33 | 0.04 |
| A | $D_{max}$ | 1.73 | 1.69 | 1.95 |
| | $D_{min}$ | 1.35 | 1.24 | 1.47 |

The above results show that the restrainer (B-1) of the present invention is highly effective in improving the Dmin of a multi-layered thermally developable light-sensitive material intended for producing color images.

EXAMPLE 7

Light-sensitive materials, B-1 to B-4 and B-15 and B-24, were left for 24 hours in a hot and humid atmosphere (50° C.×80% r.h.), and were thereafter thermally developed as in Example 3. The Dmax, Dmin, and the percentage of desensitization which occurred as a result of standing [(1-sensitivity after standing/sensitivity before standing)×100] were measured, with the results being summarized in Table 7.

TABLE 7

| Sample No. | $D_{max}$ | $D_{min}$ | Desensitization (%) |
|---|---|---|---|
| B-1 | 2.34 | 0.07 | 25% |
| B-2 | 1.89 | 0.36 | 75% |
| B-3 | 2.41 | 0.09 | 25% |
| B-4 | 2.38 | 0.06 | 0% |
| B-15 | 2.52 | 1.71 | — |
| B-24 | 1.59 | 0.20 | 50% |

As is clear from the above data, the thermally developable light-sensitive materials of the present invention containing restrainers of formula (I-B) exhibited better keeping quality after manufacture than the sample containing no such restrainer and the samples containing the comparative restrainers A and D. This is indicated by the relatively small decreases in sensitivity, Dmax and Dmin following standing in a hot and humid atmosphere.

EXAMPLE 8

A light-sensitive material and an image-receiving material (for the compositions of the respective materials, see below) were prepared. An exposure of 8000 C.M.S. was given as in Example 6 from the support side of the light-sensitive material. The exposed material was placed in close contact with the image-receiving material and thermally developed at 150° C. for 1 minute, producing the results shown in Table 8.

Light-sensitive material: (the layer arrangement is shown from top to bottom; the amount of each component indicated is per square meter)

(1) protective layer: gelatin, 0.42 g; $SiO_2$, 0.36 g; safron, 1.0 g (2) red-sensitive layer: methylbenzotriazole silver, 1.6 g; reducing agent (R-11), 0.57 g; cpm-II, 0.8 g; red-sensitive silver halide (see note 1 below), 0.58 g in terms of silver; the hydroquinone compound used in Example 3, 60 mg; gelatin, 0.75 g; phthalated gelatin, 0.75 g; polyvinylpyrrolidone, 0.5 g; 3-methylpentane-1,3,5-triol, 0.38 g; polyethylene glycol, 1.1 g; AIK-XC (see note 3), 80 mg; restrainer (B-1), 0.52 g; hardening agent, 60 mg (3) intermediate layer: gelatin, 0.5 g; the CD' scavenger used in Example 6, 0.4 g; methylbenzotriazole silver, 1.2 g; hardening agent, 20 mg (4) green-sensitive layer: cpm-I, 1.3 g; green-sensitive silver halide (see note 2), 0.76 g in terms of silver; methylbenzotriazole, 2.7 g; reducing agent (R-11), 0.76 g; the hydroquinone compound used in Example 3, 90 mg; gelatin, 1 g; phthalated gelatin, 1 g; polyvinylpyrrolidone, 0.66 g; 3-methylpentane-1,3,5-triol, 0.5 g; polyethylene glycol, 1.5 g; AIK-XC, 0.11 g; restrainer (B-1), 0.68 g; hardening agent, 80 mg (5) intermediate layer: the Y-filter dye used in Example 6, 0.4 g the CD' scavenger used in Example 6, 0.4 g; methylbenzotriazole silver, 1.2 g; gelatin, 0.5 g; hardening agent, 20 mg (6) blue-sensitive layer: cpm-III, 1.4 g; blue-sensitive silver halide, 0.97 g in terms of silver; methylbenzotriazole, 2.7 g; reducing agent, 0.97 g; the hydroquinone compound used in Example 3, 90 mg; gelatin; 1.26 g; phthalated gelatin, 1.26 g; polyvinylpyrrolidone, 0.84 g; 3-methylpentane-1,3,5-triol, 0.63 g; polyethylene glycol, 1.9 g; AIK-XC, 0.14 g; restrainer (B-1), 0.87 g; hardening agent, 0.1 g (7) gelatin layer: gelatin, 2.5 g (8) support: 180 μm polyethylene terephthalate film with a latex subbing layer Image-receiving material (1) image-receiving layer: polycarbonate, 10 g; compound (1) shown below, 0.5 g; compound (2) shown below, 0.5 g (2) support: baryta paper compound (1):

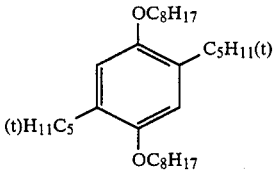

compound (2):

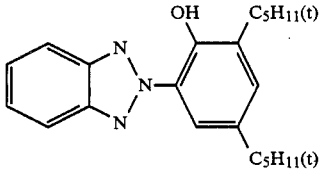

Note 1: sensitizing dye

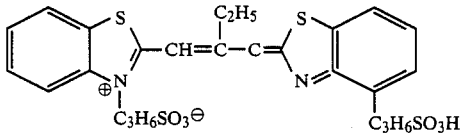

Note 2: sensitizing dye

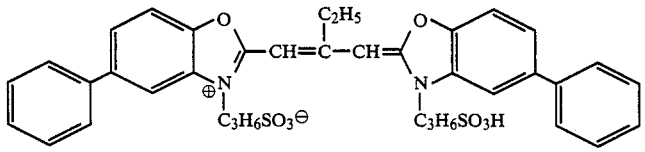

Note 3: AIK-XC

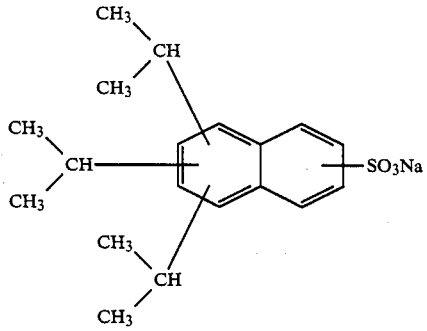

TABLE 8

| | Exposed to red light | Exposed to green light | Exposed to blue light |
|---|---|---|---|
| $D_{max}$ | 1.70 | 1.64 | 1.78 |
| $D_{min}$ | 0.07 | 0.08 | 0.08 |

EXAMPLE 9

Preparation of 5-methylbenzotriazole silver

5-Methylbenzotriazole was reacted with silver nitrate in a mixed solvent of water and ethanol; 28.8 g of the resulting 5-methylbenzotriazole silver and 16 g of poly-N-vinylpyrrolidone (Mw=30,000) were dispersed in 150 ml of water with an aluminum ball mill. After pH adjustment to 5.5, the dispersion was worked up to a volume of 200 ml.

Dispersion of dye-providing material

A dye-providing material, cpm-1 (35.5 g) having the structure shown below, 5.0 g of a hydroquinone compound having the structure shown below and 3.0 g of a polymer of the present invention (p-1) were dissolved in 200 ml of ethyl acetate. The solution was mixed with 124 ml of an aqueous solution of 5 wt% Alkanol XC (Du Pont) and 720 ml of an aqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the dispersion was adjusted pH to 5.5 and worked up to a volume of 800 ml.

Dye-providing material, cpm-1

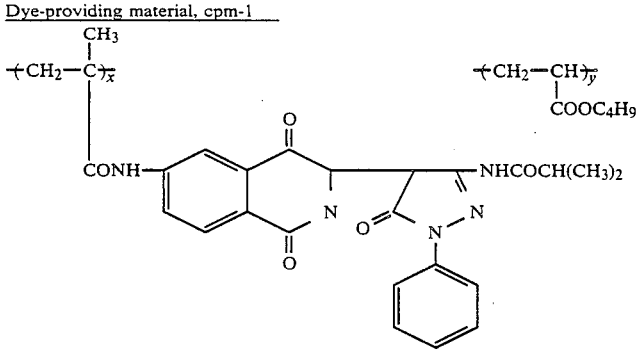

Hydroquinone compound

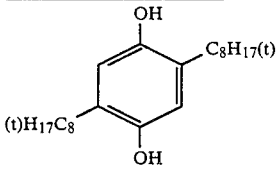

x:y = 2:3 by weight

Developer solution

A reducing agent (R-11) (23.3 g), 1.10 g of a development accelerator having the formula given below, 14.6 g of poly-(N-vinylpyrrolidone) (Mw=30,000) and 0.5 g of a fluorine-based surfactant having the formula shown below were dissolved in water. The solution was adjusted to pH 5.5 and worked up to a volume of 250 ml.

Development accelerator

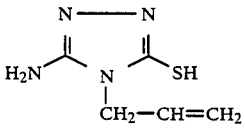

Surfactant

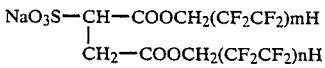

(m, n = 2 or 3)

Preparation of thermally developable light-sensitive material

The dispersion of organic silver salt (12.5 ml), 40.0 ml of the dispersion of dye-providing material (cpm-1), 12.5 ml of the developer solution, 2.0 g of polyethylene glycol, 2.0 g of 3-methylpentane-1,3,5-triol and 6 ml of a silver halide emulsion having an average grain size of 0.13 μm (containing $7.5\times10^{-3}$ moles of silver halide in terms of silver) were mixed. To the mixture was added 2.5 ml of a solution of hardening agent [i.e., a solution prepared by first reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)-methane]. The resulting coating solution was applied to a 180 μm thick subbed photographic polyethylene terephthalate film for a silver deposit of 2.64 g/m². The applied light-sensitive layer was further coated with a protective layer made of a mixture of phenylcarbamoylated gelatin (Type 17819PC of Rousselot Inc.) and poly(N-vinylpyrrolidone) (Mw=30,000), so as to obtain sample No. C-1 of thermally developable light-sensitive material.

The so prepared light-sensitive material was dried and exposed to white light (8,000 C.M.S.) through a step wedge.

In a separate step, an image-receiving layer made of polyvinyl chloride was coated on baryta paper in an amount of 12 g/m². The resulting image-receiving sheet was superposed on the exposed light-sensitive material, with the image-receiving layer side being placed in contact with the coated surface of the latter. The assembly was developed by heating at 150° C. for 1 minute and, thereafter, the light-sensitive material was spripped from the image-receiving sheet now carrying a magenta transfer image. The maximum reflection density (Dmax) of the transfer image and its fog (Dmin) are shown in Table 9.

EXAMPLE 10

Light-sensitive materials, Nos. C-2 to C-16, were prepared by repeating the procedures of Example 9 except that the types and amounts of the polymers of the present invention were changed as shown in Table 9. The materials were exposed and thermally developed as in Example 9 to obtain the results shown in Table 9.

COMPARATIVE EXAMPLE 3

Comparative light-sensitive materials, Nos. C-17 to C-28, were prepared by repeating the procedures of Example 9 except that one of the comparative restrainers, A, B, C and D, having the structural formulas shown below was substituted for the polymers of the present invention. The materials were exposed and thermally developed as in Example 9 to obtain the results shown in Table 9.

(A)

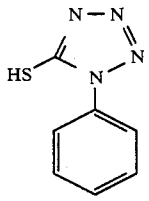

(B)

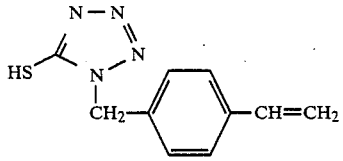

(C)

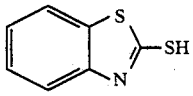

(D)

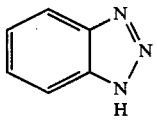

TABLE 9

| Sample No. | Restrainer | Amount added (per mole of silver in total silver compound) | $D_{max}$ | $D_{min}$ |
|---|---|---|---|---|
| Sample of the invention | | | | |
| C-1 | P-1 | 10 g | 2.47 | 0.06 |
| C-2 | P-1 | 0 g | 2.61 | 0.33 |
| C-3 | P-1 | 2.5 g | 2.54 | 0.09 |
| C-4 | P-1 | 40 g | 2.23 | 0.04 |
| C-5 | P-3 | 0.5 g | 2.51 | 0.08 |
| C-6 | P-3 | 2 g | 2.39 | 0.06 |
| C-7 | P-3 | 10 g | 2.20 | 0.05 |
| C-8 | P-7 | 2.5 g | 2.51 | 0.11 |
| C-9 | P-7 | 10 g | 2.44 | 0.07 |
| C-10 | P-7 | 40 g | 2.27 | 0.05 |
| C-11 | P-14 | 2.5 g | 2.43 | 0.12 |
| C-12 | P-14 | 10 g | 2.39 | 0.10 |
| C-13 | P-14 | 40 g | 2.30 | 0.09 |
| C-14 | P-17 | 2.5 g | 2.55 | 0.20 |
| C-15 | P-17 | 10 g | 2.41 | 0.13 |
| C-16 | P-17 | 40 g | 2.29 | 0.12 |
| Comparative Samples | | | | |
| C-17 | (A) | 2.5 g | 2.60 | 0.32 |
| C-18 | (A) | 10 g | 2.78 | 1.48 |
| C-19 | (A) | 40 g | 2.87 | 2.11 |
| C-20 | (B) | 2.5 g | 2.59 | 0.34 |
| C-21 | (B) | 10 g | 2.67 | 1.27 |
| C-22 | (B) | 90 g | 2.85 | 1.90 |
| C-23 | (C) | 2.5 g | 2.60 | 0.37 |
| C-24 | (C) | 10 g | 2.69 | 0.67 |
| C-25 | (C) | 40 g | 2.72 | 1.11 |
| C-26 | (D) | 2.5 g | 2.59 | 0.30 |
| C-27 | (D) | 10 g | 1.98 | 0.23 |
| C-28 | (D) | 40 g | 1.54 | 0.20 |

The above shows that the samples of thermally developable light-sensitive material containing polymers within the scope of the present invention achieved a significant improvement in Dmin compared with the sample containing no restrainer and those containing known restrainers.

EXAMPLE 11

Light-sensitive materials were prepared as in Example 9 except that the dye-providing material cpm-I was replaced by the following compounds, cpm-II and cpm-III. These materials were exposed and thermally developed as in Example 9 to obtain the results shown in Table 10.

cpm-II

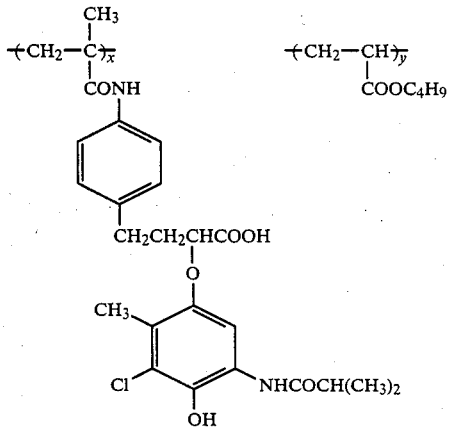

cpm-III

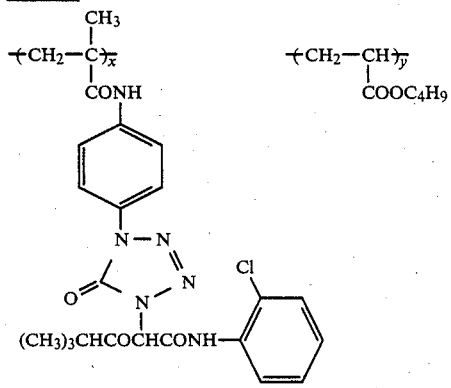

x: 60 Wt %
y: 40 Wt %

TABLE 10

| Dye-providing material | $D_{max}$ | $D_{min}$ |
|---|---|---|
| cpm-II | 2.31 | 0.04 |
| cpm-III | 2.29 | 0.04 |

The above data shows that the polymers of the present invention are effective for use with various dye-providing materials.

EXAMPLE 12

A light-sensitive material was prepared by successively coating the following layers on a subbed photographic polyethylene terephthalate film 180 μm thick.

(1) first (bottommost) light-sensitive layer: having the same composition as employed in Example 9 except that the silver halide used in Example 9 was replaced by a green-sensitive silver halide (average grain size: 0.13 μm) silver deposit was 2/5 of the value used in Example 9);

(2) intermediate layer I: containing 0.8 g of gelatin, 0.8 g of polyvinylpyrrolidone, 0.4 g of polyethylene glycol, 0.4 g of 3-methylpentane-1,3,5-triol, and 0.4 g of CD' scavenger having the formula shown below;

(3) second light-sensitive layer: having the same composition as the first light-sensitive layer except that the silver halide and the dye-providing material were replaced by a red-sensitive silver halide and cpm-II, respectively (silver deposit was ⅓ of the value used in Example 9);

(4) intermediate layer II: the same as intermediate layer I except that it further contained 0.4 g of a yellow filter dye having the formula shown below;

(5) third light-sensitive layer: having the same composition as the second light-sensitive layer except that the silver halide and the dye-providing material were replaced by a blue-sensitive silver halide and cpm-III, respectively; and (6) protective layer: the same as used in Example 9.

CD' scavenger

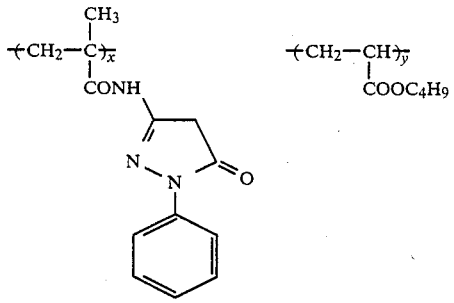

x/y = 3/2 by weight

Y-filter dye

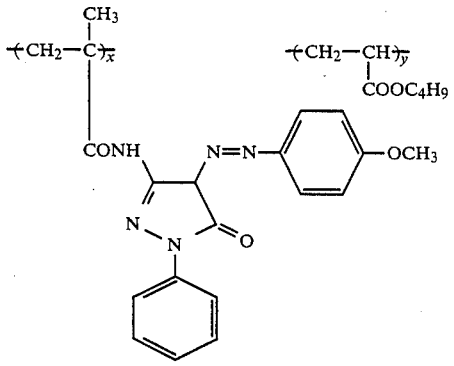

x/y = 1/1 by weight

The so prepared light-sensitive material was exposed to red, green and blue light each having an intensity of 8000 C.M.S., and thermally developed as in Example 9. The transfer densities (Dmax and fog) of the cyan, magenta and yellow dyes attained were measured, with the results being shown in Table 11.

COMPARATIVE EXAMPLE 4

Two additional light-sensitive materials were prepared as in Example 12, except that the light-sensitive layers in one material did not contain any restrainer and that each light-sensitive layer in the other material contained the comparative restrainer (A). These materials were exposed and thermally developed as in Example 12. The results are shown in Table 11.

TABLE 11

| Restrainer | | Exposed to red light | Exposed to green light | Exposed to blue light |
|---|---|---|---|---|
| P-1 | $D_{max}$ | 1.58 | 1.49 | 1.77 |
| | $D_{min}$ | 0.05 | 0.06 | 0.05 |
| None | $D_{max}$ | 1.64 | 1.61 | 1.89 |
| | $D_{min}$ | 0.34 | 0.33 | 0.40 |
| A | $D_{max}$ | 1.73 | 1.69 | 1.95 |
| | $D_{min}$ | 1.35 | 1.24 | 1.47 |

The above results show that the polymer (P-1) of the present invention is highly effective in improving the Dmin of a multi-layered thermally developable light-sensitive material intended for producing color images.

EXAMPLE 13

Light-sensitive materials, C-1 to B-4 and B-17 and B-26, were left for 24 hours in a hot and humid atmosphere (50° C.×80% r.h.), and were thereafter thermally developed as in Example 9. The Dmax, Dmin, and the percentage of desensitization which occurred as a result of standing [1-sensitivity after standing/sensitivity before standing)×100] were measured, with the results being summarized in Table 12.

TABLE 12

| Sample No. | $D_{max}$ | $D_{min}$ | Desensitization (%) |
|---|---|---|---|
| C-1 | 2.33 | 0.05 | 25 |
| C-2 | 1.89 | 0.36 | 75 |
| C-3 | 2.37 | 0.07 | 25 |
| C-4 | 2.19 | 0.04 | 0 |
| C-17 | 2.55 | 1.94 | — |
| C-26 | 1.69 | 0.13 | 50 |

As is clear from the above data, the thermally developable light-sensitive materials of the present invention containing polymers derived from monomers of formula (I-C) exhibited better keeping quality after manufacture than the sample containing no such polymer and the samples containing the comparative restrainers A and D. This is indicated by the relatively small decreases in sensitivity, Dmax and Dmin following standing in a hot and humid atmosphere.

EXAMPLE 14

A light-sensitive material and an image-receiving material (for the compositions of the respective materials, see below) were prepared. An exposure of 8000 C.M.S. was given as in Example 12 from the support side of the light-sensitive material. The exposed material was placed in close contact with the image-receiving material and thermally developed at 150° C. for 1 minute, producing the results shown in Table 13.

Light-sensitive material: (the layer arrangement is shown from top to bottom; the amount of each component indicated is per square meter)

(1) protective layer: gelatin, 0.42 g; $SiO_2$, 0.36 g; safron, 1.0 g (2) red-sensitive layer: methylbenzotriazole silver, 1.6 g; reducing agent (R-11), 0.57 g; cpm-II, 0.8 g; red-sensitive silver halide (see note 1 below), 0.58 g in terms of silver; the hydroquinone compound used in Example 9, 60 mg; gelatin, 0.75 g; phthalated gelatin, 0.75 g; polyvinylpyrrolidone, 0.5 g; 3-methylpentane-1,3,5-triol, 0.38 g; polyethylene glycol, 1.1 g; AIK-XC (see note 3), 80 mg; polymer (P-1), 0.52 g; hardening agent, 60 mg (3) intermediate layer: gelatin, 0.5 g; the CD' scavenger used in Example 12, 0.4 g; methylbenzotriazole silver, 1.2 g; hardening agent, 20 mg (4) green-sensitive layer: cpm-I, 1.3 g; green-sensitive silver halide (see note 2), 0.76 g in terms of silver; methylbenzotriazole, 2.7 g; reducing agent (R-11), 0.76 g; the hydroquinone compound used in Example 9, 90 mg; gelatin, 1 g; phthalated gelatin, 1 g; polyvinylpyrrolidone, 0.66 g; 3-methylpentane-1,3,5-triol, 0.5 g; polyethylene glycol, 1.5 g; AIK-XC, 0.11 g; polymer (P-1), 0.68 g; hardening agent, 80 mg Light-sensitive material: (the layer arrangement is shown from top to bottom; the amount of each component indicated is per square meter)

(1) Protective layer: gelatin, 0.42 g; $SiO_2$, 0.36 g; safron, 1.0 g (2) red-sensitive layer: methylbenzotriazole silver, 1.6 g; reducing agent (R-11), 0.57 g; cpm-II, 0.8 g; red-sensitive silver halide (see note 1 below), 0.58 g in terms of silver; the hydroquinone compound used in Example 9, 60 mg; gelatin, 0.75 g; phthalated gelatin, 0.75 g; polyvinylpyrrolidone, 0.5 g; 3-methylpentane-1,3,5-triol, 0.38 g; polyethylene glycol, 1.1 g; AIK-XC (see note 3), 80 mg; polymer (P-1), 0.52 g; hardening agent, 60 mg (3) intermediate layer: gelatin, 0.5 g; the CD' scavenger used in Example 12, 0.4 g; methylbenzotriazole silver, 1.2 g; hardening agent, 20 mg (4) green-sensitive layer: cpm-I, 1.3 g; green-sensitive silver halide (see note 2), 0.76 g in terms of silver; methylbenzotriazole, 2.7 g; reducing agent (R-11), 0.76 g; the hydroquinone compound used in Example 9, 90 mg; gelatin, 1 g; phthalated gelatin, 1 g; polyvinylpyrrolidone, 0.66 g; 3-methylpentane-1,3,5-triol, 0.5 g; polyethylene glycol, 1.5 g; AIK-XC, 0.11 g; polymer (P-1), 0.68 g; hardending agent, 80 mg (5) intermediate layer: the Y-filter dye used in Example 12, 0.4 g the CD' scavenger used in Example 12, 0.4 g; methylbenzotriazole silver, 1.2 g; gelatin, 0.5 g; hardening agent, 20 mg (6) blue-sensitive layer: cpm-III, 1.4 g; blue-sensitive silver halide, 0.97 g in terms of silver; methylbenzotriazole, 2.7 g; reducing agent, 0.97 g; the hydroquinone compound used in Example 9, 90 mg; gelatin, 1.26 g; phthalated gelatin, 1.26 g; polyvinylpyrrolidone, 0.84 g; 3-methylpentane-1,3,5-triol, 0.63 g; polyethylene glycol, 1.9 g; AIK-XC, 0.14 g; polymer (P-1), 0.87 g; hardening agent, 0.1 g (7) gelatin layer: gelatin, 2.5 g (8) support: 180 μm polyethylene terephthalate film with a latex subbing layer

| Image-receiving | Material | |
|---|---|---|
| (1) image-receiving layer: | polycarbonate, 10 g; shown below, 0.5 g, shown below, 0.5 g | compound (1) compound (2) |
| (2) support: baryta paper | | |

compound (1):

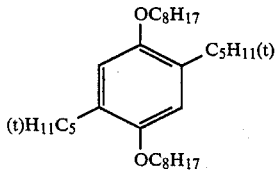

compound (2):

-continued

| Image-receiving | Material |
|---|---|

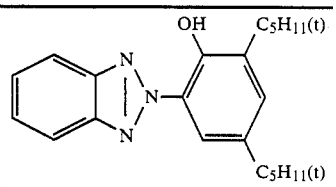

Note 1: sensitizing dye

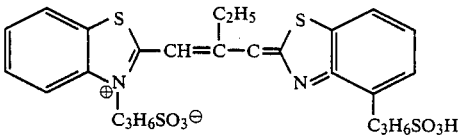

Note 2: sensitizing dye

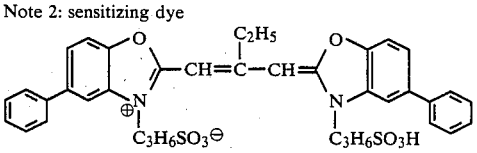

Note 3: AIK-XC

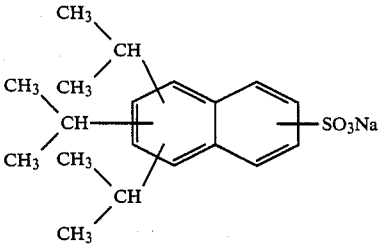

TABLE 13

| | Exposed to red light | Exposed, to green light | Exposed to blue light |
|---|---|---|---|
| Dmax | 1.72 | 1.69 | 1.62 |
| Dmin | 0.05 | 0.06 | 0.04 |

EXAMPLE 15

Preparation of Silver Bromide Emulsion

Comparative silver bromide emulsion A was prepared by the following procedures. To solution A having 20 g of ossein gelatin and ammonia dissolved in 1000 ml of distilled water and which was held at 50° C., solution B containing 1.1 mole of potassium bromide in 500 ml of water and solution C containing 1 mole of silver nitrate and ammonia in 500 ml of water were added simultaneously at a controlled pAg in a mixer-/agitator of the type shown in Japanese patent application Nos. (OPI) 92523/1982 and 92524/1982. The shape and size of the emulsion grains being formed were adjusted by controlling the pH, pAg and the rates of addition of solutions B and C. As a result, silver bromide emulsion was attained. The silver halide grains in the emulsion were octahedral in shape with an average size of 0.3 μm and 8% monodispersity. This emulsion was washed with water and desalted. The yield of the emulsion was 800 ml.

Preparation of Silver Iodobromide Emulsions

Two emulsions, B and C, comprising light-sensitive silver halides with different silver iodide contents were prepared by the following procedures. As in the preparation of emulsion A, solution A was first prepared by dissolving 20 g of ossein gelatin and ammonia in 1000 ml of distilled water. To solution A held at 50° C., 500 ml of solution B which was an aqueous solution containing predetermined amounts of potassium iodide and potassium bromide (6.64 g and 130.9 g, respectively, for emulsion B, and 11.62 g and 130.9 g for emulsion C), and 500 ml of solution C which was an aqueous solution containing 1 mole of silver nitrate and ammonia were added simultaneously at a controlled pAg in a mixer-/agitator of the type shown in Japanese patent application Nos. 92523/1982 and 92524/1982. The shape and size of the emulsion grains being formed were adjusted by controlling the pH, pAg and the rates of addition of solutions B and C. As a result, silver iodobromide emulsions were B and C obtained. They had octahedral grains with 9% monodispersity. The only difference between the two emulsions was about the content of silver iodide. Both emulsions were washed with water and desalted. The yield of each emulsion was 800 ml.

Preparation of Core/Shell Type Silver Iodobromide Emulsions

Two core/shell type emulsions, D and E, having different silver iodide contents and grain sizes were prepared by the following procedures. To solution A having 20 g of ossein gelatin and ammonia dissolved in 1000 ml of distilled water and which was held at 50° C., 500 ml of solution B which was an aqueous solution containing predetermined amounts of potassium iodide and potassium bromide (11.62 g and 130.9 g, respectively, for emulsion D; and 33.2 g and 119.0 g for emulsion E), and 500 ml of solution C which was an aqueous solution containing 1 mole of silver nitrate and ammonia were added simultaneously at a controlled pAg in a mixer/agitator of the type shown in Japanese Patent Application (OPI) Nos. 92523/1982 and 92524/1982. The shape and size of the core emulsion grains being formed were adjusted by controlling the pH, pAg and the rates of addition of solutions B and C. As a result, two core emulsions comprising octahedral grains with 8% monodispersity were obtained. The only differences were about the grain size and the content of silver iodide.

By repeating the same procedures except that the concentrations of potassium iodide and potassium bromide in solution B were 4.15 g and 0 g, respectively, for emulsion D, and 6.64 g and 130.9 g for emulsion E, a silver halide shell was coated on each of the so prepared core silver halide grains. As a result, two core/shell emulsions, D and E, were prepared; they comprised grains which were of the same octahedral shape but which had different average sizes and silver iodide contents.

These emulsions were washed with water and desalted. The yield of each emulsion was 800 ml. The characteristics of the five emulsions, A to E, are summarized in Table 14.

TABLE 14

| Emulsion | AgI content (mol %) Core | Shell | Shell thickness (μm) | Average grain size (μm) |
|---|---|---|---|---|
| A | 0 | | — | 0.3 |
| B | 4 | | — | 0.3 |
| C | 7 | | — | 0.3 |
| D | 7 | 2.5 | 0.84 | 0.3 |
| E | 20 | 4 | 0.85 | 0.4 |

Preparation of organic silver salt dispersion (1):

5-Methylbenzotriazole was reacted with silver nitrate in a mixed solvent of water and alcohol; 28.8 g of the resulting 5-methylbenzotriazole silver, 16.0 g of poly-(N-vinylpyrrolidone) and 1.33 g of sodium 4-sulfobenzotriazole were dispersed in water with an alumina ball mill and thereafter adjusted to pH 5.5 to prepare a dispersion (1) of organic silver salt in a yield of 200 ml.

Preparation of light-sensitive silver halide dispersion:

Each of the four silver halide emulsions, A, B, D and E, was subjected to sulfur sensitization with sodium thiosulfate in the presence of a sensitizing dye (1) having the structure shown below and 4-hydroxy-6-methyl-1,3,3a,7-tetrazaindene, so as to prepare a dispersion of light-sensitive silver halide having the following formulation:

silver halide (in terms of silver): 381 g
gelatin: 85 g/2820 ml

Sensitizing dye (1):

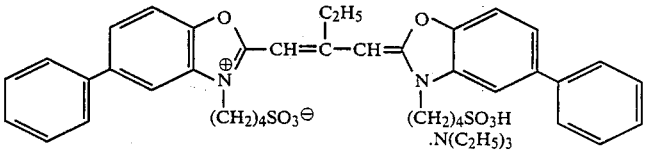

Preparation of dispersion (1) of dye-providing material:

A dye-providing material (35.5 g) identified by No. ⑦ in the list of illustrative compounds and one of the hydroxybenzene derivatives shown in Table 15 were dissolved in 200 ml of ethyl acetate. The solution was mixed with 124 ml of an aqueous solution of 5 wt% Alkanol XC (Du Pont) and 720 ml of anaqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the pH of the dispersion was adjusted to 5.5 and its volume adjusted to 795 ml to make dispersion (1) of the dye-providing material.

Preparation of dispersion (1) of reducing agent:

A reducing agent (23.3 g) identified by (R-11), 1.10 g of a development accelerator having the formula given below, 14.6 g of poly(N-vinylpyrrolidone) and 0.50 g of a fluorine-based surfactant having the formula shown below were dissolved in water. The pH of the solution was adjusted to 5.5 and its volume in 250 ml to make a dispersion (1) of the developer.

Development accelerator:

-continued

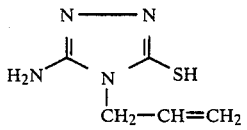

Surfactant:

$NaO_3S-CH(CH_2-COOCH_2(CF_2CF_2)nH)-COOCH_2(CF_2CF_2)mH$ (m, n = 2 or 3)

Preparation of thermally developable light-sensitive material (1):

Six milliliters of one of the four light-sensitive silver halide dispersions, A, B, D and E, was mixed with 12.5 ml of the dispersion (1) of organic silver salt, 39.8 ml of the dispersion (1) of dye-providing material 7, 12.5 ml of the dispersion (1) of reducing agent, and a predetermined amount of one of the restrainers listed in Table 15 below. To the resulting mixture, 2.50 ml of a hardening agent [i.e., a solution of hardening agent prepared by reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)methane] and 3.80 g of a hot solvent (polyethylene glycol 300 to Kanto Chemical Co., Inc.) were added. The resulting coating solution was applied to a 180 μm thick subbed photographic polyethylene terephthalate film for a silver deposit of 1.76 g/m². The applied light-sensitive layer was further coated with a protective layer made of a mixture of phenylcarbamoylated gelatin (Type 17819PC of Rousselot Inc.) and poly(N-vinylpyrrolidone).

Preparation of image-receiving member (1):

An image-receiving member (1) was prepared by coating a tetrahydrofuran solution of polyvinyl chloride (n=1,100; product of Wako Pure Chemical Industries, Ltd.) on photographic baryta paper to attain a polyvinyl chloride deposit of 12 g/m².

Each of the thermally developable light-sensitive materials previously prepared was given an exposure of 1,600 C.M.S. through a step wedge, superposed on the image-receiving member, and thermally developed at 150° C. for 1 minute in a thermal developer (Developer Module 277 of 3M). Immediately thereafter, the light-sensitive material was stripped away from the image-receiving member, which carried a negative image of magenta color.

The green reflection densities of the negative images attained from the samples were measured with a densitometer (PDA-65 of Konishiroku Photo Industry Co., Ltd.). The respective values of maximum density and minimum density (fog) attained for each sample are shown in Table 15.

TABLE 15

| Sample No. | Emulsion | Hydroxybenzene derivative | Amount added (mol/mol Ag) | Restrainer | Amount added (mol/mol Ag | $D_{min}$ | $D_{max}$ |
|---|---|---|---|---|---|---|---|
| D-1 (Comparative sample) | A | — | — | — | — | 0.22 | 1.94 |
| D-2 (Comparative sample) | B | — | — | — | — | 0.39 | 1.92 |
| D-3 (Comparative sample) | D | — | — | — | — | 0.27 | 1.97 |
| D-4 (Comparative sample) | E | — | — | — | — | 0.28 | 1.93 |
| D-5 (Sample of the invention) | D | — | — | A-20 | $3 \times 10^{-4}$ | 0.21 | 1.94 |
| D-6 (Comparative sample) | D | III-4 | $3 \times 10^{-2}$ | — | — | 0.21 | 1.95 |
| D-7 (Comparative sample) | D | III-4 | " | (A) | $3 \times 10^{-4}$ | 0.40 | 2.03 |
| D-8 (Sample of the invention) | D | III-4 | " | A-4 | " | 0.15 | 1.93 |
| D-9 (Sample of the invention) | D | III-4 | " | A-19 | " | 0.15 | 1.94 |
| D-10 (Sample of the invention) | A | III-4 | " | A-20 | " | 0.13 | 1.92 |
| D-11 (Sample of the invention) | B | III-4 | " | " | " | 0.16 | 1.89 |
| D-12 (Sample of the invention) | D | III-4 | " | " | " | 0.14 | 1.94 |
| D-13 (Sample of the invention) | D | III-4 | " | " | $1 \times 10^{-3}$ | 0.12 | 1.92 |
| D-14 (Sample of | E | III-4 | " | " | $3 \times 10^{-4}$ | 0.13 | 1.93 |

TABLE 15-continued

| Sample No. | Emulsion | Hydroxy-benzene deriva-tive | Amount added (mol/mol Ag) | Re-strainer | Amount added (mol/mol Ag | $D_{min}$ | $D_{max}$ |
|---|---|---|---|---|---|---|---|
| the invention) | | | | | | | |
| D-15 (Sample of the invention) | D | III-5 | " | " | " | 0.12 | 1.96 |
| D-16 (Sample of the invention) | D | III-13 | " | " | " | 0.13 | 1.93 |
| D-17 (Sample of the invention) | D | III-4 | " | A-33 | " | 0.14 | 1.92 |
| D-18 (Sample of the invention) | D | IV-2 | " | A-20 | " | 0.12 | 1.95 |
| D-19 (Sample of the invention) | D | IV-7 | " | A-20 | " | 0.13 | 1.94 |

The comparative restrainer (A) mentioned in Table 15 had the following structural formula:

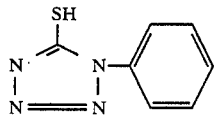

As one can see from Table 15, sample Nos. D-8 to D-19 prepared in accordance with the present invention wherein hydroxybenzene derivatives within the scope of the invention were used in combination with restrainers of the general formula (I-D) or (I-E) displayed much better characteristics than sample Nos. D-1 to D-7 employing no such combination in that those samples of the present invention were capable of reducing the minimum density (thermal fog) without causing any substantial drop in maximum density.

EXAMPLE 16

Emulsions A, C and D prepared in Example 15 were subjected to sulfur sensitization with sodium thiosulfate in the presence of a sensitizing dye (2) having the structure shown below and 4-hydroxy-6-methyl-1,3,3a,7-tetrazaindene, so as to prepare three dispersions of light-sensitive silver halide having the following formulation:

silver halide (in terms of silver): 381 g
gelatin: 85 g/2820 ml

Sensitizing dye (2):

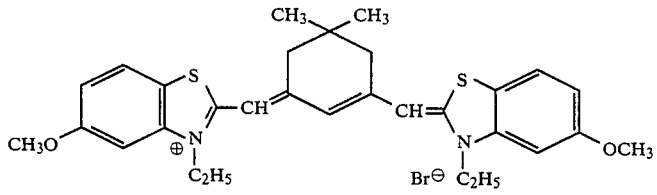

Preparation of dispersion (2) of dye-providing material:

Thirty grams of a dye-providing material ③ as used in Example 2 and one of the hydroxybenzene derivatives shown in Table 16 were dissolved in 30.0 g of tricresyl phosphate and 90.0 ml of ethyl acetate. The solution was mixed with 460 ml of an aqueous gelatin solution containing the same surfactant as used in Example 15; the mixture was dispersed with an ultrasonic homogenizer and the ethyl acetate was distilled off. By addition of water to make a total volume of 500 ml, dispersion (2) of the dye providing material was produced. Preparation of thermally developable light-sensitive material (2):

Forty milliliters of one of the three previously prepared dispersion of light-sensitive silver halide was mixed with 25.0 ml of the dispersion (1) of organic silver salt prepared in Example 15, 50.0 ml of the dispersion (2) of dye-providing material ③, and one of the restrainers shown in Table 16. To the resulting mixture were added 4.20 g of a hot solvent (polyethylene glycol 300 of Kanto Chemical Co., Inc.), 1.5 ml of a methanol solution of 10 wt% 1-phenyl-4,4-dimethyl-3-pyrazolidone, 3.00 ml of the same solution of hardening agent as used in Example 15, and 20.0 ml of a solution of 10 wt% guanidinetrichloroacetic acid in a mixture of water and alcohol. The resulting coating solution was applied to a 180 μm thick subbed photographic polyethylene terephthalate film for a silver deposit of 2.50 g/m$^2$.

Preparation of image-receiving member (2):

An image-receiving member was prepared by successively coating the following layers on a 100 μm thick transparent polyethylene terephthalate film:

(1) polyacrylic acid layer (7.00 g/m$^2$);
(2) acetylcellulose layer (4.00 g/m$^2$); and
(3) layer made of a 1:1 copolymer of styrene and N-benzyl-N,N-dimethyl-N-(3-maleimidopropyl)ammonium chloride and gelatin (copolymer, 3.00 g/m$^2$; gelatin, 3.00 g/m$^2$).

Each of the samples of thermally developable light-sensitive material (2) was given an exposure of 1,600 C.M.S. through a step wedge, heated on a heat block for 1 minute at 150° C., superimposed on the image-receiving member (2) while it was submerged in water, and the two members were compressed together at 500°–800 g/cm$^2$ for 30 seconds at 50° C. Immediately thereafter, the two members were stripped apart from each other. The transmission density of the yellow transparent image formed on the surface of the image-receiving element was measured with a densitometer (PDA-65 of Konishiroku Photo Industry Co., Ltd.). The respective values of maximum density and minimum density (fog) attained for each sample are shown in Table 16.

The comparative restrainer (A) mentioned in Table 16 was the same as employed in Example 15.

TABLE 16

| Sample No. | Emulsion | Hydroxybenzene derivative | Amount added (mol/mol/Ag) | Restrainer | Amount added (mol/mol/Ag) | $D_{min}$ | $D_{max}$ |
|---|---|---|---|---|---|---|---|
| D-20 (Comparative sample) | A | — | — | — | — | 0.26 | 1.90 |
| D-21 (Comparative sample) | C | — | — | — | — | 0.44 | 1.89 |
| D-22 (Comparative sample) | D | — | — | — | — | 0.29 | 1.94 |
| D-23 (Sample of the invention) | C | — | — | A-20 | $3 \times 10^{-4}$ | 0.24 | 1.89 |
| D-24 (Comparative sample) | C | III-4 | $3 \times 10^{-2}$ | — | — | 0.27 | 1.87 |
| D-25 (Comparative sample) | C | III-4 | " | (A) | $3 \times 10^{-4}$ | 0.68 | 1.96 |
| D-26 (Sample of the invention) | C | III-4 | " | A-5 | " | 0.17 | 1.86 |
| D-27 (Sample of the invention) | A | III-4 | " | A-20 | " | 0.12 | 1.85 |
| D-28 (Sample of the invention) | C | III-4 | " | " | " | 0.16 | 1.85 |
| D-29 (Sample of the invention) | C | III-4 | " | " | $3 \times 10^{-3}$ | 0.13 | 1.84 |
| D-30 (Sample of the invention) | D | III-4 | " | " | $3 \times 10^{-4}$ | 0.11 | 1.88 |
| D-31 (Sample of the invention) | C | III-11 | " | A-33 | " | 0.17 | 1.85 |
| D-32 (Sample of the invention) | C | III-5 | " | A-20 | " | 0.15 | 1.86 |
| D-33 (Sample of the invention) | C | III-6 | " | " | " | 0.16 | 1.85 |
| D-34 (Sample of the invention) | C | II-2 | " | " | " | 0.15 | 1.84 |
| D-35 (Sample of the invention) | C | II-2 | $6 \times 10^{-2}$ | " | " | 0.12 | 1.83 |

As one can see from Table 16, combinations of the restrainers and hydroxybenzene derivatives both of which are within the scope of the present invention attained the same results as in Example 15 even when they were used with the dye-providing material 3 which, when heated, would react with a light-sensitive silver halide to release a hydrophilic dye. Sample Nos. D-26 to D-35 wherein hydroxybenzene derivatives within the scope of the present invention were used in combination with restrainers of the general formula (I-D) or (I-E) displayed much better characteristics than sample Nos. D-20 to D-25 employing no such combination in that those samples of the present invention were capable of reducing the minimum density (thermal fog) without causing any substantial drop in maximum density.

EXAMPLE 17

Preparation of Silver Bromide Emulsion:

Silver bromide emulsion A was prepared by the following procedures. To solution A having 20 g of ossein gelatin and ammonia dissolved in 1000 ml of distilled water and which was held at 50° C., solution B containing 1.1 mole of potassium bromide in 500 ml of water and solution C containing 1 mole of silver nitrate and ammonia in 500 ml of water were added simultaneously at a controlled pAg in a mixter/agitator of the type shown in Japanese Patent Application Nos. (OPI) 92523/1982 and 92524/1982. The shape and size of the emulsion grains being formed were adjusted by controlling the pH, pAg and the rates of addition of solutions B and C. As a result, a silver bromide emulsion was attained. The silver halide grains in the emulsion were octahedral in shape with an average size of 0.3 μm and 8% monodispersity. This emulsion was washed with water and desalted. The yield of the emulsion was 800 ml.

Preparation of Silver Iodobromide Emulsion:

Three emulsions, B, C and D comprising light-sensitive silver halides with different silver iodide contents were prepared by the following procedures. As in the preparation of emulsion A, solution A was first prepared by dissolving 20 g of ossein gelatin and ammonia in 1000 ml of distilled water. To solution A held at 50° C., 500 ml of solution B which was an aqueous solution containing predetermined amounts of potassium iodide and potassium bromide (4.98 g and 131 g, respectively, for emulsion B: 6.64 g of potassium iodide and 131 g of potassium bromide for emulsion C; and 11.62 g and 131 g for emulsion D), and 500 ml of solution C which was an aqueous solution containing 1 mole of silver nitrate and ammonia were added simultaneously at a controlled pAg in a mixer/agitator of the type shown in Japanese Patent Application (OPI) Nos. 92523/1982 and 92524/1982. The shape and size of the emulsion grains being formed were adjusted by controlling the pH, pAg and the rates of addition of solutions B and C. As a result, silver iodobromide emulsions were B, C and D obtained. They had octahedral grains with 9% monidispersity. The only difference between the two emulsions was about the content of silver iodide. These emulsions were washed with water and desalted. The yield of each emulsion was 800 ml.

The so prepared comparative silver halide emulsions, A to D, had the following characteristics.

| Emulsion | Average grain size (μm) | AgI content (mol %) |
|---|---|---|
| A | 0.3 | 0 |
| B | 0.3 | 3 |
| C | 0.3 | 4 |
| D | 0.3 | 7 |

Preparation of Core/Shell Type Silver Iodobromide Emulsions:

Three core/shell type emulsions, E, F and G, having different silver iodide contents and grain sizes were prepared by the following procedures. To solution A having 20 g of ossein gelatin and ammonia dissolved in 1000 ml of distill d water and which was held at 50° C., 500 ml of solution B which has an aqueous solution containing predetermined amounts of potassium iodide and potassium bromide (11.62 g and 131 g, respectively, for emulsion E; 11.62 g of potassium iodide and 131 g of potassium bromide for emulsion F; and 33.2 g and 119 g for emulsion G), and 500 ml of solution C which was an aqueous solution containing 1 mole of silver nitrate and ammonia were added simultaneously at a controlled pAg in a mixer/agitator of the type shown in Japanese Patent Application (OPI) Nos. 92523/1982 and 92524/1982. The shape and size of the core emulsion grains being formed were adjusted by controlling the pH, pAg and the rates of addition of solutions B and C. As a result, three core emulsions comprising octahedral grains with 8% monodispersity were obtained. The only differences were about the average grain size and the content of silver iodide.

By repeating the same procedures except that the concentrations of potassium iodide and potassium bromide in shell-forming solution B were 3.32 g and 131 g, respectively, for each emulsion, a silver halide shell was coated on each of the so prepared core silver halide grains. As a result, three core/shell emulsions, E, F and G, were prepared; they comprised grains which were of the same octahedral shape but which had different average sizes and silver iodide contents.

These emulsions were washed with water and desalted. The yield of each emulsion was 800 ml. The characteristics of the so prepared emulsions, E to G, are summarized in Table 17.

TABLE 17

| Emulsion | AgI content in core (mol %) | Shell thickness (μm) | AgI content in shell (mol %) | Average grain size (μm) |
|---|---|---|---|---|
| E | 7 | 0.04 | 2 | 0.3 |
| F | 7 | 0.05 | 2 | 0.5 |
| G | 20 | 0.04 | 2 | 0.3 |

Preparation of organic silver salt dispersion (1):

5-Methylbenzotriazole was reacted with silver nitrate in a mixed solvent of water and alcohol; 28.8 g of the resulting 5-methylbenzotriazole silver, 16.0 g of poly(N-vinylpyrrolidone) and 1.33 g of sodium 4-sulfobenzotriazole were dispersed in water with an alumina ball mill and thereafter adjusted to pH 5.5 to prepare a dispersion (1) of organic silver salt in a yield of 200 ml.

Preparation of light-sensitive silver halide dispersion:

Silver halide emulsions D, was subjected to sulfur sensitization with sodium thiosulfate in the presence of one of the sensitizing dyes shown in Table 18 and 4-hydroxy-6-methyl-1,3,3a,7-tetrazaindene, so as to prepare a dispersion of light-sensitive silver halide having the following formulation:

silver halide (in terms of silver): 381 g
gelatin: 85 g/2820 ml

Preparation of dispersion (1) of dye-providing material:

A dye-providing material identified by No. ⑦ in the list of illustrative compounds and 5.00 g of a hydroquinone compound having the structure shown below were dissolved in 200 ml of ethyl acetate. The solution was mixed with 124 ml of an aqueous solution of 5 wt% Alkanol XC (Du Pont) and 720 ml of anaqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the pH of the dispersion was adjusted to 5.5 and its volume adjusted to 795 ml to make dispersion (1) of the dye-providing material Hydroquinone compound:

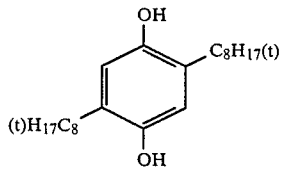

Preparation of dispersion (1) of reducing agent:

A reducing agent 23.3 g identified by (R-11) as used in Example 2, 1.10 g of a development accelerator having the formula given below, 14.6 g of poly(N-vinylpyrrolidone) and 0.50 g of a fluorine-based surfactant having the formula shown below were dissolved in water. The pH of the solution was adjusted to 5.5 and its volume to 250 ml to make a dispersion (1) of the reducing agent.

Development accelerator:

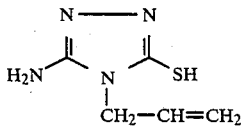

Surfactant:

$$NaO_3S-\underset{\underset{CH_2-COOCH_2(CF_2CF_2)nH}{|}}{CH}-COOCH_2(CF_2CF_2)mH$$

(m, n = 2 or 3)

Preparation of thermally developable light-sensitive material (1):

Six milliliters of the light-sensitive silver halide dispersion was mixed with 12.5 ml of the dispersion (1) of organic silver salt, 39.8 ml of the dispersion (1) of dye-providing material ⑦, 12.5 ml of the dispersion (1) of reducing agent. To the resulting mixture, 2.50 ml of a hardening agent [i.e., a solution of hardening agent prepared by reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)-methane] and 3.80 g of a hot solvent (polyethylene glycol 300 of Kanto Chemical Co., Inc.) were added. The resulting coating solution was applied to a 180 μm thick subbed photographic polyethylene terephthalate film for a silver deposit of 1.76 g/m². The applied light-sensitive layer was further coated with a protective layer made of a mixture of phenylcarbamoylated gelatin (Type 17819PC of Rousselot Inc.) and poly(N-vinylpyrrolidone).

Preparation of image-receiving member (1):

An image-receiving member (1) was prepared by coating a tetrahydrofuran solution of polyvinyl chloride (n=1,100; product of Wako Pure Chemical Industries, Ltd.) on photographic baryta paper to attain a polyvinyl chloride deposit of 12 g/m².

Each of the thermally developable light-sensitive materials previously prepared was given an exposure of 1,600 C.M.S. through a step wedge, superposed on the image-receiving member, and thermally developed at 150° C. for 1 minute in a thermal developer (Developer Module 277 of 3M). Immediately thereafter, the light-sensitive material was stripped away from the image-receiving member, which carried a negative image of magenta color.

The maximum density and minimum density (fog) of the negative image formed on each of the samples were measured with a densitometer (PDA-65 of Konishiroku Photo Industry Co., Ltd.). The results are shown in Table 18.

TABLE 18

| Sample No. | Sensitizing dye (II) (mmol/mol Ag X) | | Compound (I-D) or (I-E) (mmol/mol Ag X) | | $D_{max}$ | $D_{min}$ |
|---|---|---|---|---|---|---|
| E-1 (Comparative sample) | dye A | 0.40 | — | | 2.18 | 0.25 |
| E-2 (Sample of the invention) | dye A | 0.40 | (A-1) | 0.5 | 2.21 | 0.20 |
| E-3 (Comparative sample) | dye B | 0.40 | — | | 2.17 | 0.26 |
| E-4 (Sample of the invention) | dye B | 0.40 | (A-1) | 0.5 | 2.19 | 0.21 |
| E-5 (Comparative sample) | (II-1) | 0.20 | — | | 2.15 | 0.23 |
| E-6 (Comparative sample) | (II-1) | 0.40 | — | | 2.11 | 0.25 |
| E-7 (Sample of the invention) | (II-1) | 0.40 | (A-1) | 0.5 | 2.19 | 0.15 |
| E-8 (Sample of the invention) | (II-1) | 0.40 | (A-1) | 3.0 | 2.13 | 0.13 |
| E-9 (Comparative sample) | (II-2) | 0.20 | — | | 2.24 | 0.22 |
| E-10 (Comparative sample) | (II-2) | 0.40 | — | | 2.17 | 0.24 |
| E-11 (Sample of the invention) | (II-2) | 0.40 | (A-1) | 0.5 | 2.17 | 0.16 |
| E-12 (Sample of the invention) | (II-2) | 0.40 | (A-1) | 3.0 | 2.13 | 0.13 |
| E-13 (Comparative sample) | (II-3) | 0.40 | — | | 2.17 | 0.26 |
| E-14 (Sample of the invention) | (II-3) | 0.40 | (A-1) | 0.5 | 2.15 | 0.18 |
| E-15 (Sample of the invention) | (II-3) | 0.40 | (A-2) | 0.5 | 2.17 | 0.17 |
| E-16 (Sample of the invention) | (II-3) | 0.40 | (A-3) | 0.5 | 2.24 | 0.18 |
| E-17 (Sample of the invention) | (II-3) | 0.40 | (A-28) | 3.0 | 2.18 | 0.15 |
| E-18 (Comparative sample) | (II-4) | 0.40 | — | | 2.13 | 0.25 |
| E-19 (Sample of the invention) | (II-4) | 0.40 | (A-4) | 0.5 | 2.11 | 0.15 |
| E-20 (Sample of the invention) | (II-4) | 0.40 | (A-5) | 0.5 | 2.23 | 0.14 |
| E-21 (Sample of the invention) | (II-4) | 0.40 | (A-29) | 3.0 | 2.17 | 0.16 |

The comparative sensitizing dyes, A and B, mentioned in Table 18 had the following structural formulas:

Dye A:

-continued

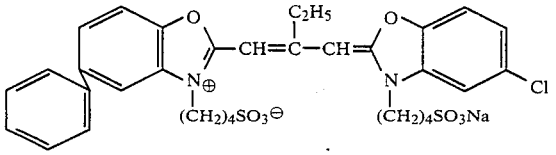

Dye B:

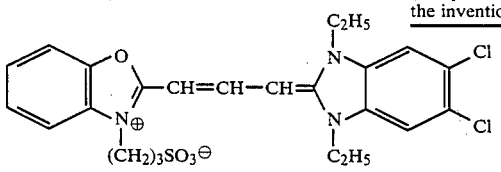

As one can see from Table 18, the samples wherein sensitizing dyes within the scope of the present invention were used in combination with restrainers of the general formula (I-D) or (I-E) were satisfactory thermally developable light-sensitive materials which experienced reduced minimum density (fog) without causing any substantial increase in maximum density.

EXAMPLE 18

Additional dispersions of light-sensitive silver halide were prepared as in Example 17 except that various silver halide emulsions were combined with sensitizing dyes and restrainers as indicated in Table 19. Samples of thermally developable light-sensitive material and an image-receiving member were prepared as in Example 17. Subsequently, the light-sensitive materials were exposed and thermally developed as in Example 17 to attain a magenta transfer image. The maximum density, minimum density and sensitivity of the magenta transfer image formed on each sample are indicated in terms of relative values, with the value for sample E-22 being taken as 100. Sensitivity is the reciprocal of the amount of exposure necessary to provide a density of fog+0.2.

TABLE 19

| Sample No. | Emulsion | Sensitizing dye (I) (mmol/mol Ag X) | | Compound (I-D) or (I-E) (mmol/mol Ag X) | | Sensitivity | $D_{max}$ | $D_{min}$ |
|---|---|---|---|---|---|---|---|---|
| E-22 (Comparative sample) | A | (II-1) | 0.40 | — | | 100 | 2.13 | 0.25 |
| E-23 (Sample of the invention) | A | (II-1) | 0.40 | (A-1) | 0.5 | 90 | 2.15 | 0.17 |
| E-24 (Comparative sample) | D | (II-1) | 0.40 | — | | 240 | 2.19 | 0.45 |
| E-25 (Sample of the invention) | D | (II-1) | 0.40 | (A-1) | 0.5 | 220 | 2.13 | 0.16 |
| E-26 (Comparative sample) | E | (II-1) | 0.40 | — | | 305 | 2.18 | 0.43 |
| E-27 (Sample of the invention) | E | (II-1) | 0.40 | (A-1) | 0.5 | 285 | 2.15 | 0.17 |
| E-28 (Comparative sample) | G | (II-1) | 0.40 | — | | 255 | 2.15 | 0.52 |
| E-29 (Sample of the invention) | G | (II-1) | 0.40 | (A-1) | 0.5 | 225 | 2.20 | 0.17 |
| E-30 (Comparative sample) | F | (II-1) | 0.40 | — | | 420 | 1.13 | 0.47 |
| E-31 (Sample of the invention) | F | (II-1) | 0.40 | (A-1) | 0.5 | 390 | 1.05 | 0.21 |
| E-32 (Comparative sample) | B | (II-1) | 0.40 | — | | 150 | 2.15 | 0.30 |
| E-33 (Sample of the invention) | B | (II-1) | 0.40 | (A-1) | 0.5 | 125 | 2.13 | 0.14 |
| E-34 (Comparative sample) | C | (II-1) | 0.40 | — | | 220 | 2.17 | 0.41 |
| E-35 (Sample of the invention) | C | (II-1) | 0.40 | (A-1) | 0.5 | 190 | 2.19 | 0.14 |

As one can see from Table 19, thermal fog (i.e., fog due to thermal development) could be suppressed in a more effective manner when the sensitizing dyes within the scope of the present invention were used in combination with restrainers of formula (I-D) or (I-E). It is also clear from Table 19 that compared to a purely silver bromide emulsion, high-sensitivity and low-fog thermally developable light-sensitive materials can be attained by applying the present invention to silver iodobromide emulsions, in particular, those having a silver iodide content of 4 mol% or more. Table 19 also shows that among the silver iodobromide emulsions, core/shell type emulsions are capable of attaining particularly good results, (i.e., high sensitivity and low fog) by applying the present invention.

EXAMPLE 19

Dispersions of light-sensitive silver halide were prepared as in Example 17 except that the sensitizing dyes shown in Table 20 were used.

Preparation of dispersion (2) of dye-providing material

Thirty grams of a dye-providing material 3 as used in Example 2 was dissolved in 30.0 g of tricresyl phosphate and 90.0 ml of ethyl acetate.

The solution was mixed with 460 ml of an aqueous gelatin solution containing the same surfactant as used in Example 17; the mixture was dispersed with an ultrasonic homogenizer and the ethyl acetate was distilled off. By addition of water to make a total volume of 500 ml, dispersion (2) of the dye providing material was produced.

Preparation of thermally developable light-sensitive material (2)

Forty milliliters of one of the previously prepared dispersion of light-sensitive silver halide was mixed with 25.0 ml of the dispersion (1) of organic silver salt prepared in Example 17 and 50.0 ml of the dispersion (2) of dye-providing material 3 . To the resulting mixture were added 4.20 g of a hot solvent (polyethylene glycol 300 of Kanto Chemical Co., Inc.), 1.5 ml of a methanol solution of 10 wt% 1-phenyl-4,4-dimethyl-3-pyrazolidone, 3.00 ml of the same solution of hardening agent as used in Example 17, and 20.0 ml of a solution of 10 wt% guanidinetrichloroacetic acid in a mixture of water and alcohol, aminophenol. The resulting coating solution was applied to a 180 μm thick subbed photographic polyethylene terephthalate film for a silver deposit of 2.50 g/m$^2$. By these procedures, sample Nos. E-36 to E-56 of thermally developable light-sensitive material (2) having the compositions shown in Table 20 were prepared.

Preparation of image-receiving member (2)

An image-receiving member was prepared by successively coating the following layers on a 100 μm thick transparent polyethylene terephthalate film:

(1) polyacrylic acid layer (7.00 g/m$^2$);

(2) acetylcellulose layer (4.00 g/m$^2$); and (3) layer made of a 1:1 copolymer of styrene and N-benzyl-N,N-dimethyl-N-(3-maleimidopropyl)ammonium chloride and gelatin (copolymer, 3.00 g/m$^2$; gelatin, 3.00 g/m$^2$).

Each of the 29 samples of thermally developable light-sensitive material (2) (sample Nos. E-58 to E-86) was given an exposure of 1,600 C.M.S. through a step wedge, heated on a heat block for 1 minute at 150° C., superimposed on the image-receiving member (2) while it was submerged in water, and the two members were compressed together at 500–800 g/cm$^2$ for 30 seconds at 50° C. Immediately thereafter, the two members were stripped apart from each other. The transmission density of the yellow transparent image formed on the surface of the image-receiving element was measured with a densitometer (PDA-65 of Konishiroku Photo Industry Co., Ltd.). The respective values of maximum density and minimum density (fog) attained for each sample are shown in Table 20.

TABLE 20

| Sample No. | Sensitizing dye (II) (mmol/mol Ag X) | Compound (I-D) or (I-E) (mmol/mol Ag X) | $D_{max}$ | $D_{min}$ |
|---|---|---|---|---|
| E-36 (Comparative sample) | dye A 0.40 | — | 2.23 | 0.30 |
| E-37 (Sample of the invention) | dye A 0.40 | (A-1) 0.5 | 2.18 | 0.27 |
| E-38 (Comparative example) | dye B 0.40 | — | 2.16 | 0.31 |
| E-39 (Sample of the invention) | dye B 0.40 | (A-1) 0.5 | 2.14 | 0.27 |
| E-40 (Comparative sample) | (II-1) 0.20 | — | 2.13 | 0.27 |
| E-41 (Comparative sample) | (II-1) 0.40 | — | 2.11 | 0.30 |
| E-42 (Sample of the invention) | (II-1) 0.40 | (A-1) 0.5 | 2.21 | 0.23 |
| E-43 (Sample of the invention) | (II-1) 0.40 | (A-1) 3.0 | 2.17 | 0.19 |
| E-44 (Comparative sample) | (II-2) 0.20 | — | 2.25 | 0.29 |
| E-45 (Comparative sample) | (II-2) 0.40 | — | 2.16 | 0.31 |
| E-46 (Sample of the invention) | (II-2) 0.40 | (A-1) 0.5 | 2.22 | 0.19 |
| E-47 (Sample of the invention) | (II-2) 0.40 | (A-1) 3.0 | 2.21 | 0.17 |
| E-48 (Comparative sample) | (II-3) 0.40 | — | 2.18 | 0.31 |
| E-49 (Sample of the invention) | (II-3) 0.40 | (A-1) 0.5 | 2.19 | 0.20 |
| E-50 (Sample of the invention) | (II-3) 0.40 | (A-2) 0.5 | 2.14 | 0.21 |
| E-51 (Sample of the invention) | (II-3) 0.40 | (A-3) 0.5 | 2.17 | 0.19 |
| E-52 (Sample of the invention) | (II-3) 0.40 | (A-28) 3.0 | 2.13 | 0.18 |
| E-53 (Comparative sample) | (II-4) 0.40 | — | 2.17 | 0.32 |
| E-54 (Sample of the invention) | (II-4) 0.40 | (A-4) 0.5 | 2.25 | 0.19 |
| E-55 (Sample of the invention) | (II-4) 0.40 | (A-5) 0.5 | 2.11 | 0.18 |
| E-56 (Sample of the invention) | (II-4) 0.40 | (A-29) 3.0 | 2.15 | 0.20 |

As one can see from Table 20, the effectiveness of combining the sensitizing dyes of the present invention with restrainers of formula (I-D) or (-E) was also apparent in thermally developable light-sensitive materials employing a reducing dye-providing material; they experienced reduced fog during thermal development.

EXAMPLE 20

Additional dispersions of light-sensitive silver halide were prepared as in Example 19 except that various silver halide emulsions were combined with sensitizing dyes and restrainers as shown in Table 21. Samples of thermally developable light-sensitive material and an image-receiving member were prepared as in Example 19. Subsequently, the light-sensitive materials were exposed and thermally developed as in Example 19 to attain a yellow transfer image. The maximum density, minimum density and sensitivity of the yellow transfer image formed on each sample are indicated in terms of relative values, with the value for sample E-57 being taken as 100. Sensitivity is the reciprocal of the amount of exposure necessary to provide a density of fog+0.2.

TABLE 21

| Sample No. | Emulsion | Sensitizing dye (II) (mmol/mol Ag X) | Compound (I-D) or (I-E) (mmol/mol Ag X) | Sensitivity | $D_{max}$ | $D_{min}$ |
|---|---|---|---|---|---|---|
| E-57 (Comparative sample) | A | (II-1) 0.40 | — | 100 | 2.16 | 0.30 |
| E-58 (Sample of the invention) | A | (II-1) 0.40 | (A-1) 0.5 | 90 | 2.13 | 0.20 |
| E-59 (Comparative sample) | D | (II-1) 0.40 | — | 246 | 2.20 | 0.45 |
| E-60 (Sample of the invention) | D | (II-1) 0.40 | (A-1) 0.5 | 230 | 2.23 | 0.20 |
| E-61 (Comparative sample) | E | (II-1) 0.40 | — | 310 | 2.17 | 0.45 |
| E-62 (Sample of the invention) | E | (II-1) 0.40 | (A-1) 0.5 | 300 | 2.13 | 0.21 |
| E-63 (Comparative sample) | G | (II-1) 0.40 | — | 240 | 2.24 | 0.50 |
| E-64 (Sample of the invention) | G | (II-1) 0.40 | (A-1) 0.5 | 230 | 2.18 | 0.23 |
| E-65 (Comparative sample) | F | (II-1) 0.40 | — | 430 | 1.05 | 0.48 |
| E-66 (Sample of the invention) | F | (II-1) 0.40 | (A-1) 0.5 | 400 | 1.10 | 0.22 |
| E-67 (Comparative sample) | B | (II-1) 0.40 | — | 145 | 2.15 | 0.43 |
| E-68 (Sample of the invention) | B | (II-1) 0.40 | (A-1) 0.5 | 130 | 2.20 | 0.23 |
| E-69 (Comparative sample) | C | (II-1) 0.40 | — | 210 | 2.20 | 0.40 |
| E-70 (Sample of the invention) | C | (II-1) 0.40 | (A-1) 0.5 | 185 | 2.13 | 0.20 |

As one can see from Table 21, even thermally developable light-sensitive materials employing a reducing dye-providing material can be provided with better resistance to thermal fog (i.e., fog due to thermal development) by using the sensitizing dyes of the present invention in combination with restrainers of formula (I-D) or (I-E). It is also clear from Table 21 that compared to a purely silver bromide emulsion, high-sensitivity and low-fog thermally developable light-sensitive materials can be attained by applying the present invention to silver iodobromide emulsions, in particular, those having a silver iodide content of 4 mol% or more. Table 21 also shows that among the silver iodobromide emulsions, core/shell type emulsions are capable of attaining particularly good results (ie., high sensitivity and low fog) by applying the present invention.

We claim:

1. A thermally developable light-sensitive material which has at least one light-sensitive silver halide layer containing a reducing agent and a dye-providing material on a color support and which further contains a compound represented by the general formula (I):

$$X((J)_m F)_n \quad (I)$$

wherein X is a development restrainer residue capable of functioning without being released from said compound; J is a divalent linkage; F is an immobilizing group that is capable of reducing the diffusibility of the compound of formula (I) or a silver salt or silver complex thereof during thermal development; m is 0 or 1; and n is an integer of 1 to 3.

2. A thermally developable light-sensitive material according to claim 1 wherein the immobilizing group denoted by F in the formula (I) is a ballast group.

3. A thermally developable light-sensitive material according to claim 1 wherein the immobilizing group denoted by F in the formula (I) is a polymer residue having a building block derived from an ethylenically unsaturated group or a group having an ethylenically unsaturated group.

4. A thermally developable light-sensitive material according to claim 1 wherein the residue of development restrainer denoted by X in formula (I) is the residue of an organic compound represented by one of the following general formulas (1) to (17):

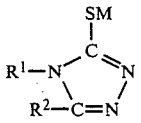

(1)

(where $R^1$ and $R^2$ are each a hydrogen atom, an alkyl group or an aryl group; and M is a hydrogen atom, an alkali metal atom, an ammonium group or an organic amino residue);

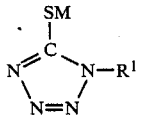

(2)

(where $R^1$ is an alkyl group, an aryl group or a hydrogen atom; and M has the same meaning as M in formula (1));

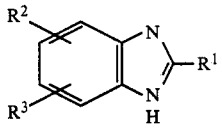

(3)

(where $R^1$ is a hydrogen atom, an alkyl group, an aryl group or

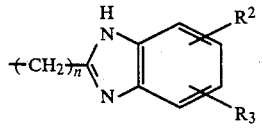

where n is 1 or 2; $R^2$ and $R^3$ are each a hydrogen atom, an alkyl group, an aryl group or a nitro group, provided that $R^2$ may combine with $R^3$ to form a 5- or 6-membered ring)

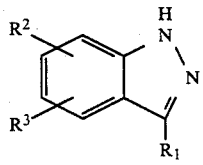

(4)

(where $R^1$ is an alkyl group, an aryl group or a hydrogen atom; $R^2$ and $R^3$ are each a hydrogen atom, an alkyl group, an aryl group or a nitro group, provided that $R^2$ may combine with $R^3$ to form a 5- or 6-membered ring);

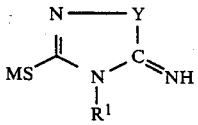

(5)

(where Y is

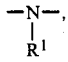

—O— or —S—; $R^1$ is an alkyl group, an aryl group or a hydrogen atom; and M has the same meaning as M in formula (1));

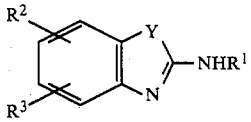

(where Y is —O—, —S—,

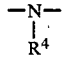

or

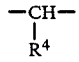

$R^1$ and $R^4$ are each an alkyl group, an aryl group or a hydrogen atom; $R^2$ and $R^3$ are each a hydrogen atom, an alkyl group, an aryl group or a nitro group, provided that $R^2$ may combine with $R^3$ to form a 5- or 6-membered ring);

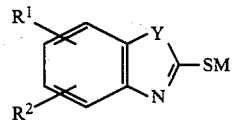

(where Y has the same meaning as Y in formula (6); $R^1$ and $R^2$ have the same meanings as $R^2$ and $R^3$ in formula (6); and M has the same meaning as M in formula (1));

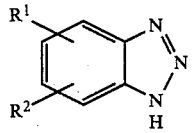

(8)

(where $R^1$ and $R^2$ are each a hydrogen atom, an alkyl group, an aryl group, a nitro group or a halogen atom, provided that $R^1$ may combine with $R^2$ to form a 5- or 6-membered ring);

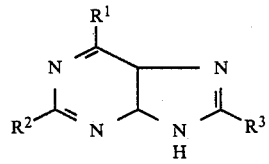

(9)

(where $R^1$, $R^2$ and $R^3$ are each an alkyl group, an amino group, an alkoxy group, a thioalkoxy group, —SM where M has the same meaning as M in formula (1), a hydroxyl group or a hydrogen atom);

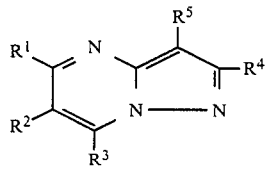

(10)

(where $R^1$, $R^2$, $R^3$, $R^4$ and $R^5$ are each a hydrogen atom, an alkyl group, an aryl group, $R^6$—NH— where $R^6$ is a hydrogen atom, an alkyl grup or an aryl grup, —SM where M has the same meaning as M in formula (1), an alkylthio group, a hydroxyl group or an alkoxy group);

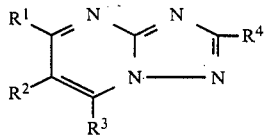

(11)

(where $R^1$, $R^2$, $R^3$ and $R^4$ each has the same meaning as $R^1$ to $R^5$ in formula (10));

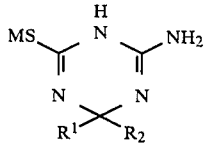

(12)

(where $R^1$ and $R^2$ are each an alkyl group or a hydrogen atom; and M has the same meaning as M in formula (1))

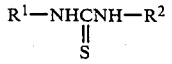

(13)

(where $R^1$ and $R^2$ are each an alkyl group, an aryl group or a hydrogen atom, provided that $R^1$ may combine with $R^2$ to form a 5- or 6-membered ring);

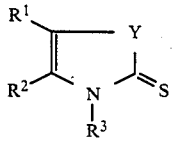

(14)

(where $R^1$, $R^2$ and $R^3$ are each an alkyl group, an aryl group or a hydrogen atom, provided that $R^1$ may combine with $R^2$ to form a 5- or 6-membered ring; Y is —O—, —S— or

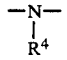

where $R^4$ is a hydrogen atom or an alkyl group);

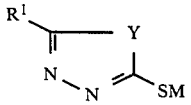

(15)

(where $R^1$ is an alkyl group, an aryl group or a hydrogen atom; Y is —O—, —S— or

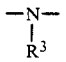

where $R^3$ is a hydrogen atom or an alkyl group; and M has the same meaning as M in formula (1));

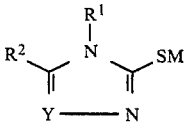

(16)

(where Y is

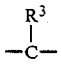

or =N— where $R^3$ is a hydrogen atom or an alkyl group; $R^1$ and $R^2$ are each an alkyl group, an aryl group or a hydrogen atom, provided that $R^1$ and $R^2$ may combine with each other to form a 5- or 6-membered ring; and M has the same meaning as M in formula (1));

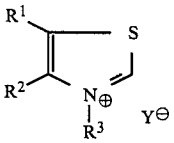

(17)

(where $R^1$, $R^2$ and $R^3$ have the same meanings as $R^1$ to $R^3$ in formula (14) and $Y^{\ominus}$ is a counter anion).

5. A thermally developable light-sensitive material according to claim 4 wherein the residue of development restrainer denoted by X in formula (I) is the residue of a nitrogenous hetero ring having an —SM group where M is a hydrogen atom, an alkali metal, an ammonium group or an organic amino residue.

6. A thermally developable light-sensitive material according to claim 2 wherein n in formula (I) is 1.

7. A thermally developable light-sensitive material according to claim 6 wherein the ballast group is an organic group having 8–40 carbon atoms.

8. A thermally developable light-sensitive material according to claim 6 wherein the ballast group is an alkyl group having 8–30 carbon atoms which is unsubstituted or substituted by a hydrophilic group.

9. A thermally developable light-sensitive material according to claim 3 wherein m and n in formula (I) are 0 and 1, respectively.

10. A thermally developable light-sensitive material according to claim 9 wherein the ethylenically unsaturated group is represented by the following general formula (18):

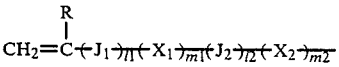

(18)

where R is a hydrogen atom, a carboxyl group or an alkyl group, provided that if R is a carboxyl group, said carboxyl group may form a salt; $J_1$ and $J_2$ are each a divalent linkage; $X_1$ and $X_2$ are each a divalent hydrocarbon group; k, $l_1$, $m_1$ $l_1$ and $m_2$ are each 0 or 1.

11. A thermally developable light-sensitive material according to claim 1 wherein the residue of development restrainer denoted by X in formula (I) contains a compound represented by the following general formula (19) or (20), said material further containing a compound represented by the following general formula (II), (III) or (IV):

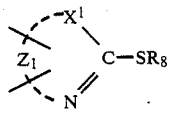

(19)

where $X^1$ is —O—, —S—, —SE or $>N(L_3)_{n4}R_9$; $Z_1$ represents the nonmetallic atomic group necessary for forming a 5- or 6-membered heterocyclic ring (including the case where unsaturated rings are condensed); $L_3$ is a divalent group; $n_4$ is 0 or 1; $R_9$ is a hydrogen atom, a halogen atom, a mercapto group, a hydroxyl group, a carboxylic acid group or a salt thereof, a sulfonic acid group or a salt thereof, an alkyl group or an aryl group; $R_8$ is a hydrogen atom, an alkali metal ion, a quaternary ammonium ion or a quaternary phosphonium ion;

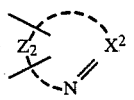

(20)

where $X_2$ is a carbon or nitrogen atom participating in the formation of an unsaturated ring; $Z_2$ represents the nonmetallic atomic group necessary for forming a 5- or 6-membered heterocyclic ring (including the case where unsaturated rings are condensed);

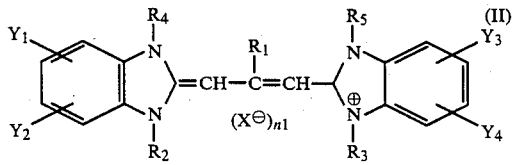

(II)

where $Y_1$, Yhd 2, $Y_3$ and $Y_4$ are each a hydrogen atom, a halogen atom, an acyl group, an acylamido group, an acyloxy group, an alkoxycarbonyl group, an aryloxycarbonyl group, an alkoxycarbonylamino group, a cyano group, a sulfonyl group, an alkyl group or an aryl group, provided that $Y_1$ and $Y_2$ (and/or $Y_3$ and $Y_4$) may combine with each other to form a naphthodiazole ring; $R_1$ is a hydrogen atom or an alkyl group; $R_2$, $R_3$, $R_4$ and $R_5$ are each an alkyl or alkenyl group; $X^{\ominus}$ is an anion; n1 is 0 or 1, provided that when n1 is 0, $R_2$, $R_3$, $R_4$ or $R_5$ represents a group capable of forming an intramolecular salt;

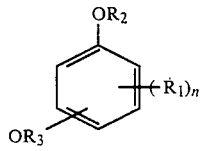

[III]

where $R_1$ is a halogen atom, an alkyl group, an aryl group, an acyl group, an alkyloxycarbonyl group, an aryloxycarbonyl group, an alkylsulfonyl group, an arylsulfonyl group, an alkylamino group, an arylamino group, a carbamoyl group, an acylamino group, an alkoxy group, a sulfamoyl group, a sulfonic acid group or a salt thereof, a carboxylic acid group or a salt thereof, or a nitro group; $R_2$ and $R_3$ are each a hydrogen atom or a protective group that is eliminated upon decomposition; and n is an integer of 1 to 4;

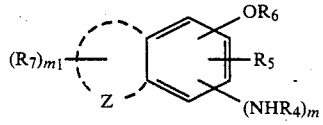

[IV]

where $R_4$ is a hydrogen atom, an alkyl group, an acyl group, an alkylsulfonyl group, an arylsulfonyl group, an alkylaminosulfonyl group or an arylaminosulfonyl group; $R_5$ is a hydrogen atom, a halogen atom, an alkyl group, an aryl group, an alkoxy group, an acylamino group or a sulfamoyl group; $R_6$ is a hydrogen atom or a protective group that will be eliminated upon decomposition; Z is $(R_5)_2$ or the atomic group necessary for forming a condensed carbon ring, provided that when Z is $(R_5)_2$, $R_5$ may be the same or different; $R_7$ is a group having no less than 7 carbon atoms; m is an integer of 0 to 2; and n is 0 or 1.

12. A thermally developable light-sensitive material according to claim 1 which further contains an organic silver salt and a binder.

13. A thermally developable light-sensitive material according to claim 1, wherein the residue of development restrainer denoted by X in formula (I) is the residue of an organic compound which forms a silver salt having a solubility product (pKsg) of 10 or more in water at 25 C.

14. A thermally developable light-sensitive material according to claim 17, wherein the residue of development restrainer denoted by X in formula (I) is the residue of an organic compound which forms a silver salt having a solubility product (pKsg) of 10 or more in water at 25 C.

15. A thermally developable light-sensitive material according to claim 2, wherein the residue of development restrainer denoted by X in formula (I) is the residue of an organic compound which forms a silver salt having a solubility product (pksg) of 10 or more in water at 25 C.

16. A thermally developable light-sensitive material according to claim 3, wherein the residue of development restrainer denoted by X in formula (I) is the residue of an organic compound which forms a silver salt having a solubility product (pKsg) of 10 or more in water at 25 C.

17. The thermally developable light-sensitive material of claim 1 wherein the immobilizing group denoted by F in formula (I) is a hydrophilic group chosen from the group consisting of a hydroxyl group, a carboxyl group or a salt thereof, a sulfo group or a salt thereof, and a sulfinic acid group or a salt thereof.

* * * * *